US006774876B2

(12) United States Patent
Inukai

(10) Patent No.: US 6,774,876 B2
(45) Date of Patent: Aug. 10, 2004

(54) SELF LIGHT EMITTING DEVICE AND DRIVING METHOD THEREOF

(75) Inventor: Kazutaka Inukai, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 254 days.

(21) Appl. No.: 09/965,567

(22) Filed: Sep. 27, 2001

(65) Prior Publication Data

US 2002/0039087 A1 Apr. 4, 2002

(30) Foreign Application Priority Data

Oct. 2, 2000 (JP) ..... 2000-302447
Oct. 24, 2000 (JP) ..... 2000-323453

(51) Int. Cl.[7] ..... G09G 3/30
(52) U.S. Cl. ..... 345/76; 345/82; 315/169.3
(58) Field of Search ..... 345/76, 77, 78, 345/79, 80, 81, 82, 83; 315/169.1, 169.2, 169.3

(56) References Cited

U.S. PATENT DOCUMENTS

| | | | | |
|---|---|---|---|---|
| 4,070,663 A | | 1/1978 | Kanatani et al. | 340/324 |
| 4,773,738 A | | 9/1988 | Hayakawa et al. | 350/350 S |
| 5,091,722 A | | 2/1992 | Kitajima et al. | 340/784 |
| 5,200,846 A | | 4/1993 | Hiroki et al. | 359/57 |
| 5,225,823 A | | 7/1993 | Kanaly | 340/793 |
| 5,302,966 A | | 4/1994 | Stewart | 345/76 |
| 5,349,366 A | | 9/1994 | Yamazaki et al. | 345/92 |
| 5,424,752 A | | 6/1995 | Yamazaki et al. | 345/92 |
| 5,471,225 A | | 11/1995 | Parks | 345/98 |
| 5,479,283 A | | 12/1995 | Kaneko et al. | 359/79 |
| 5,600,169 A | | 2/1997 | Burgener et al. | 257/352 |
| 5,642,129 A | | 6/1997 | Zavracky et al. | 345/100 |
| 5,712,652 A | | 1/1998 | Sato et al. | 345/90 |
| 5,798,746 A | | 8/1998 | Koyama | 345/98 |
| 5,990,629 A | | 11/1999 | Yamada et al. | 315/169.3 |
| 6,040,819 A | | 3/2000 | Someya | 345/147 |
| 6,091,203 A | | 7/2000 | Kawashima et al. | 315/169.3 |
| 6,157,356 A | * | 12/2000 | Troutman | 345/82 |
| 6,229,506 B1 | | 5/2001 | Dawson et al. | 345/82 |

(List continued on next page.)

FOREIGN PATENT DOCUMENTS

| | | |
|---|---|---|
| EP | 1 111 574 A2 | 6/2001 |
| EP | 1 148 467 A2 | 10/2001 |
| JP | 4-350627 | 12/1992 |
| JP | 6-102530 | 4/1994 |
| JP | 07-175439 | 7/1995 |
| JP | 10-312173 | 11/1998 |
| WO | WO 99/65012 | 12/1999 |

OTHER PUBLICATIONS

Inukai, K. et al, "36.4L: Late–News Paper: 4.0–in. TFT–OLED Displays and a Novel Digital Driving Method," SID 00 Digest, pp. 924–927 (2000).

(List continued on next page.)

*Primary Examiner*—Xiao Wu
(74) *Attorney, Agent, or Firm*—Cook, Alex, McFarron, Manzo, Cummings & Mehler, Ltd.

(57) ABSTRACT

A self light emitting device in which pseudo contours are not easily generated, and a method of driving the self light emitting device, are provided. In order to prevent visualization of display irregularities such as pseudo contours, sub-frame periods are divided in order from the longest, and the sub-frame periods which have been divided (divided sub-frame periods) are distributed within the one frame period in order not to appear consecutively. Then, from among a plurality of divided sub-frames, data read in during the first divided sub-frame period is stored in memory of each pixel, and the stored data is read out during other divided sub-frame display periods and display is performed. Observation of display hindrances such as pseudo contours conspicuous in time division driving by a binary code method can thus be prevented in accordance with the above structure.

34 Claims, 28 Drawing Sheets

U.S. PATENT DOCUMENTS

| | | | | |
|---|---|---|---|---|
| 6,229,508 | B1 | 5/2001 | Kane | 345/82 |
| 6,373,454 | B1 | 4/2002 | Knapp et al. | 345/76 |
| 6,396,105 | B1 * | 5/2002 | Yamazaki et al. | 257/350 |
| 6,452,341 | B1 * | 9/2002 | Yamauchi et al. | 315/169.1 |
| 6,542,138 | B1 * | 4/2003 | Shannon et al. | 345/76 |
| 6,563,480 | B1 * | 5/2003 | Nakamura | 345/82 |
| 2003/0057423 | A1 * | 3/2003 | Shimoda et al. | 257/80 |

OTHER PUBLICATIONS

Tsutsui, T. et al, "Electroluminescence in Organic Thin Films," Photochemical Processes in Organized Molecular Systems, pp. 437–450, 1991.

Baldo, M.A. et al, "Highly Efficient Phosphorescent Emission from Organic Electroluminescent Devices," Nature, vol. 395, pp. 151–154, Sep. 10, 1998.

Baldo, M.A. et al, "Very High–Efficiency Green Organic Light–Emitting Devices Based on Electrophosphorescence," Applied Physics Letters, vol. 75, No. 1, pp. 4–6, Jul. 5, 1999.

Tsutsui, T. et al, "High Quantum Efficiency in Organic Light–Emitting Devices with Iridium–Complex as a Triplet Emissive Center," Japanese Journal of Appled Physics, vol. 38, part 2, No. 12B, pp. L 1502–L 1504, Dec. 15, 1999.

U.S. patent application No. 09/707,054 (pending) to Yamazaki et al, filed Nov. 6, 2000, including specification, claims, abstract, drawings and PTO filing receipt.

English translation re Japanese Patent Application No. JP 4–350627, published Dec. 4, 1992.

English translation re Japanese Patent Application No. JP 6–102530, published Apr. 15, 1994.

English abstract re Japanese Patent Application No. JP 10–214060, published Aug. 11, 1998.

English abstract re Japanese Patent Application No. JP 10–232649, published Sep. 2, 1998.

English translation re Japanese Patent Application No. JP 10–312173, published Nov. 24, 1998.

* cited by examiner

SELF LIGHT EMITTING DEVICE AND DRIVING METHOD THEREOF

BACKGROUND OF THE INVENTION

1. Field of the Invention

The present invention relates to an EL panel in which EL elements formed on a substrate are enclosed between the substrate and a cover material. Further, the present invention relates to an EL module in which an IC is mounted in the EL panel. Note that EL panels and EL modules are referred to generically by the term "self light emitting device" in this specification. In addition, the present invention relates to electronic devices using the self light emitting device.

2. Description of the Related Art

EL elements have high visibility because light is self emitted, and are optimal for making a display thin because a backlight like used for an liquid crystal display (LCD) is not required. Along with this, their angle of view has no limits. Self light emitting devices using EL elements have thus come under the spotlight as substitute display devices for CRTs and LCDs.

EL elements have a layer containing an organic compound in which electro luminescence is generated by adding an electric field (hereafter referred to as an EL layer), an anode, and a cathode. There is emission of light in the organic compound in returning to a base state from a singlet excitation state (fluorescence), and in returning to a base state from a triplet excitation state (phosphorescence), and the self light emitting device of the present invention may use either type of light emission.

Note that all layers formed between the anode and the cathode are defined as EL layers in this specification. Specifically, layers such as a light emitting layer, a hole injecting layer, an electron injecting layer, a hole transporting layer, and an electron transporting layer are included as EL layers. An EL element basically has a structure in which an anode, a light emitting layer, and a cathode are laminated in the stated order. In addition to this structure, the EL element may also have a structure in which an anode, a hole injecting layer, a light emitting layer, and a cathode are laminated in the stated order, or a structure in which layers such as an anode, a hole injecting layer, a light emitting layer, an electron transporting layer, and a cathode are laminated in the stated order.

Furthermore, an EL element emitting light is referred to as the EL element being driven in this specification. Moreover, an element formed by an anode, an EL layer, and a cathode is referred to as an EL element within this specification.

There are mainly analog drive and digital drive as methods of driving a self light emitting display device which has EL elements. In particular, with respect to the digital drive, it is possible to display an image using a digital video signal with image information (digital video signal) without converting it to analog, corresponding to a digitalized broadcast signal, and therefore the digital drive is promising.

A surface area division driving method and a time division driving method can be given as driving methods for performing gray scale display in accordance with two voltage values of a digital video signal.

The surface area division driving method is a driving method for performing gray scale display by dividing one pixel into a plurality of sub-pixels and driving each sub-pixel independently based upon a digital video signal. One pixel must be divided into a plurality of sub-pixels with this surface area driving method. In addition, it is also necessary to form pixel electrodes corresponding to each of the sub-pixels in order to drive the divided sub-pixels independently. Thus, a difficulty that the pixel structure is complex develops.

On the other hand, the time division driving method is a driving method for performing gray scale display by controlling the length of time during which pixels are turned on. Specifically, one frame period is divided into a plurality of sub-frame periods. Each pixel is then placed in a turned on or turned off state in each sub-frame period in accordance with a digital video signal. The gray scale of a certain pixel is found by summing lengths of all the sub-frame periods that the pixel is turned on during, of the sub-frame periods within one frame period.

In general, the response speed of organic EL materials is fast compared to liquid crystals and the like, and therefore organic EL materials are suitable for time division driving.

A case of displaying mid-level gray scales by time division driving in accordance with a simple binary code method is explained in detail below using FIGS. 27A and 27B.

FIG. 27A shows a pixel portion of a general self light emitting device, and the lengths of all sub-frame periods within one frame period in the pixel portion are shown in FIG. 27B.

An image is displayed using a 6 bit digital video signal which is capable of displaying 1 to 64 gray scales in FIGS. 27A and 27B. The right half portion of the pixel portion performs displaying of 33rd (32+1) gray scale, and the left half of the pixel portion performs displaying of 32nd (31+1) gray scale.

Six sub-frame periods (sub-frame periods SF1 to SF6) generally appear within one frame period in the case of using a 6 bit digital video signal. The first to the sixth bits of the digital video signal correspond to the sub-frame periods SF1 to SF6, respectively.

The ratio of lengths of the sub-frame periods SF1 to SF6 become $2^0::2^1::2^2::2^3::2^4::2^5$. The length of the sub-frame period SF6 corresponding to the most significant bit (the sixth bit in this case) of the digital video signal is the longest, and the length of the sub-frame period corresponding to the least significant bit (the first bit) of the digital video signal is the shortest.

For a case of performing display of the 32nd gray scale, the pixels are placed in an on state in the sub-frame periods SF1 to SF5, and the pixels are placed in an off state during the sub-frame period SF6. Further, the pixels are placed in a turned off state during the sub-frame periods SF1 to SF5, and are turned on during the sub-frame period SF6, when performing display of the 33rd gray scale.

A pseudo contour may be visible at a boundary portion between the portion for performing display of the 32nd gray scale and the portion for performing display of the 33rd gray scale.

The term pseudo contour refers to an unnatural contour line which is repeatedly visible in performing time gray scale display in accordance with a binary code method, and it is considered that the main cause is fluctuations develop in the perceived brightness due to the characteristics of human sight. A mechanism for the generation of the pseudo contour is explained using FIGS. 28A and 28B.

FIG. 28A shows a pixel portion of a self light emitting device in which a pseudo contour develops, and FIG. 28B shows the ratio of the lengths of sub-frame periods within one frame period.

An image is displayed using a 6 bit digital video signal which is capable of displaying 1 to 64 gray scales in FIGS. 28A and 28B. The right half portion of the pixel portion performs displaying 33rd gray scales, and the left half of the pixel portion performs displaying 32nd gray scales.

The pixels are placed in an on state during 31/63 of one frame period, and are placed in an off state during 32/63 of the one frame period, in the portion of the pixel portion for performing the 32nd gray scale. Periods during which the pixels are turned on appear alternately with periods in which the pixels are turned off.

Further, the pixels are placed in an on state during 32/63 of one frame period, and the pixels are placed in an off state during 31/63 of the one frame period, in portions of the pixel portion for performing the 33rd gray scale. Periods during which the pixels are turned on appear alternately with periods in which the pixels are turned off.

In a case of displaying a moving image, the boundary between portions for displaying the 32nd gray scale and portions for displaying the 33rd gray scale in FIG. 28A is taken, for example, as moving in the direction of the dotted line. Namely, the pixels switch over from displaying the 32nd gray scale to displaying the 33rd gray scale near the boundary. Then, a turn on period for displaying the 33rd gray scale begins immediately after a turn on period for displaying the 32nd gray scale in pixels near the boundary. The human eye thus can see the pixels turned on continuously during one frame period. This is thus perceived as an unnatural bright line on the screen.

Conversely, the boundary between the portions for displaying the 32nd gray scale and the portions for displaying the 33rd gray scale in FIG. 28A is taken, for example, as moving in the direction of the solid line. Namely, the pixels switch over from displaying the 33rd gray scale to displaying the 32nd gray scale near the boundary. Then, the turn on period for displaying the 32nd gray scale begins immediately after the turn on period for displaying the 33rd gray scale in pixels near the boundary. The human eye thus can see the pixels turned off continuously during one frame period. This is thus is perceived as an unnatural dark line on the screen.

The above unnatural bright lines and dark lines appearing on a screen are display obstructions referred to as pseudo contours(moving pseudo contours).

Display obstructions may also become visible in static images due to the same cause as that by which the moving pseudo contours are developed in moving images. The display obstructions in static images are ones in which flickering motion can be seen in the boundaries of gray scales. A simple explanation of the reason why such display obstructions are visible in static images is described below.

Even if a person's eye is fixed upon one point, the visual point moves slightly, and it is difficult to stare at one point with certainty. Therefore, even if an intention is to stare at the border between portions of the pixel portion in which the pixels are performing display of the 32nd gray scale and portions in which the pixels are performing display of the 33rd gray scale when staring at the boundary, the visual point will move slightly left and right, up and down.

For example, assume that the visual point moves from portions performing display of the 32nd gray scale to portions performing display of the 33rd gray scale, as shown by the dashed line. In a case in which the pixels are in a turned off state when the visual point is located in the portions displaying the 32nd gray scale and the pixels are in a turned off state when the visual point is located in the portions displaying the 33rd gray scale, the pixels are seen to be in a turned off state through the entire one frame period by an observer's eyes.

Conversely, for example, assume that the visual point moves from portions performing display of the 33rd gray scale to portions performing display of the 32nd gray scale, as shown by the solid line. In a case in which the pixels are in a turned on state when the visual point is located in portions displaying the 32nd gray scale and the pixels are in a turned on state when the visual point is located in portions displaying the 33rd gray scale, the pixels are seen to be in a turned on state through the entire one frame period by an observer's eyes.

The pixels are therefore seen by human eyes to be in a turned on state, or in a turned off state, throughout one frame period because of the tiny movement to the left and right, up and down, of the visual point, and a display obstruction in which the boundary portion is seen to sway back and forth is seen.

SUMMARY OF THE INVENTION

The applicants of the present invention divided sub-frame periods with long periods in order to prevent pseudo contours from being seen. The sub-frame periods which are divided (divided sub-frame periods) are then distributed within one frame period so as not to appear in succession.

There may be one sub-frame period to be divided, and there may be a plurality of sub-frame periods to be divided. However, it is preferable that the division be performed in order from a sub-frame period corresponding to the most significant bit, in other words the longest sub-frame period.

Further, it is possible for a designer to appropriately select the number of divisions of sub-frame periods. It is preferable, however, that the number of divisions be determined by the balance between the driving speed for a self light emitting device and the required display quality of an image.

Furthermore, it is preferable that the lengths of divided sub-frame periods, corresponding to the same bit of a digital video signal, be the same, although the present invention is not limited to such. It is not always necessary to make the lengths of the divided sub-frame periods the same.

The above stated driving method is realized by forming memory within each pixel.

In accordance with the above structure, display obstructions such as pseudo contours, which are conspicuous in time division driving with a binary code method, can be prevented from being visible. The reason for such is explained below.

FIG. 1A shows a pixel portion of a self light emitting device, and the ratio of the lengths of sub-frame periods SF to appear during one sub-frame period (F) in the pixel portion are shown in FIG. 1B.

An image is displayed with FIGS. 1A and 1B using an n-bit digital video signal which is capable of displaying 1 to $2^n$ gray scales. The right half portion of the pixel portion performs displaying $2^{n-1}+1$ gray scale, and the left half portion performs displaying $2^{n-1}$ gray scale.

In a case of using the n-bit digital video signal in accordance with a simple binary code method, n sub-frame periods SF1 to SFn appear within one frame period. The first bit of the digital signal to the n-th bit of the digital video signal correspond to the sub-frame periods SF1 to SFn, respectively.

The ratio of lengths of the sub-frame periods SF1 to SFn become $2^0::2^1::2^2::\ .\ .\ .\ 2^{n-2}::2^{n-1}$. The length of the sub-frame period SFn corresponding to the most significant bit (the n-th bit in this case) of the digital video signal is the longest, and the length of the sub-frame period SF1 corresponding to the least significant bit (the first bit) of the digital video signal is the shortest.

In a case of performing display of the $2^{n-1}$ gray scale, the pixels are placed in an on state in the sub-frame periods SF1 to SF(n−1), and are placed in an off state during the sub-frame period SFn. Further, the pixels are placed in a turned off state during the sub-frame periods SF1 to SF(n−1), and are turned on during the sub-frame period SFn, in performing display of the $2^{n+1}+1$ gray scale.

The sub-frame period SFn which is the longest sub-frame period, is then divided into two divided sub-frame periods. Note that although the sub-frame period SFn is divided into two divided sub-frame periods here, the present invention is not limited to this number. The sub-frame period may be divided into any number as long as the operation speeds of a driving circuit and pixel TFTs can keep up therewith.

The sub-frame periods which are divided (divided sub-frame periods) do not appear in succession. A sub-frame period corresponding to another bit of the digital video signal always appears between the divided sub-frame periods.

Note that the lengths of the divided sub-frame periods may not all be the same. Further, it is not necessary to place any limitations on the order of the sub-frame periods. There are no limitations of setting the order from the sub-frame period corresponding to the most significant bit, to the sub-frame period corresponding to the least significant bit.

FIG. 2A shows a pixel portion of a self light emitting device for performing display by a driving method of the present invention, and FIG. 2B shows the lengths of sub-frame periods and divided sub-frame periods to appear within one frame period, which are divided into turn on periods and turn off (non-turn on) periods.

The right half portion of the pixel portion performs display of $2^{n-1}+1$ gray scale, and the left half portion performs display of $2^{n-1}$ gray scale in FIG. 2A.

In portions of the pixel portion performing display of $2^{n-1}$ gray scale, the pixels are placed in an on state in $(2^{n-1}-1)/2^n$ periods within one frame period, and the pixels are placed in an off state in $2^{n-1}/2^n$ periods within the one frame period. The periods during which the pixels are in an turn on state and the periods during which the pixels are in a turn off state then appear alternately.

Further, in portions of the pixel portion performing display of the number $2^{n-1}+1$ gray scale, the pixels are placed in a turned on state in $2^{n-1}/2^n$ periods within one frame period, and the pixels are placed in a turned off state in $(2^{n-1}-1)/2^n$ periods within the one frame period. The periods during which the pixels are in a turned on state and the periods during which the pixels are in a turned off state then appear alternately.

The visual point of an observer may move slightly left and right, up and down, and it is sufficiently possible to occasionally straddle other sub-frame periods or divided sub-frame periods. In this case, even if the visual point of an observer is fixed continuously on only turned off pixels, or conversely is fixed continuously on only turned on pixels, the turn on periods and the turn off periods during one frame period are divided and appear alternately. Thus, the lengths of successive turn on periods or turn off periods are therefore short compared with conventional driving with a simple binary code method, and pseudo contours can thus be prevented from being visible.

For example, the visual point is taken as moving from a portion displaying the $2^{n-1}$ gray scale to a portion displaying the $2^{n-1}+1$ gray scale, as shown the dotted line. With the driving method of the present invention, even if the pixels are in a turned off state when the visual point is located in portions displaying the $2^{n-1}$ gray scale and the pixels are in a turned off state when the visual point moves to portions displaying the $2^{n-1}+1$ gray scale, the sum of two turn off periods in succession becomes shorter than that for a conventional driving method. Therefore, the visualization by human eyes that the pixels are always in a turned off state throughout one frame period can be prevented.

Conversely, for example, the visual point is taken as moving from a portion displaying the $2^{n-1}+1$ gray scale to a portion displaying the $2^{n-1}$ gray scale. With the driving method of the present invention, even if the pixels are in a turned on state when the visual point is located in portions displaying the $2^{n-1}+1$ gray scale and the pixels are in a turned on state when the visual point moves to portions displaying the $2^{n-1}+1$ gray scale, the sum of the two turn on periods in succession becomes shorter than that for a conventional driving method. Therefore, the visualization by human eyes that the pixels are always in a turned on state throughout one frame period can be prevented.

In accordance with the above structure, display obstructions such as pseudo contours, which are conspicuous in time division drive with a binary code method, can be prevented from being visible.

Structures of the present invention are shown below.

In accordance with the present invention, there is provided a self light emitting device which comprises a plurality of pixels, each pixel comprising: an EL element; a memory; a first TFT; a second TFT; and a third TFT formed therein, characterized in that:

a digital video signal is input to one of a source region and a drain region of the first TFT, while the other is connected to a gate electrode of the third TFT;

one of a source region and a drain region of the second TFT is connected to the memory, while the other is connected to the gate electrode of the third TFT; and a source region of the third TFT is connected to a first electric power source, and a drain region of the third TFT is connected to the EL element.

In accordance with the present invention, there is provided a self light emitting device which comprises a plurality of pixels, each pixel comprising: an EL element; an SRAM; a first TFT; a second TFT; and a third TFT formed therein, characterized in that:

a digital video signal is input to one of a source region and a drain region of the first TFT, while the other is connected to a gate electrode of the third TFT;

one of a source region and a drain region of the second TFT is connected to the SRAM, while the other is connected to the gate electrode of the third TFT; and a source region of the third TFT is connected to a first electric power source, and a drain region of the third TFT is connected to the EL element.

In accordance with the present invention, there is provided a method of driving a self light emitting device which comprises a plurality of pixels, each pixel comprising an EL element, a memory, a first TFT, a second TFT, and a third TFT formed therein, the method comprises:

a period during which a p bit of a digital signal is input to a gate electrode of the third TFT through the first TFT, and during which the p bit of the digital signal is written into the memory through the first TFT and the second TFT;

a period during which a q bit of the digital signal is input to the gate electrode of the third TFT through the first TFT, and during which the p bit of the digital signal written into the memory is stored; and a period during which the p bit of the digital signal stored in the memory is read out, and then input to the gate electrode of the third TFT, characterized in that light emission of the EL element is controlled by controlling switching of the third TFT in accordance with the p bit of the digital signal and the q bit of the digital signal.

In accordance with the present invention, there is provided a method of driving a self light emitting device which comprises a plurality of pixels, each pixel comprising: an EL element; a memory; a first TFT; a second TFT; and a third TFT formed therein, characterized in that:

input of a digital video signal to the pixel is controlled by the first TFT;

write in to the memory and read out from the memory of a portion of bits of the digital video signal input is controlled by the second TFT;

switching of the third TFT is controlled in accordance with the portion of bits of the digital video signal read out from the memory or the digital video signal input to the pixel; and light emission of the EL element is controlled by the third TFT.

In accordance with the present invention, there is provided a method of driving a self light emitting device which comprises a plurality of pixels, each pixel comprising an EL element and a memory formed therein, characterized in that:

a plurality of sub-frame periods are formed in one frame period;

at least one sub-frame period from among the plurality of sub-frame periods comprises a plurality of divided sub-frame periods;

a digital video signal is written into the memory in at least one divided sub-frame period from among the plurality of divided sub-frame periods;

the digital video signal is read out from the memory in the divided sub-frame period which appears after the divided sub-frame period during which the digital video signal is written into the memory; and light emission from the EL element is controlled in accordance with the digital video signal input to the pixel or the digital video signal read out from the memory.

In accordance with the present invention, there is provided a method of driving a self light emitting device comprises a plurality of pixels, each pixel comprising an EL element, an SRAM, a first TFT, a second TFT, and a third TFT formed therein, the method comprises:

a period during which a p bit of a digital signal is input to a gate electrode of the third TFT through the first TFT, and during which the number p bit of the digital signal is written into the SRAM through the first TFT and the second TFT;

a period during which a q bit of the digital signal is input to the gate electrode of the third TFT through the first TFT, and during which the p bit of the digital signal written into the SRAM is stored; and a period during which the p bit of the digital signal stored in the SRAM is read out, and then input to the gate electrode of the third TFT, characterized in that light emission of the EL element is controlled by controlling switching of the third TFT in accordance with the p bit of the digital signal and the number q bit of the digital signal.

In accordance with the present invention, there is provided a method of driving a self light emitting device which comprises a plurality of pixels, each pixel comprising an EL element, an SRAM, a first TFT, a second TFT, and a third TFT formed therein, characterized in that:

input of a digital video signal to the pixel is controlled by the first TFT;

write in to the SRAM and read out from the SRAM of a portion of bits of the digital video signal input is controlled by the second TFT;

switching of the third TFT is controlled in accordance with the portion of bits of the digital video signal read out from the SRAM or the digital video signal input to the pixel; and light emission of the EL element is controlled by the third TFT.

In accordance with the present invention, there is provided a method of driving a self light emitting device which comprises a plurality of pixels, each pixel comprising an EL element and an SRAM, characterized in that:

a plurality of sub-frame periods are formed in one frame period;

at least one sub-frame period from among the plurality of sub-frame periods comprises a plurality of divided sub-frame periods;

a digital video signal is written into the SRAM in at least one divided sub-frame period from among the plurality of divided sub-frame periods;

the digital video signal is read out from the SRAM in the divided sub-frame period which appears after the divided sub-frame period during which the digital video signal is written into the SRAM; and light emission from the EL element is controlled in accordance with the digital video signal input to the pixel or the digital video signal read out from the SRAM.

The present invention may also have a characteristic in that the memory has three n-channel TFTs and three p-channel TFTs.

The present invention may also have a characteristic in that a gate electrode of one of the three n-channel TFTs is connected to a gate electrode of the first TFT, and a gate electrode of one of the three p-channel TFTs is connected to a gate electrode of the second TFT of a different pixel.

The present invention may also have a characteristic in that:

the memory has two sets of an n-channel TFT and a p-channel TFT which have gate electrodes mutually connected;

drain regions of the n-channel TFT and the p-channel TFT are mutually connected;

the gate electrodes of one of the two sets of the n-channel TFT and the p-channel TFT are mutually connected to the drain regions of the other; and the drain regions of one of two sets of the n-channel TFT and the p-channel TFT are connected to one of a source region and a drain region of the second TFT.

The present invention may also have a characteristic in that the SRAM has two n-channel TFTs and two p-channel TFTs.

The present invention may also have a characteristic in that:

the SRAM has two sets of an n-channel TFT and a p-channel TFT whose gate electrodes are mutually connected;

drain regions of the n-channel TFT and the p-channel TFT are mutually connected;

the gate electrodes of two sets of the n-channel TFT and the p-channel TFT are mutually connected to another pair of the drain regions; and any one of the pair of the drain regions out of two sets of the n-channel TFT and the p-channel TFT are connected to one of a source region or a drain region of the second TFT.

The present invention may also have a characteristic in that the plurality of divided sub-frame periods need not appear in sequence with the present invention.

DETAILED DESCRIPTION OF THE PREFERRED EMBODIMENTS

Structures of the present invention are explained below.

[Embodiment Mode 1]

Figures 1A, 1B:
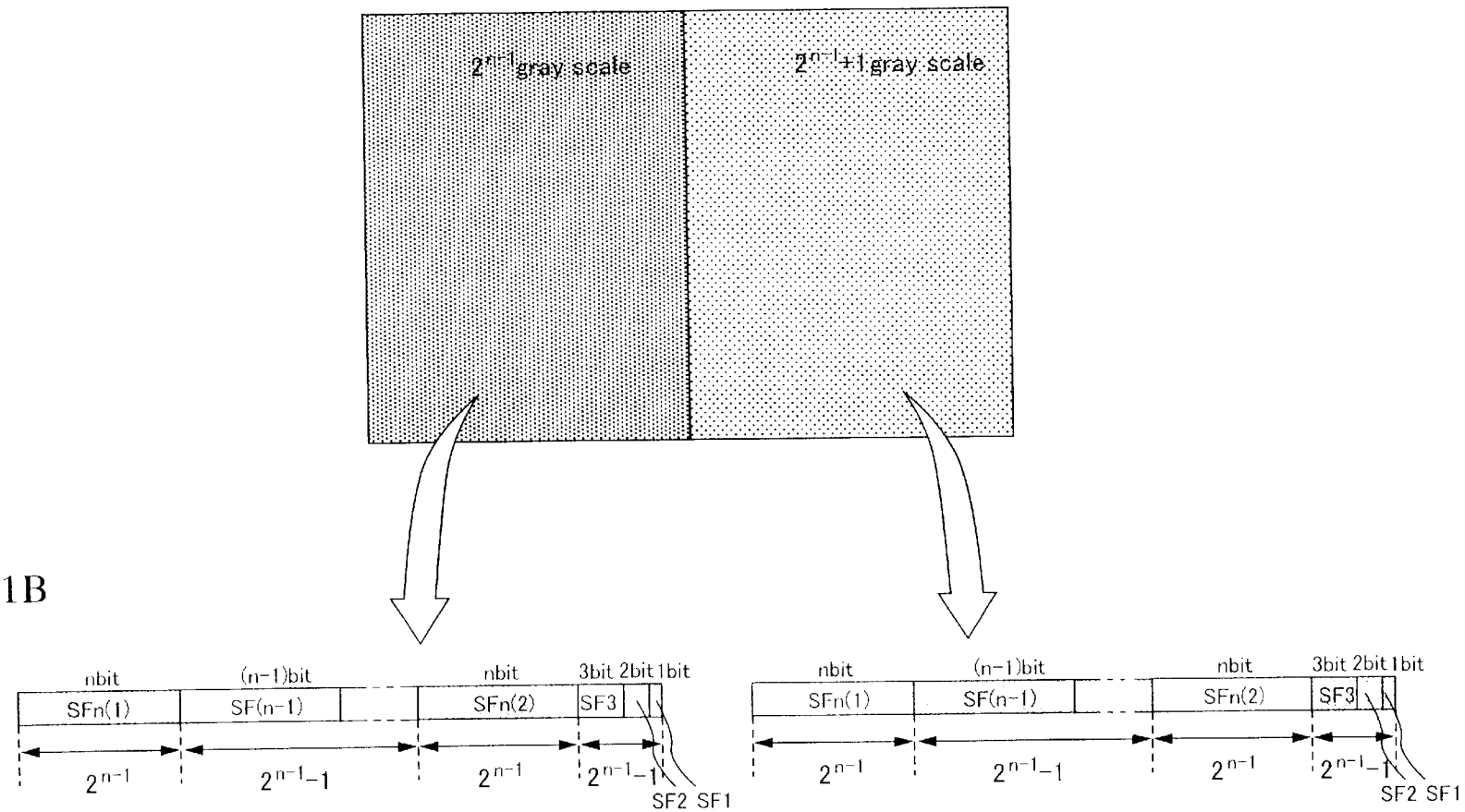
FIGS. 1A and 1B are a diagram of a pixel portion of a self light emitting device using a driving method of the present invention, and a diagram for expressing the ratio of the lengths of a display period and a divided display period, respectively.
Figure 2A:
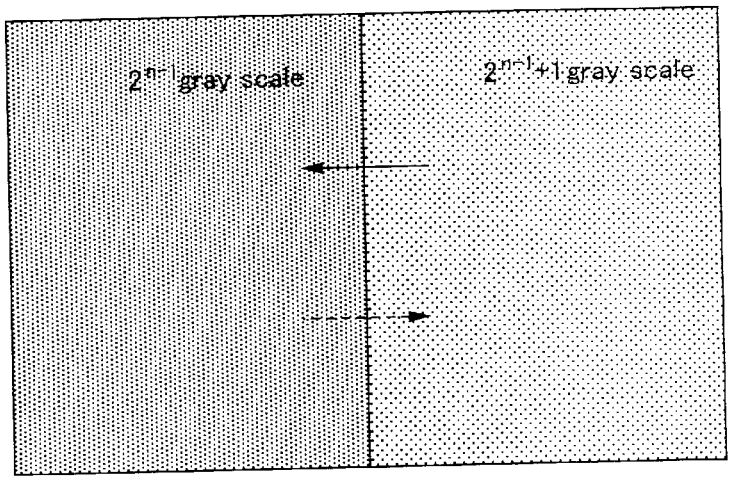
FIGS. 2A and 2B are a diagram of a pixel portion of a self light emitting device using a driving method of the present invention, and a diagram for expressing the ratio of the lengths of a turn on period and a turn off period, respectively.
Figure 2B:
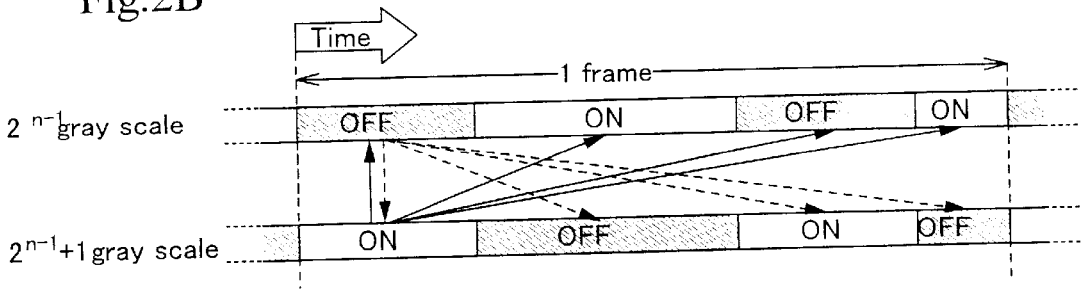
Figure 3:
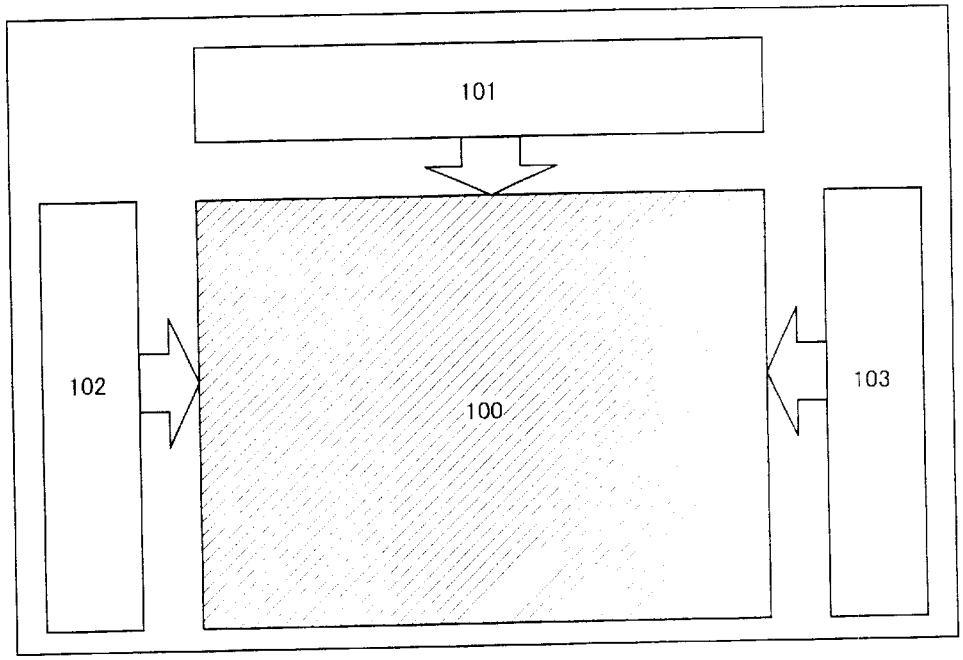
FIG. 3 is a block diagram of an upper surface of a self light emitting device of the present invention.

FIG. 3 is a block diagram of a self light emitting device of the present invention, and reference numeral 100 denotes a pixel portion, reference numeral 101 denotes a source signal line driving circuit, reference numeral 102 denotes a gate signal line driving circuit used for addressing, and reference numeral 103 denotes a gate signal line driving circuit used for memory.

Figure 4:
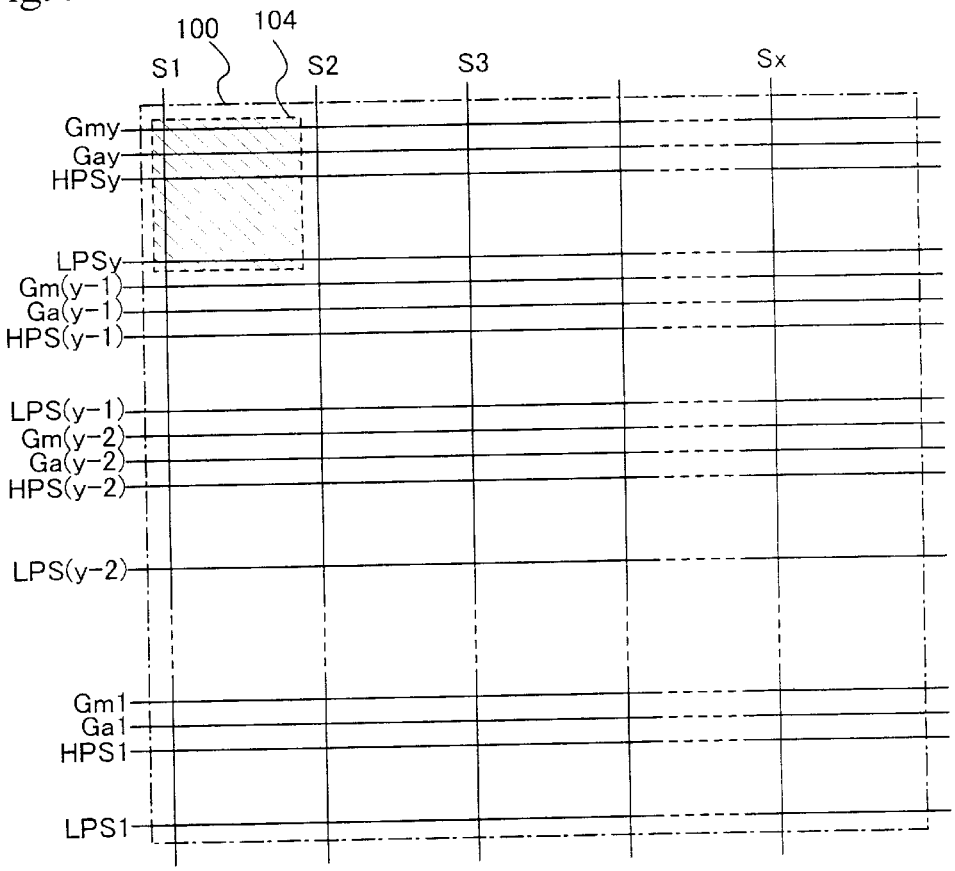
FIG. 4 is a pixel portion of a self light emitting device of the present invention.

A detailed structure of the pixel portion 100 is shown in FIG. 4. The pixel portion has source signal lines S1 to Sx, address gate signal lines Ga1 to Gay, gate memory signal lines used for memory Gm1 to Gmy, high voltage side electric power source lines HPS1 to HPSy, and low voltage side electric power source lines LPS1 to LPSy.

Each of regions which has one of the source signal lines, one of the address gate signal line, one of the memory gate signal lines, one of the high voltage side electric power source lines, and one of the low voltage side electric power source lines is pixel 104. A plurality of the pixels 104 are formed in a matrix shape in the pixel portion 100.

Figure 5:
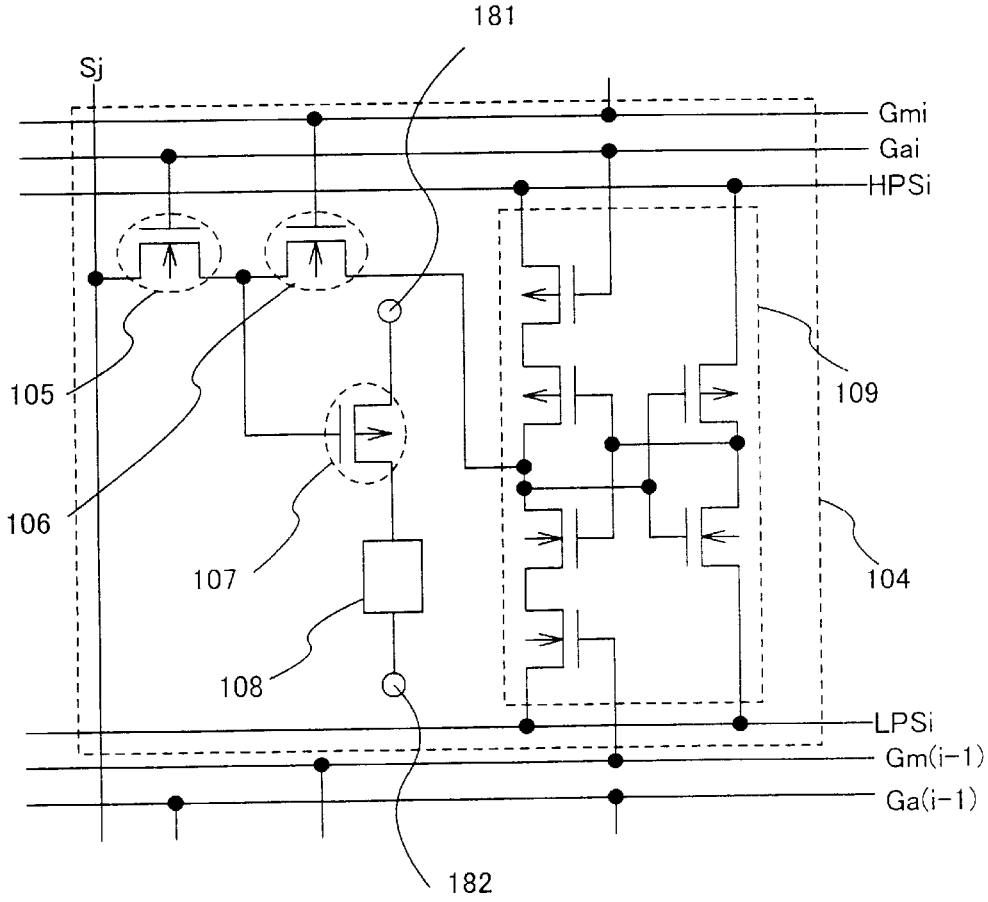
FIG. 5 is a circuit diagram of a pixel of a self light emitting device of the present invention.

A detailed structure of the pixel 104 is shown in FIG. 5. Shown in FIG. 5 is one arbitrary pixel from the plurality of pixels 104, and the pixel has the source signal line Sj (one of S1 to Sx), the address gate signal line Gai (one of Ga1 to Gay), the memory gate signal line Gmi (one of Gm1 to Gmy), the high voltage side electric power source line HPSi (one of HPS1 to HPSy), and the low voltage side electric power source line LPSi (one of LPS1 to LPSy).

The high voltage side electric power source lines HPS1 to HPSy are connected to a high voltage side electric power source, and the low voltage side electric power source lines LPS1 to LPSy are connected to a low voltage side electric power source.

Further, the pixel 104 has an address TFT 105, a memory TFT 106, an EL driving TFT 107, an EL element 108, and a memory 109.

A gate electrode of the address TFT 105 is connected to the address gate signal line Gai. Further, one of a source region and a drain region of the address TFT 105 is connected to the source signal line Sj, and the other is connected to a gate electrode of the EL driving TFT 107.

A gate electrode of the memory TFT 106 is connected to the memory gate signal line Gmi. Furthermore, one of a source region and a drain region of the memory TFT 106 is connected to the gate electrode of the EL driving TFT 107, and the other is connected to the memory 109. In other words, either the source region or the drain region of the address TFT 105, which is not connected to the source signal line Sj, is connected to either the source region or the drain region of the memory TFT 106, which is not connected to the memory 109.

A source region of the EL driving TFT 107 is connected to a pixel electrode side electric power source 181, and a drain region of the EL driving TFT 107 is connected to a pixel electrode of the EL element 108. The EL element 108 has the pixel electrode, an opposing electrode, and an EL layer formed between the pixel electrode and the opposing electrode. The opposing electrode of the EL element 108 is connected to an opposing electrode side electric power source 182.

The electric potential of the pixel electrode side electric power source 181 and the opposing electrode side electric power source 182 is set to have a mutual electric potential difference, on the order that the EL element 108 emits light when the electric potential of the pixel electrode side electric power source 181 is imparted to the pixel electrode of the EL element 108.

Note that, although a case in which the EL driving TFT 107 is a p-channel TFT is shown in FIG. 5, embodiment mode 1 is not limited to this structure. The EL driving TFT 107 may also be an n-channel TFT.

Note that a structure, in which the pixel electrode side electric power source 181 connected to the source region of the EL driving TFT 107 is made common with the high voltage side electric power source and the opposing electrode side electric power source 182 connected to the opposing electrode of the EL element 108 is made common with the low voltage side electric power source if the EL driving TFT 107 is a p-channel TFT, may also be used.

Note that a structure, in which the pixel electrode side electric power source 181 connected to the source region of the EL driving TFT 107 is made common with the low voltage side electric power source and the opposing electrode side electric power source 182 connected to the opposing electrode of the EL element 108 is made common with the high voltage side electric power source if the EL driving TFT 107 is a n-channel TFT, may also be used.

Further, one of the pixel electrode and the opposing electrode of the EL element is an anode, and the other is a cathode. It is preferable to use the anode as the pixel electrode and to use the cathode as the opposing electrode for cases in which the EL driving TFT 107 is a p-channel TFT. Conversely, if the EL driving TFT 107 is an n-channel TFT, then it is preferable to use the cathode as the pixel electrode, and to use the anode as the opposing electrode.

Figure 6:
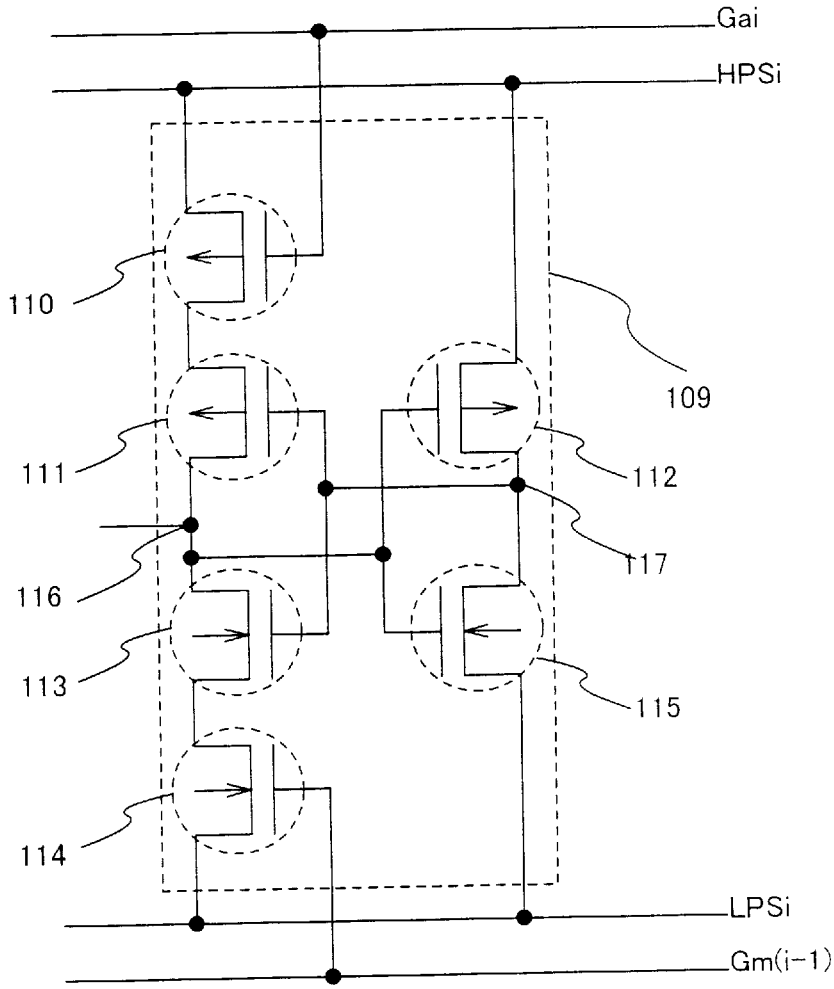
FIG. 6 is a memory circuit diagram.

A detailed structure of the memory 109 is explained next. FIG. 6 shows a detailed structure of the memory 109. Note that the structure of the memory provided in the pixel is not limited to the structure of FIG. 6.

The memory 109 has three p-channel TFTs 110, 111, and 112, and three n-channel TFTs 113, 114, and 115.

A source region of the p-channel TFT 110 is connected to the high voltage side electric power source line HPSi, and a drain region of the p-channel TFT 110 is connected to a source region of the p-channel TFT 111. Further, a source region of the n-channel TFT 114 is connected to the low voltage side electric power source line LPSi, and a drain region of the n-channel TFT 114 is connected to a source region of the n-channel TFT 113.

A drain region of the p-channel TFT 111 and a drain region of the n-channel TFT 113 are connected at a connection point 116.

Further, a source region of the p-channel TFT 112 is connected to the high voltage side electric power source line HPSi, and a source region of the n-channel TFT 115 is connected to the low voltage side electric power source line LPSi. A drain region of the p-channel TFT 112 and a drain region of the n-channel TFT 115 are connected at a connection point 117.

A gate electrode of the p-channel TFT 110 is connected to the address gate signal line Gai, and a gate electrode of the n-channel TFT 114 is connected to the memory gate signal line Gm(i−1).

Gate electrodes of the p-channel TFT 111 and the n-channel TFT 113 are connected, and each are also connected to the connection point 117. Gate electrodes of the p-channel TFT 112 and the n-channel TFT 115 are connected, and are also connected to the connection point 116.

The connection point 116 is connected to the source region or the drain region of the memory TFT 106.

Note that it is necessary that the address TFT 105 and the memory TFT 106 have the same polarity in embodiment mode 1. Further, it is necessary that the address TFT 105 and the memory TFT 106 have the opposite polarity as that of the EL driving TFT 107.

In addition, it is necessary that, from among the TFTs of the memory 109, the TFT connected to the address gate signal line Gai have the same polarity as that of the EL driving TFT 107. Furthermore, it is necessary that, from among the TFTs of the memory 109, the TFT of which the gate electrode is connected to the memory gate signal line Ga(i−1) of the adjacent pixel have the same polarity as that of the address TFT 105 and the memory TFT 106.

Drive of a self light emitting device of embodiment mode 1 is explained next using FIG. 7.

Figure 7:
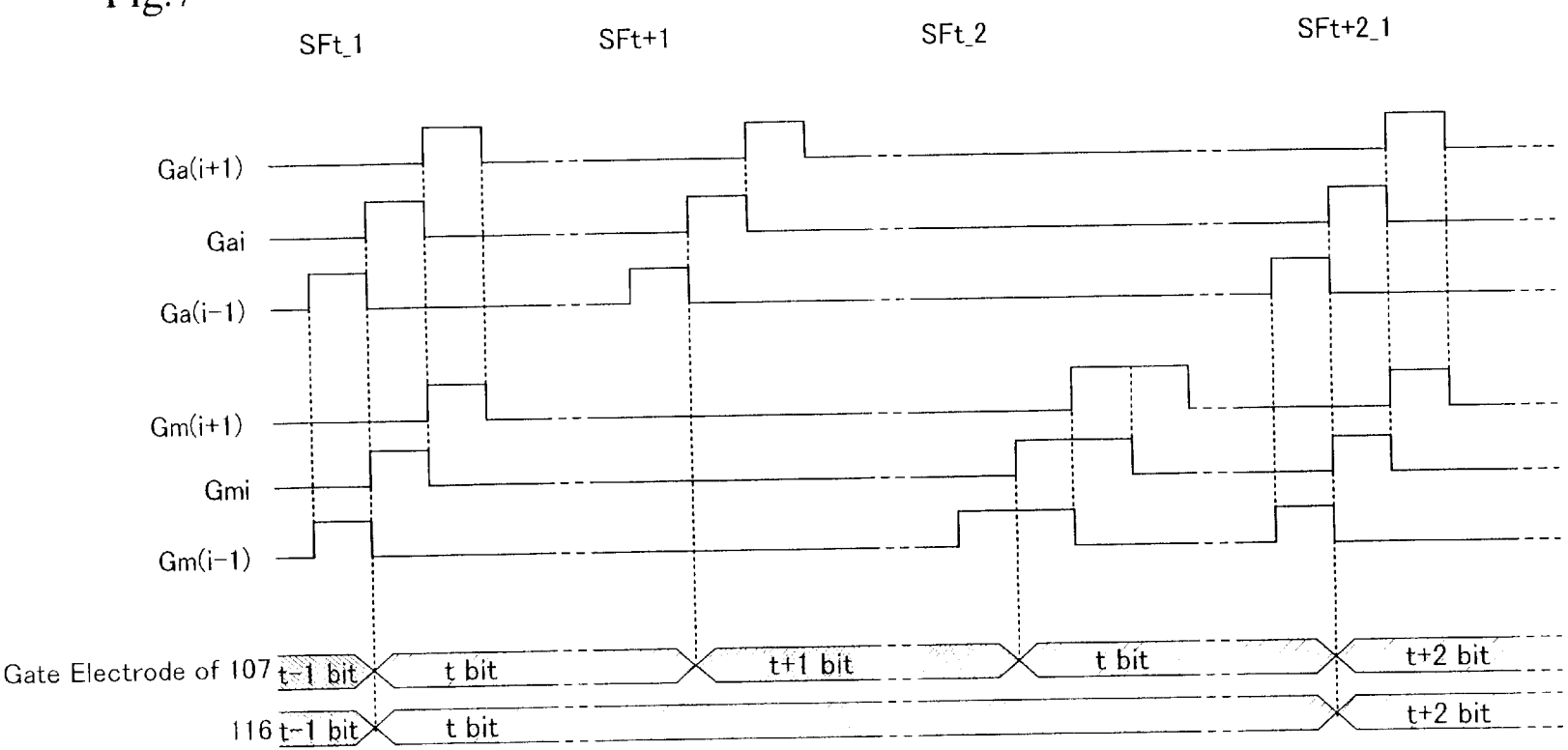
FIG. 7 is a diagram showing a method of driving a self light emitting device of the present invention.

The bit number of a digital video signal, input to the gate electrode of the EL driving TFT 107 and the connection point 116 in arbitrary sub-frame periods SFt to SFt+2, is shown in FIG. 7. Note that, among the sub-frame periods SFt to SFt+2, the sub-frame period SFt appears divided into two divided sub-frame periods (SFt_1 and SFt_2).

Whether or not the EL elements emit light in each sub-frame period is controlled in accordance with the digital video signal corresponding to each sub-frame period.

Among the divided sub-frame period SFt, the address gate signal lines Ga1 to Gay are selected in order in accordance with an address selection signal output from the address gate signal line driving circuit 102 in the divided sub-frame period SFt_1 which appears first.

Note that, in this specification, the term selection of an address gate signal line denotes that all address TFTs 105 which have their gate electrode connected to the address gate signal line are placed in an on state.

Further, the memory gate signal lines Gm1 to Gmy are also selected in order, in accordance with a memory selection signal output at the same time from the memory gate signal line driving circuit 103.

Note that, in this specification, the term selection of a memory gate signal line denotes that all memory TFTs 106 which have their gate electrode connected to the memory gate signal line are placed in an on state.

For example, the address gate signal line Gai and the memory gate signal line Gmi are simultaneously selected in the divided sub-frame period SFt_1 for the case of the i-th line. All of the address TFTs 105 which have their gate electrode connected to the address gate signal line Gai therefore are turned on. Further, all of the memory TFTs 106 which have their gate electrode connected to the memory gate signal line Gmi are turned on at the same time.

In addition, from among the TFTs of the memory 109, the TFT which has its gate electrode connected to the address gate signal line Gai (the p-channel TFT 110 in embodiment mode 1) is turned off.

The memory gate signal line Gm(i−1) is not selected when the memory gate signal line Gmi is selected, and therefore the TFT (the n-channel TFT 114 in embodiment mode 1) which has its gate electrode connected to the memory gate signal line Gm(i−1) is in an off state.

The t-th bit digital video signal is then input from the source signal line driving circuit 101 to each of the source signal lines S1 to Sx.

As a result, the t-bit the digital video signal is input to the gate electrode of the EL driving TFT 107 through the address TFT 105. Further, the t-bit digital video signal is input at the same time to the connection point 116 through the memory TFT 106, and stored in the memory 109.

When the t-bit the digital video signal is input to the gate electrode of the EL driving TFT 107 of each pixel, switching of the EL driving TFTs 107 is controlled in accordance with information indicating 1 or 0 of the t-bit the digital video signal.

If the EL driving TFT 107 is turned on, then the electric potential of the pixel electrode side electric power source 181 is imparted to the pixel electrode of the EL element 108. Note that an EL driving voltage which is the electric potential difference between the pixel electrode side electric power source 181 and the opposing electrode electric power source 182, is applied to the EL layer since the electric potential of the opposing electrode electric power source 182 is imparted to the opposing electrode of the EL element 108. The EL element 108 then emits light.

Conversely, if the EL driving TFT is turned off, then the electric potential of the pixel electrode side electric power source 181 is not imparted to the pixel electrode of the EL element 108. Consequently, the pixel electrode of the EL element 108 is maintained at the same electric potential as that of the opposing electrode, and therefore the EL element 108 does not emit light.

The divided sub-frame period such as the above during which the address gate signal line and the memory gate signal line are selected simultaneously is referred to as a pixel and memory write in period.

The address TFT 105 and the memory TFT 106 are both turned off when the selection of the address gate signal line Gai and the memory gate signal line Gmi is complete. The TFT which has its gate electrode is connected to the address gate signal line Gai, from among the TFTs of the memory 109, is then turned off.

The above operations are repeated and all of the address gate signal lines and the memory gate signal lines are selected, thus to complete the divided sub-frame period SFt_1.

The sub-frame period SFt+1 begins next, and the address gate signal lines Ga1 to Gay are selected in order in accordance with address selection signals output from the address gate signal line driving circuit 102.

For example, for the case of the i-th line, all of the address TFTs 105 which have their gate electrodes connected to the address gate signal line Gai are turned on if the address gate signal line Gai is selected.

In addition, from among the TFTs of the memory 109, the TFT (the p-channel TFT 110 in embodiment mode 1) which has its gate electrode connected to the address gate signal line Gai is turned off.

The memory gate signal line is not selected, and therefore the memory TFTs 106 which have their gate electrodes connected to the memory gate signal line Gmi all become turned off. Further, from among the TFTs of the memory 109, the TFT (the n-channel TFT 114 in embodiment mode 1) which has its gate electrode connected to the memory gate signal line Gm(i−1) is turned off.

The (t+1)-th bit digital video signal is then input from the source signal line driving circuit 101 to each of the source signal lines S1 to Sx when each address gate signal line is selected. As a result, the (t+1)-th bit digital video signal is input to the gate electrodes of the EL driving TFTs 107 through the address TFTs 105.

Note that, in the sub-frame period SFt+1, all of the memory TFTs 106 are turned off, and therefore the t-bit digital video signal input to the memory 109 in the divided sub-frame period SFt_1 is stored as is.

Switching of the EL driving TFTs 107 is controlled in accordance with the (t+1)-bit digital video signal, as in the divided sub-frame period SFt_1, when the (t+1)-bit digital video signal is input to the gate electrode of the EL driving TFT 107 of each pixel. Whether or not the EL elements 108 emit light is thus selected.

A period like this, during which only the address gate signal lines are selected and the memory gate signal lines are not selected, is referred to as a pixel write in period.

The address TFTs 105 are turned off when selection of the address gate signal line Gai is complete, and from among the TFTs of the memory 109, the TFT (the p-channel TFT 110 in embodiment mode 1) which has its gate electrode connected to the address gate signal line Gai is turned on.

Selection of the address gate signal line Ga(i+1) then begins.

The above operations are repeated, and the sub-frame period SFt+1 is complete when selection of all of the address gate signal lines is completed.

The divided sub-frame period SFt_2 begins next, and the memory gate signal lines Gm1 to Gmy are selected in order, in accordance with memory selection signals output from the memory gate signal line driving circuit 103. At this point, periods during which respective memory gate signal lines are selected (selection periods) mutually overlap by half. For example, when a period for selecting the memory gate signal line Gm (i−1) half elapses, a period for selecting the next memory gate signal line Gmi begins. When the period for selecting the memory gate signal line Gm(i−1) is completed, a period for selecting the Gm (i+1) memory gate signal line then begins. Thus, except for the ones at the first and the last, two memory gate signal lines are always selected.

Note that the address gate signal lines are not selected in the sub-frame period SFt_2, and therefore the address TFTs 105 are turned off. Further, from among the TFTs of the memory 109, the TFT (the p-channel TFT 110 in embodiment mode 1) which has its gate electrode connected to the address gate signal line is turned on.

For example, in pixels of the i-th line, the TFT (the n-channel TFT 114 in embodiment mode 1), from among the TFTs of the memory 109, which has its gate electrode connected to the memory gate signal line Gm(i−1) is turned on in the first half of a period for selecting the memory gate signal line Gm(i−1).

All of the memory TFTs 106 which have their gate electrodes connected to the memory gate signal line Gmi are then turned on in the first half of the period for selecting the memory gate signal line Gmi. The t-bit digital video signal stored in the memory 109 is thus input to the gate electrodes of the EL driving TFTs 107.

When the t-bit digital video signal is input to the gate electrodes of the EL driving TFTs 107 of each pixel, switching of the EL driving TFTs 107 is controlled by the t-bit digital video signal, as in the divided sub-frame period SFt_1.

Further, the memory gate signal line Gm(i−1) is selected in the first half of the period for selecting the memory gate signal line Gmi, and therefore the n-channel TFT 114 remains turned on.

Next, in the second half of the period for selecting the memory gate signal line Gmi, the period for selecting the next memory gate signal line Gm(i−1) is complete. The n-channel TFT 114 which has its gate electrode connected to the memory gate signal line Gm(i−1) is therefore turned off. The memory TFT which has its gate electrode connected to the memory gate signal line Gmi remains turned on.

A period during which only the memory gate signal lines are selected and the address gate signal lines are not selected as above, is referred to as a memory read out period.

When the above operations are repeated, and selection of all of the memory gate signal lines is complete, the divided sub-frame period SFt_2 is complete.

A divided sub-frame period SFt+2_1, which is a pixel and memory write in period, begins next, and the address gate signal lines and the memory gate signal lines are selected in order.

The pixel and memory write in periods, the pixel write in periods, and the memory read out periods are thus formed in the method of driving a self light emitting device of embodiment mode 1.

Figure 8A:
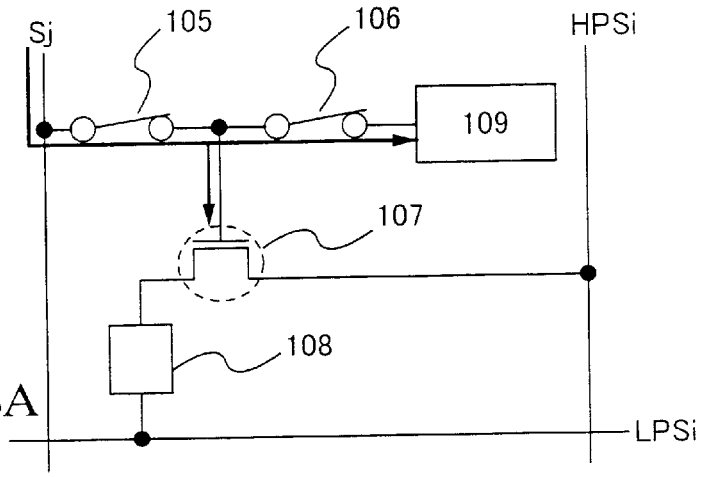
FIGS. 8A to 8C are diagrams showing connection structures for a pixel during driving.
Figure 8B:
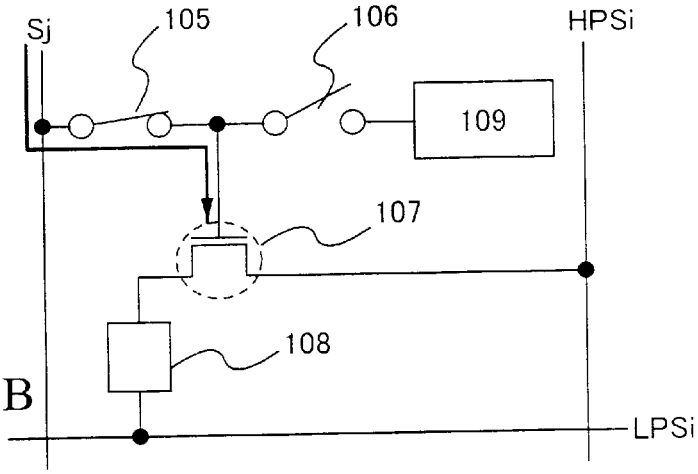
Figure 8C:
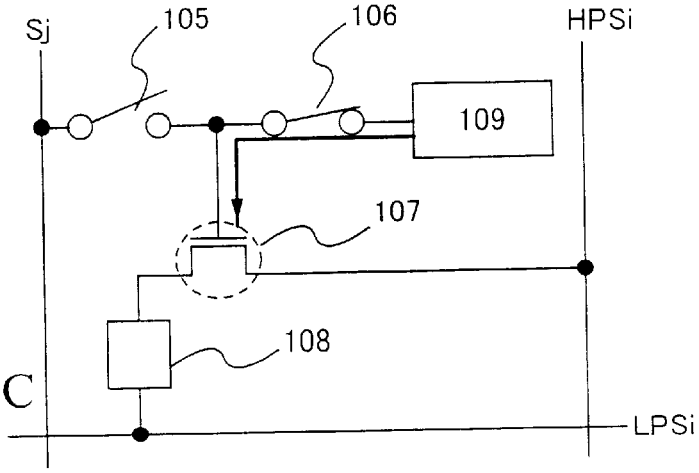

A connection structure of the pixels in the above driving method is simplified and shown in FIGS. 8A to 8C.

FIG. 8A is a case of a pixel and memory write in period. A digital video signal input from the source signal line Sj is input to the gate electrode of the EL driving TFT 107 and to the memory 109, through the address TFT 105 and the memory TFT 106 which are turned on.

FIG. 8B is a case of a pixel write in period. A digital video signal input from the source signal line Sj is input to the gate electrode of the EL driving TFT 107 through the address TFT 105 which is turned on. The memory TFT 106 is turned off, and therefore the digital video signal input previously into the memory 109 is stored.

FIG. 8C is a case of a memory read out period. A digital video signal input from the source signal line Sj is not input to the gate electrode of the EL driving TFT 107 because the address TFT 105 is turned off. The memory TFT 106 is turned on, and therefore the digital video signal stored in the memory 109 is input to the gate electrode of the EL driving TFT 107 through the memory TFT 106.

By repeating the above operations, driving of the EL elements is controlled in each sub-frame period.

Figure 9:
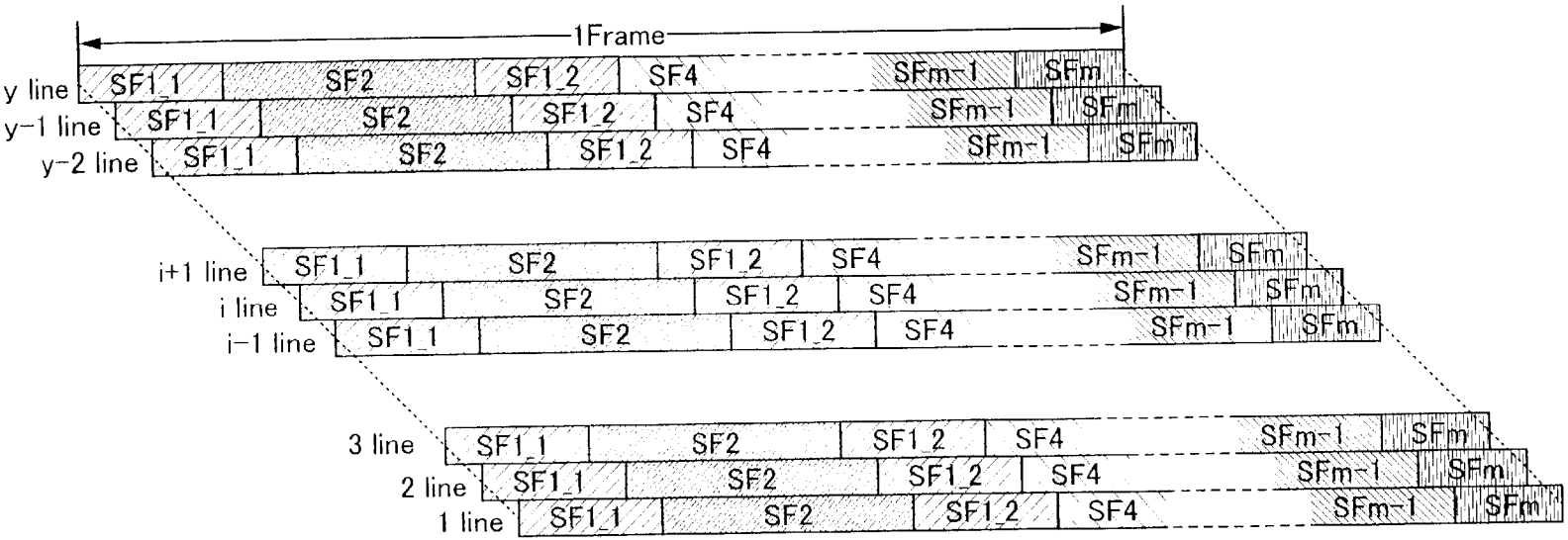
FIG. 9 is a diagram showing a method of driving a self light emitting device of the present invention.

Further, timing at which the sub-frame periods and the divided sub-frame periods begin, differs for each line of pixels. Timing at which the sub-frame periods and the divided sub-frame periods begin in each line of pixels is shown in FIG. 9. The vertical axis shows pixel position, and the horizontal axis shows time.

The timing at which one frame period begins differs for each line of pixels, but the length of one frame period is the same in each of the pixels.

Further, the lengths of each sub-frame period satisfy SF1::SF2:: . . . ::SFn=$2^0$:$2^1$:: . . . $2^{n-1}$. The sum of all of the divided sub-frame periods is considered as the length of the sub-frame period for cases in which the sub-frame period is divided into a plurality of divided sub-frame periods. For example, if a sub-frame period SFt is composed of three divided sub-frame periods SFt_1, SFt_2, and SFt_3, then SFt=SFt_1+SFt_2+SFt_3.

With the driving method of embodiment mode 1, gray scales are displayed by controlling the emission of light of the EL elements in each sub-frame period, including the divided sub-frame periods. The gray scale of a pixel is determined by the proportion of the sum of the sub-frame periods (turn on periods) during which light is emitted in one frame period.

As stated above, with the self light emitting device of embodiment mode 1, the turn on periods and the non-turn on periods are divided and appear alternately within one frame period. Thus, even if the visual point of a human moves slightly left and right, up and down, and only non-turned on pixels are continuously observed, or conversely, only turned on pixels are continuously observed, the length of successive turn on periods or non-turn on periods is shorter compared to driving by a conventional simple binary code method, and therefore observation of pseudo contours can be prevented.

Observation of conspicuous display hindrances, such as pseudo contours in time division driving by a binary code method, can therefore be prevented.

Note that, although the address gate signal lines and the memory gate signal lines are controlled by different gate signal line driving circuits (the address gate signal line driving circuit 102 and the memory gate signal line driving circuit 103) in embodiment mode 1, embodiment mode 1 is not limited to this. The address gate signal lines and the memory gate signal lines may also be controlled using by gate signal line driving circuit.

Further, an example is shown in embodiment mode 1 in which only one memory read out period is provided for one pixel and memory write in period, embodiment mode 1 is not limited to such. A plurality of the memory read out periods may also be formed, sandwiching the pixel write in periods in between.

In addition, although a structure is shown in embodiment mode 1 in which the first divided sub-frame period, from among the plurality of divided sub-frame periods, is the pixel and memory write in period, embodiment mode 1 is not limited to this structure. It is not always necessary that the first divided sub-frame period be a pixel and memory write in period in a case of dividing a sub-frame period into a plurality of divided sub-frame periods. Further, it is not always necessary that one of the divided sub-frame periods be a pixel and memory write in period. All of the divided sub-frame periods may be pixel and memory write in periods.

In addition, it is possible for a designer to appropriately set the appearance order of the sub-frame periods and the divided sub-frame periods, provided that divided sub-frame periods which are divided from the same sub-frame period do not appear consecutively.

Furthermore, the self light emitting device of embodiment mode 1 stores a digital video signal in a memory provided in a pixel, and therefore a static image can be continuously displayed without performing input of a digital video signal every frame, provided that write is performed once for cases of static images. In other words, it becomes possible to stop the source signal line driving circuit after performing processing operations on at least the first frame of signals when a static image is displayed, and it thus becomes possible to greatly reduce electric power consumption.

[Embodiment Mode 2]

A structure of the pixel portion 100 shown in FIG. 3 which differs from that of embodiment mode 1 is explained.

Figure 10:
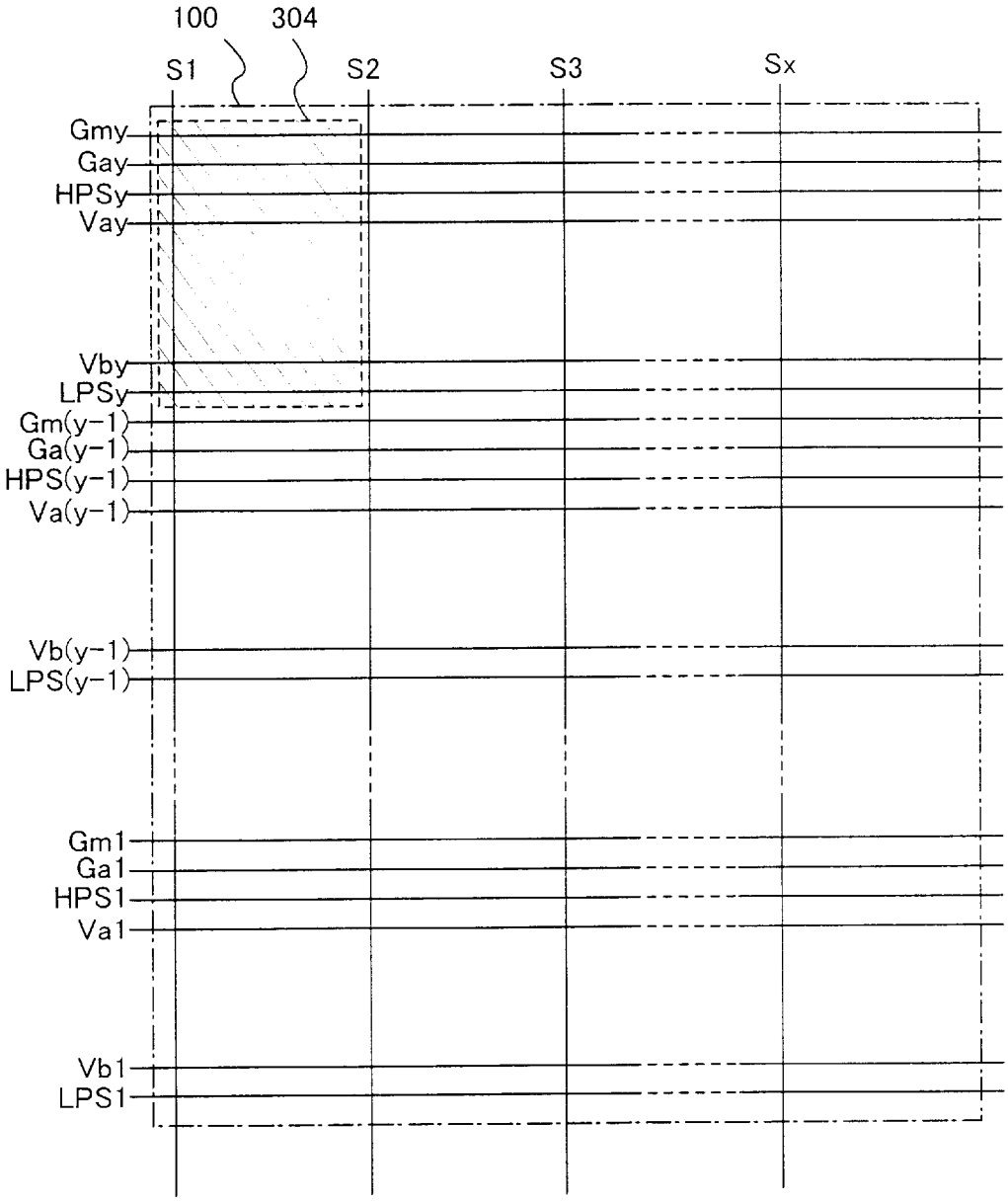
FIG. 10 is a pixel portion of a self light emitting device of the present invention.

A detailed structure of the pixel portion 100 of embodiment mode 2 is shown in FIG. 10. The pixel portion has the source signal lines S1 to Sx, the address gate signal lines Ga1 to Gay, memory gate signal line used Gm1 to Gmy, the high voltage side electric power source lines HPS1 to HPSy, the low voltage side electric power source lines LPS1 to LPSy, pixel electrode side electric power source lines Va1 to Vay, and opposing electrode side electric power source lines Vb1 to Vby.

Regions which has one of the source signal lines, one of the address gate signal lines, one of the memory gate signal lines, one of the high voltage side electric power source lines, one of the low voltage side electric power source lines, one of the pixel electrode side electric power source lines, and one of the opposing electrode side electric power source lines are pixels 304. A plurality of the pixels 304 are formed in a matrix shape in the pixel portion 100.

Figure 11:
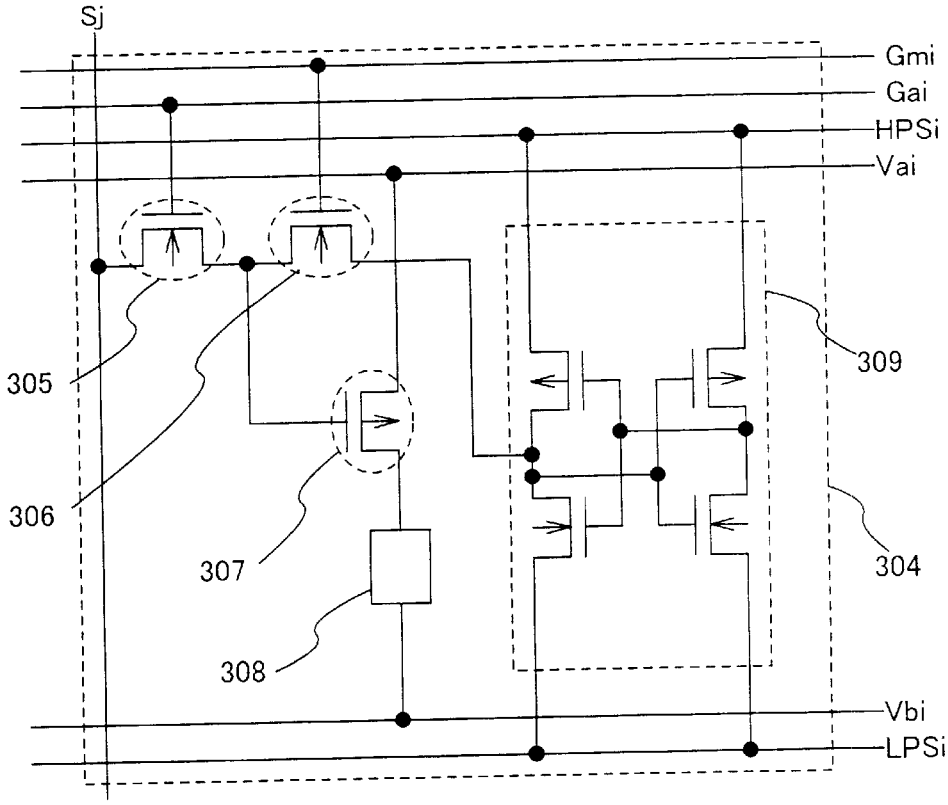
FIG. 11 is a circuit diagram of a pixel of a self light emitting device of the present invention.

A detailed structure of the pixel 304 is shown in FIG. 11. Shown in FIG. 11 is one arbitrary pixel of the plurality of pixels 304, and the pixel has the source signal line Sj (one from among S1 to Sx), the address gate signal line Gai (one from among Ga1 to Gay), the memory gate signal line Gmi (one from among Gm1 to Gmy), the high voltage side electric power source line HPSi (one from among HPS1 to HPSy), the low voltage side electric power source line LPSi (one from among LPS1 to LPSy), the pixel electrode side electric power source line Vai (one from among Va1 to Vay), and the opposing electrode side electron power source line Vbi (from among Vb1 to Vby).

The high voltage side electric power source lines HPS1 to HPSy are connected to a high voltage side electric power source, and the low voltage side electric power source lines LPS1 to LPSy are connected to a low voltage side electric power source. Further, the pixel electrode side electric power source lines Va1 to Vay are connected to a pixel electrode side electric power source, and the opposing electrode side electric power source lines Vb1 to Vby are connected to an opposing electrode side electric power source.

Further, the pixel 304 has an address TFT 305, a memory TFT 306, an EL driving TFT 307, an EL element 308, and a memory 309.

A gate electrode of the address TFT 305 is connected to the address gate signal line Gai. Further, one of a source region and a drain region of the address TFT 305 is connected to the source signal line Sj, and the other is connected to a gate electrode of the EL driving TFT 307.

A gate electrode of the memory TFT 306 is connected to the memory gate signal line Gmi. Furthermore, one of a source region and a drain region of the memory TFT 306 is connected to the gate electrode of the EL driving TFT 307, and the other is connected to the memory 309. In other words, the one of the source region and the drain region of the address TFT 305, which is not connected to the source signal line Sj, is connected to the one of the source region and the drain region of the memory TFT 306, which is not connected to the memory 309.

A source region of the EL driving TFT 307 is connected to the pixel electrode side electric power source line Vai, and a drain region of the EL driving TFT 307 is connected to a pixel electrode of the EL element 308. The EL element 308 has the pixel electrode, an opposing electrode, and an EL layer formed between the pixel electrode and the opposing electrode. The opposing electrode of the EL element 308 is connected to the opposing electrode side electric power source line Vbi.

The electric potentials of the pixel electrode side electric power source line Vai and the opposing electrode side electric power source line Vbi have a mutual electric potential difference, in order that the EL element 308 emits light when the electric potential of the pixel electrode side electric power source line Vai is imparted to the pixel electrode of the EL element 308.

Note that, although a case in which the EL driving TFT 307 is a p-channel TFT is shown in FIG. 11, embodiment mode 2 is not limited to this structure. The EL driving TFT 307 may also be an n-channel TFT.

Further, one of the pixel electrode and the opposing electrode of the EL element is an anode, and the other is a cathode. It is preferable that the EL driving TFT 307 is a p-channel TFT when the anode is used as the pixel electrode and the cathode is used as the opposing electrode. Conversely, it is preferable that the EL driving TFT 307 is an n-channel TFT when the cathode is used as the pixel electrode and the anode is used as the opposing electrode.

Figure 12:
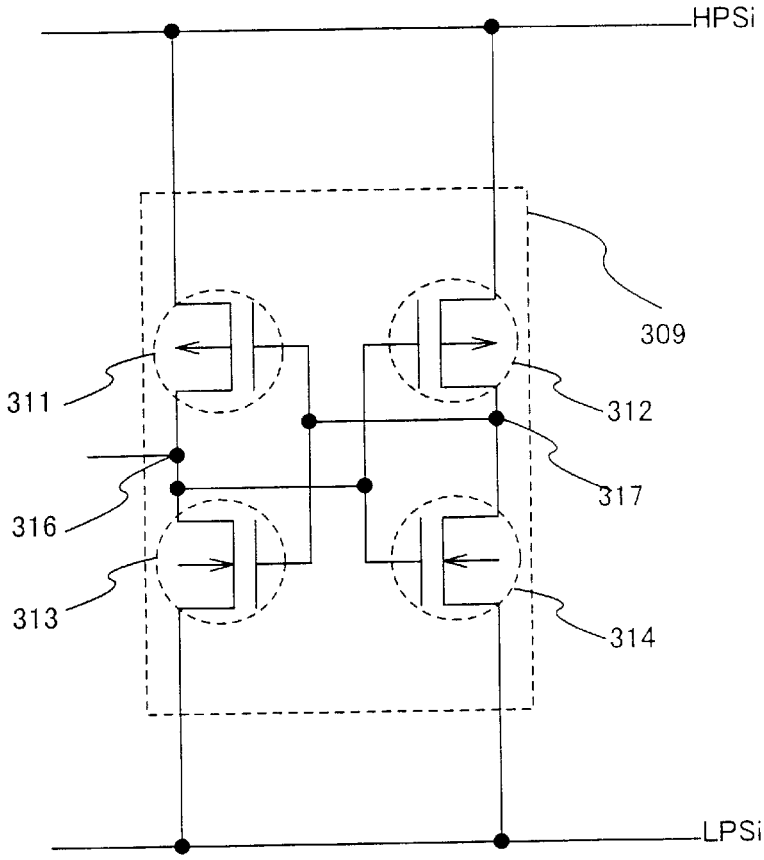
FIG. 12 is a memory circuit diagram.

A detailed structure of the memory 309 is explained next. FIG. 12 shows a detailed structure of the memory 309.

The memory 309 has two p-channel TFTs (PTFTs) 311 and 312, and two n-channel TFTs (NTFTs) 313 and 314.

Source regions of the p-channel TFTs 311 and 312 are each connected to the high voltage side electric power supply line HPSi. Further, source regions of the n-channel TFTs 313 and 314 are each connected to the low voltage side electric power source line LPSi.

A drain region of the p-channel TFT 311 and a drain region of the n-channel TFT 313 are connected at a connection point 316. Further, a drain region of the p-channel TFT 312 and a drain region of the n-channel TFT 314 are connected at a connection point 317.

Gate electrodes of the p-channel TFT 311 and the n-channel TFT 313 are connected to the connection point 317. Further, gate electrodes of the p-channel TFT 312 and the n-channel TFT 314 are connected to the connection point 316.

The connection point 316 connects to a source region or a drain region of the memory TFT 306.

Note that the address TFT 305 and the memory TFT 306 have the same polarity.

Driving of a self light emitting device of embodiment mode 2 is explained next using FIG. 13.

Figure 13:
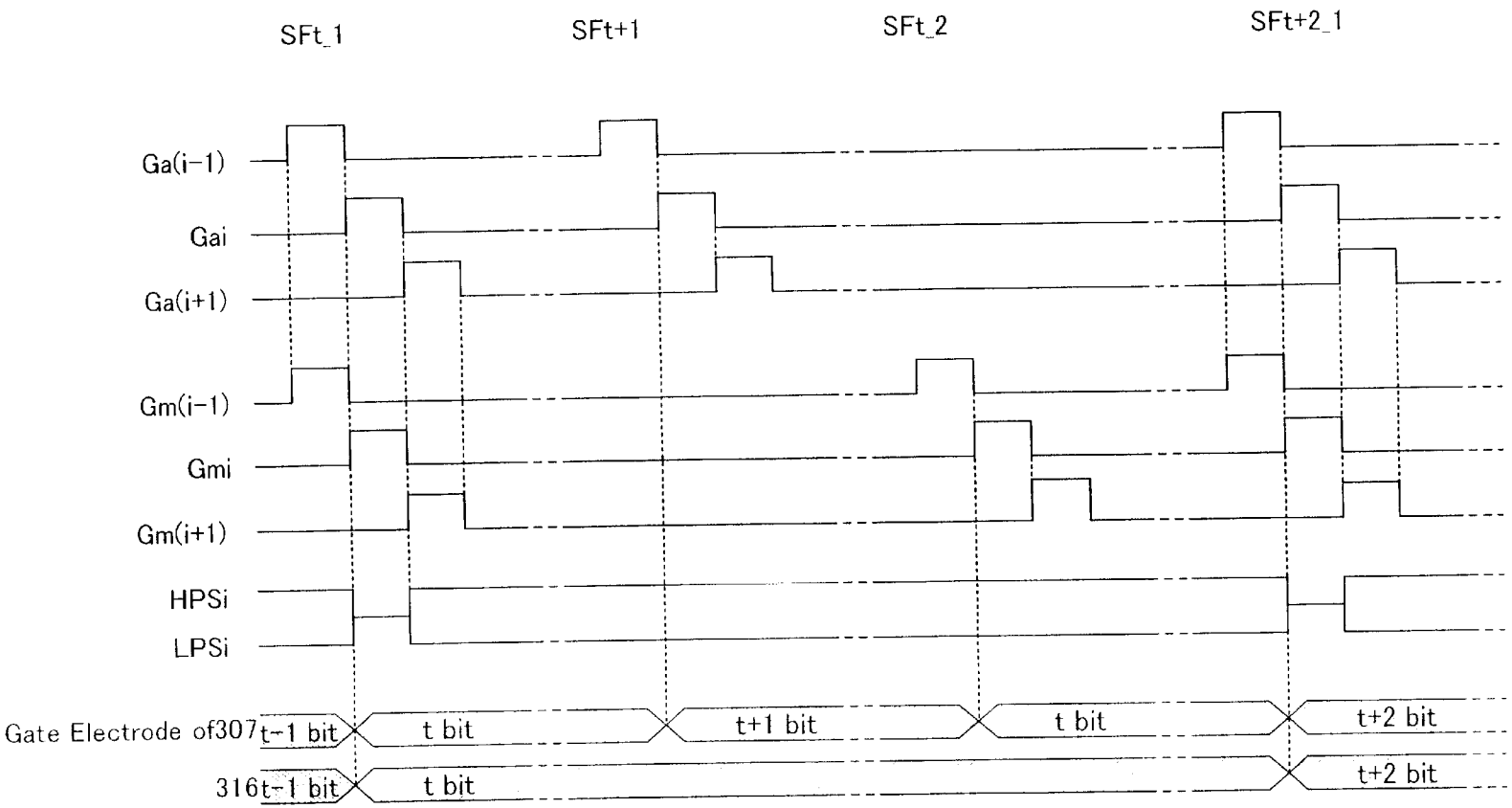
FIG. 13 is a diagram showing a method of driving a self light emitting device of the present invention.

The electric potential of signals input to the address gate signal lines Ga(i+1), Gai, and Ga(i−1), and the electric potential of signals input to the memory gate signal lines Gm(i+1), Gmi, and Gm(i−1) in arbitrary sub-frame periods SFt to SFt+2 are shown in FIG. 13. Further, the bit number of a digital video signal input to the gate electrode of the EL driving TFT 307, or to the connection point 316, in each sub-frame period is shown.

Note that, from among the sub-frame periods SFt to SFt+2, two divided sub-frame periods (SFt_1 and SFt_2) appear in the sub-frame period SFt. Furthermore, the sub-frame period SFt+2 is also divided into a plurality of divided sub-frame periods, but only the first divided sub-frame period to appear, SFt+2_1, is shown in FIG. 13.

Whether or not the EL elements emit light in each sub-frame period or divided sub-frame period is controlled in accordance with the digital video signal corresponding to each period.

In the divided sub-frame period SFt_1 which appears first among the divided sub-frame periods of SFt, the address gate signal lines Ga1 to Gay are selected in order in accordance with an address selection signal output from the address gate signal line driving circuit 102.

Note that, in this specification, the term, selection of an address gate signal line, denotes that all address TFTs 305 which have their gate electrodes connected to the address gate signal line are placed in an on state.

Further, at the same time, the memory gate signal lines Gm1 to Gmy are also selected in order, in accordance with a memory selection signal output from the memory gate signal line driving circuit 103.

The term, selection of a memory gate signal line, denotes that all memory TFTs 306 which have their gate electrodes connected to the memory gate signal line are placed in an on state in this specification.

In addition, the high voltage side electric power source lines HPS1 to HPSy and the low voltage side electric power source lines LPS1 to LPSy are maintained in order, at an intermediate electric potential. Note that the term intermediate electric potential denotes an electric potential between the highest electric potential imparted to the high voltage side electric power source lines and the lowest electric potential imparted to the low voltage side electric power source lines.

For example, the address gate signal line Gai and the memory gate signal line Gmi are simultaneously selected in the divided sub-frame period SFt_1 in the case of the i-th line. All of the address TFTs 305 which have their gate electrodes connected to the address gate signal line Gai therefore are turned on. Further, all of the memory TFTs 306 which have their gate electrodes connected to the memory gate signal line Gmi are turned on at the same time.

Further, the high voltage side electric power source line HPSi and the low voltage side electric power source line LPSi are maintained in order, at the intermediate electric potential.

The t-bit digital video signal is then input from the source signal line driving circuit 101 to the source signal lines S1 to Sx.

As a result, the t-bit digital video signal is input to the gate electrode of the EL driving TFT 307 through the address TFT 305. Further, the t-bit digital video signal is input at the same time to the connection point 316 through the memory TFT 306, and stored in the memory 309.

When the t-bit digital video signal is input to the gate electrode of the EL driving TFT 307 of each pixel, switching of the EL driving TFT 307 is controlled in accordance with the information indicating 1 or 0 of the t-bit digital video signal.

If the EL driving TFT 307 is turned on, then the electric potential of the pixel electrode side electric power source line Vai is imparted to the pixel electrode of the EL element 308. Note that an EL driving voltage, which is the electric potential difference between the pixel electrode side electric power source line Vai and the opposing electrode electric power source line Vbi, is applied to the EL layer since the electric potential of the opposing electrode electric power source line Vbi is imparted to the opposing electrode of the EL element 308. The EL element 308 then emits light.

Conversely, if the EL driving TFT 307 is turned off, then the electric potential of the pixel electrode side electric power source line Vai is not imparted to the pixel electrode of the EL element 308. Consequently, the pixel electrode of the EL element 308 is maintained at the same electric potential as that of the opposing electrode side electric power source line Vbi, and therefore the EL element 308 does not emit light.

The divided sub-frame period during which the address gate signal line and the memory gate signal line are selected simultaneously as described above is referred to as a pixel and memory write in period.

The address TFT 305 and the memory TFT 306 are both turned off when selection of the address gate signal line Gai and the memory gate signal line Gmi is complete. Further, the electric potentials of the high voltage side electric power source line HPSi and the low voltage side electric power source line LPSi are maintained at Vddh and Vss, respectively. Note that Vddh>Vss.

Selection of the address gate signal line Ga(i+1) and the memory gate signal line Gm(i+1) begins next.

The above operations are repeated, and all of the address gate signal lines and the memory gate signal lines are selected to complete the divided sub-frame period SFt_1.

The sub-frame period SFt+1 begins next, and the address gate signal lines Ga1 to Gay are selected in order in accordance with address selections signals output from the address gate signal line driving circuit 102.

For example, in the case of i-line, all of the address TFTs 305 which have their gate electrodes connected to the address gate signal line Gai are turned on if the address gate signal line Gai is selected.

Further, the memory gate signal line is not selected, and therefore all of the memory TFTs 306 which have their gate electrodes connected to the memory gate signal line Gmi are turned off.

The electric potentials of the high voltage side electric power source lines HPS1 to HPSy and the low voltage side electric power source lines LPS1 to LPSy remain to be maintained at Vddh and Vss, respectively.

The (t+1)-th bit digital video signal is then input from the source signal line driving circuit 101 to each of the source signal lines S1 to Sx when each address gate signal line is selected. As a result, the (t+1)-bit digital video signal is input to the gate electrodes of the EL driving TFTs 307 through the address TFTs 305.

Note that, in the sub-frame period SFt+1, all of the memory TFTs 306 are turned off, and therefore the t-bit digital video signal input to the memory 309 in the divided sub-frame period SFt_1 is stored as it is.

Switching of the EL driving TFTs 307 is controlled in accordance with the (t+1)-bit digital video signal, as in the divided sub-frame period SFt_1, when the (t+1)-bit digital video signal is input to the gate electrode of the EL driving TFT 307. Whether or not the EL elements 308 emit light is thus selected.

A period like this during which only the address gate signal lines are selected and the memory gate signal lines are not selected, is referred to as a pixel write in period.

The address TFTs 305 are turned off when selection of the address gate signal line Gai is complete. Selection of the address gate signal line Ga(i+1) begins next.

The above operations are repeated, and the sub-frame period SFt+1 is complete when selection of all of the address gate signal lines is complete.

The divided sub-frame period SFt_2 begins next, and the memory gate signal lines Gm1 to Gmy are selected in order, in accordance with memory selection signals output from the memory gate signal line driving circuit 103.

Note that the address gate signal lines are not selected in the sub-frame period SFt_2, and therefore the address TFTs 305 are turned off.

Further, the electric potentials of the high voltage side electric power source lines HPS1 to HPSy and the low voltage side electric power source lines LPS1 to LPSy remain to be maintained at Vddh and Vss, respectively.

For example, in the i-th line of pixels, all of the memory TFTs 306 which have gate electrodes connected to the memory gate signal line Gmi are then turned on in the period for selecting the memory gate signal line Gmi. The t-bit digital video signal stored in the memory 309 is thus input to the gate electrodes of the EL driving TFTs 307.

When the t-bit digital video signal is input to the gate electrode of the EL driving TFT 307 of each pixel, switching of the EL driving TFTs 307 is controlled by the t-bit digital video signal, as in the divided sub-frame period SFt_1, and whether or not the EL elements 308 emit light is selected.

A period like this during which only the memory gate signal lines are selected, and the address gate signal lines are not selected, is referred to as a memory read out period.

The memory TFT 306 is turned off when selection of the memory gate signal line Gmi is complete. Selection of the memory gate signal line Gm(i+1) begins next.

When the above operations are repeated and selection of all of the memory gate signal lines is complete, the divided sub-frame period SFt_2 is completed.

A divided sub-frame period SFt+2_1, which is a pixel and memory write in period, begins next, and the address gate signal lines and the memory gate signal lines are selected in order.

The pixel and memory write in periods, the pixel write in periods, and the memory read out periods are thus formed in the method of driving a self light emitting device of embodiment mode 2.

Figure 14A:
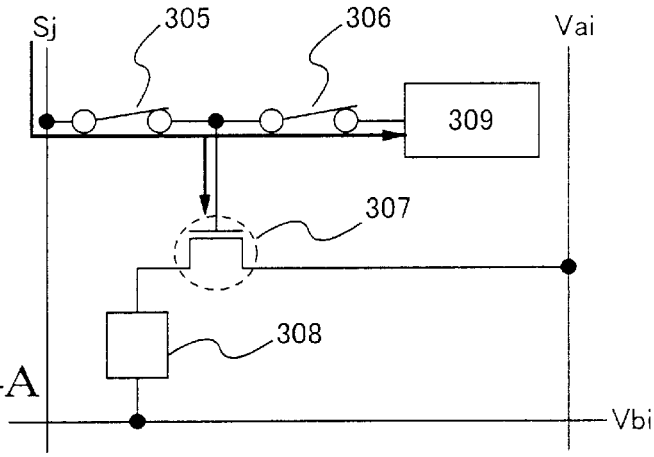
FIGS. 14A to 14C are diagrams showing connection structures for a pixel during driving.
Figure 14B:
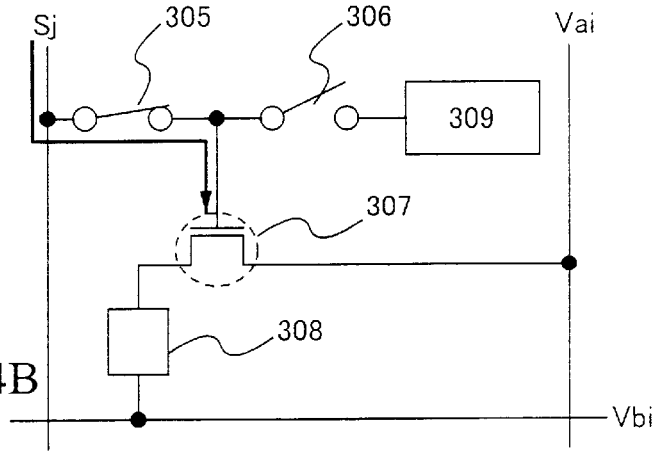
Figure 14C:
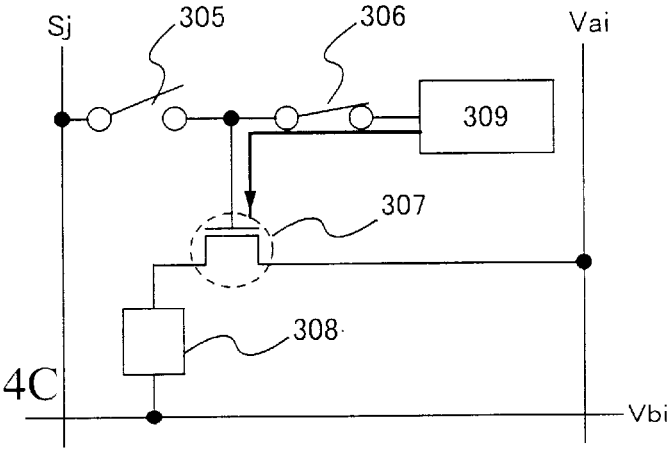

A connection structure of the pixel in the above driving method is simplified and shown in FIGS. 14A to 14C.

FIG. 14A is a case of a pixel and memory write in period. A digital video signal input from the source signal line Sj is input to the gate electrode of the EL driving TFT 307 and to the memory 309, through the address TFT 305 and the memory TFT 306 which are turned on.

FIG. 14B is a case of a pixel write in period. A digital video signal input from the source signal line Sj is input to the gate electrode of the EL driving TFT 307 through the address TFT 305 which is turned on. The memory TFT 306 is turned off, and therefore the digital video signal input previously into the memory 309 is stored.

FIG. 14C is a case of a memory read out period. A digital video signal input from the source signal line Sj is not input to the gate electrode of the EL driving TFT 307 because the address TFT 305 is turned off. The memory TFT 306 is turned on, and therefore the digital video signal stored in the memory 309 is input to the gate electrode of the EL driving TFT 307 through the memory TFT 306.

By repeating the above operations, driving of the EL elements is controlled in each sub-frame period.

Further, timing, at which the sub-frame periods and the divided sub-frame periods begin, differs for each line of pixels. FIG. 9 may be referred to regarding timing at which the sub-frame periods and the divided sub-frame periods begin in each line of pixels.

The timing at which one frame period begins differs for each line of pixels, but the length of one frame period is the same in each of the pixels.

Further, the lengths of each sub-frame period satisfy SF1::SF2:: . . . ::SFn=$2^0$::$2^1$:: . . . ::$2^{n-1}$. The sum of all of the divided sub-frame periods is considered as the length of the sub-frame period for cases in which the sub-frame period is divided into a plurality of divided sub-frame periods. For example, if a sub-frame period SFt is composed of three divided sub-frame periods SFt_1, SFt_2, and SFt_3, then SFt=SFt_1+SFt_2+SFt_3.

With the driving method of embodiment mode 1, gray scales are displayed by controlling the emission of light of the EL elements in each sub-frame period, including the divided sub-frame periods. The gray scale of a pixel is determined by the proportion of the sum of the sub-frame periods (turn on periods) during which light is emitted in one frame period.

As stated above, with the self light emitting device of embodiment mode 1, the turn on periods and the non-turn on periods are divided and appear alternately within one frame period. Thus, even if the visual point of a human moves slightly left and right, up and down, and only non-turned on pixels are continuously observed, or conversely, only turned on pixels are continuously observed, the length of successive turn on periods or non-turn on periods is shorter compared to driving by a conventional simple binary code method, and therefore observation of pseudo contours can be prevented.

Observation of conspicuous display hindrances, such as pseudo contours in time division driving by a binary code method, can therefore be prevented.

Note that, although the address gate signal lines and the memory gate signal lines are controlled by different gate signal line driving circuits (the address gate signal line driving circuit 102 and the memory gate signal line driving circuit 103) in embodiment mode 1, embodiment mode 1 is not limited to this. The address gate signal lines and the memory gate signal lines may also be controlled using by gate signal line driving circuit.

Further, an example is shown in embodiment mode 1 in which only one memory read out period is provided for one pixel and memory write in period, embodiment mode 1 is not limited to such. A plurality of the memory read out periods may also be formed, sandwiching the pixel write in periods in between.

In addition, although a structure is shown in embodiment mode 1 in which the first divided sub-frame period, from among the plurality of divided sub-frame periods, is the pixel and memory write in period, embodiment mode 1 is not limited to this structure. It is not always necessary that the first divided sub-frame period be a pixel and memory write in period in a case of dividing a sub-frame period into a plurality of divided sub-frame periods. Further, it is not always necessary that one of the divided sub-frame periods be a pixel and memory write in period. All of the divided sub-frame periods may be pixel and memory write in periods.

In addition, it is possible for a designer to appropriately set the appearance order of the sub-frame periods and the divided sub-frame periods, provided that divided sub-frame periods which are divided from the same sub-frame period do not appear consecutively.

Furthermore, the electric potential of the high voltage side electric power source lines and the electric potential of the low voltage side electric power source lines, are fixed during periods, which are not pixel and memory write in periods, for the self light emitting display device of embodiment mode 2. The memory formed within the pixels therefore functions as SRAM, and consequently a digital video signal once stored in the memory continues to be stored until the input of another digital video signal. Accordingly, for the case of static display using a one bit digital video signal, the static image can be continuously displayed without performing input of the video signal for each frame, provided that it is written in once. In other words, it becomes possible to stop the source signal line driving circuit after performing processing operations on at lest the first frame of signals when a static image is displayed, and it thus becomes possible to greatly reduce electric power consumption.

Embodiments

Embodiments of the present invention are explained below.

[Embodiment 1]

An example of driving a self light emitting device of the present invention, which has the structure shown in FIGS. 4 to 6, using an 8 bit digital video signal is explained.

Figure 15:
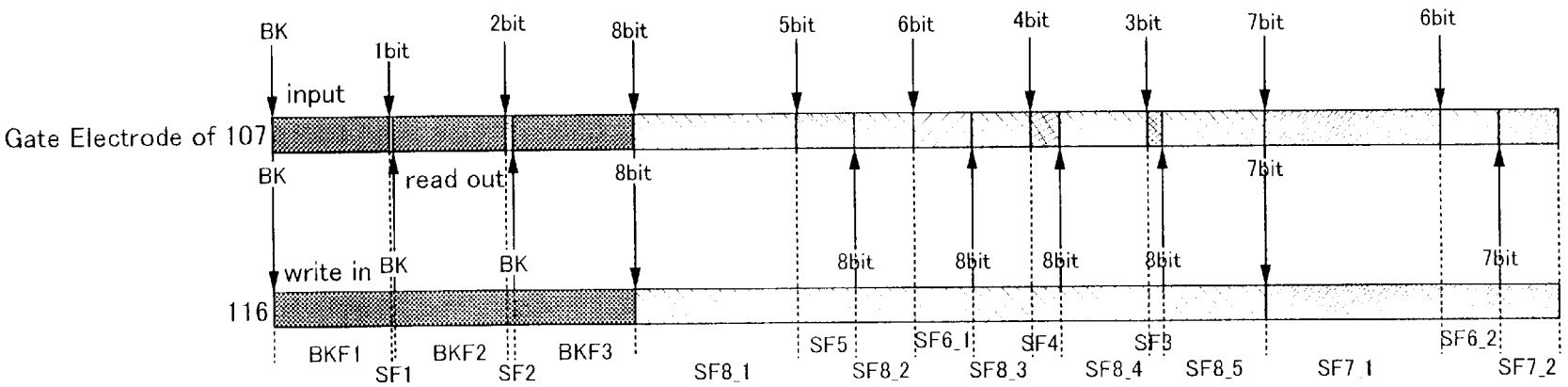
FIG. 15 is a diagram showing a method of driving a self light emitting device of the present invention.

FIG. 15 is a diagram showing simply a driving method of embodiment 1. The bit numbers of digital video signals input to the gate electrodes of the EL driving TFTs 107 and the connection points 116 are shown. Note that the horizontal axis is time.

Reference symbol BK denotes a digital signal by which display is not performed in any of the pixels (non-display signal). The non-display signal therefore has no image information. If the non-display signal is input to the gate electrodes of the EL driving TFTs 107 instead of the digital video signal, then the EL driving TFTs turn off, and EL element do not emit light. Note that a period during which none of the pixels perform display in accordance with a non-display signal, is referred to as a non-display period (BKF) in this specification.

When one frame period begins, first a non-display period BKF1 begins. The non-display period BKF1 is a pixel and memory write in period, and the non-display signal BK input to the source signal line Sj is input to the gate electrode of the EL driving TFT 107 and to the memory 109.

The EL driving TFT 107 turns off when the non-display signal BK is input to the gate electrode of the EL driving TFT 107, and the EL element does not emit light.

A sub-frame period SF1 begins next. The sub-frame period SF1 is a pixel write in period, and the first bit of the digital video signal is input to the gate electrodes of the EL driving TFTs 107. Whether or not the EL elements emit light is then selected in accordance with the first bit of the digital video signal.

The non-display signal BK is stored in the memory 109 in the sub-frame period SF1.

A non-display period BKF2 begins next. The non-display period BKF2 is a memory read out period, and the non-display signal BK stored in the memory 109 is read out and input to the gate electrodes of the EL driving TFTs 107. The EL driving TFTs 107 turn off when the non-display signal BK is input to the gate electrodes of the EL driving TFTs 107, and the EL elements do not emit light.

A sub-frame period SF2 begins next. The sub-frame period SF2 is a pixel write in period, and therefore the second bit of the digital video signal is input to the gate electrodes of the EL driving TFTs 107. Whether or not the EL elements emit light is selected in accordance with the second bit of the digital video signal.

The non-display signal BK is stored in the memory 109 in the sub-frame period SF2.

A non-display period BKF3 begins next. The non-display period BKF3 is a memory read out period, and the non-display signal BK stored in the memory 109 is read out and input to the gate electrodes of the EL driving TFTs 107. The EL driving TFTs 107 turn off when the non-display signal BK is input to the gate electrodes of the EL driving TFTs 107, and the EL elements do not emit light.

A divided sub-frame period SF8_1 begins next. The divided sub-frame period SF8_1 is a pixel and memory write in period, and the 8 bit of the digital video signal input to the source signal line Sj is then input to the gate electrodes of the EL driving TFTs 107 and to the memory 109. Whether or not the EL elements emit light is selected in accordance with the 8 bit of the digital video signal.

A sub-frame period SF5 begins next. The sub-frame period SF5 is a pixel write in period, and therefore the 5 bit of the digital video signal is input to the gate electrodes of the EL driving TFTs 107. Whether or not the EL elements emit light is selected in accordance with the 5 bit of the digital video signal.

The 8 bit of the digital video signal is stored in the memory 109 during the sub-frame period SF5.

A divided sub-frame period SF8_2 begins next. The divided sub-frame period SF8_2 is a memory read out period, and the 8 bit of the digital video signal stored in the memory 109 is read out and then input to the gate electrodes of the EL driving TFTs 107. Whether or not the EL elements emit light is selected in accordance with the 8 bit of the digital video signal.

A divided sub-frame period SF6_1 begins next. The divided sub-frame period SF6_1 is a pixel write in period, and therefore the 6 bit of the digital video signal is input to the gate electrodes of the EL driving TFTs 107. Whether or not the EL elements emit light is selected in accordance with the 6 bit of the digital video signal.

The 8 bit of the digital video signal is stored in the memory 109 during the divided sub-frame period SF6_1.

A divided sub-frame period SF8_3 begins next. The divided sub-frame period SF8_3 is a memory read out period, and the 8 bit of the digital video signal stored in the memory 109 is read out and then input to the gate electrodes of the EL driving TFTs 107. Whether or not the EL elements emit light is selected in accordance with the 8 bit of the digital video signal.

A sub-frame periods SF4 begins next. The sub-frame period SF4 is a pixel write in period, and therefore the 4 bit of the digital video signal is input to the gate electrodes of the EL driving TFTs 107. Whether or not the EL elements emit light is selected in accordance with the 4 bit of the digital video signal.

The 8 bit of the digital video signal is stored in the memory 109 during the sub-frame period SF4.

A divided sub-frame period SF8_4 begins next. The divided sub-frame period SF8_4 is a memory read out period, and the 8 bit of the digital video signal stored in the memory 109 is read out and then input to the gate electrodes of the EL driving TFTs 107. Whether or not the EL elements emit light is selected in accordance with the 8 bit of the digital video signal.

A sub-frame period SF3 begins next. The sub-frame period SF3 is a pixel write in period, and therefore the 3 bit of the digital video signal is input to the gate electrodes of the EL driving TFTs 107. Whether or not the EL elements emit light is selected in accordance with the 3 bit of the digital video signal.

The 8 bit of the digital video signal is stored in the memory 109 during the sub-frame period SF3.

A divided sub-frame period SF8_5 begins next. The divided sub-frame period SF8_5 is a memory read out period, and the 8 bit of the digital video signal stored in the memory 109 is read out and then input to the gate electrodes of the EL driving TFTs 107. Whether or not the EL elements emit light is selected in accordance with the 8 bit of the digital video signal.

A divided sub-frame period SF7_1 begins next. The divided sub-frame period SF7_1 is a pixel and memory write in period, and the 7 bit of the digital video signal input to the source signal line Sj is then input to the gate electrodes of the EL driving TFTs 107 and to the memory 109. Whether or not the EL elements emit light is selected in accordance with the 7 bit of the digital video signal.

A divided sub-frame period SF6_2 begins next. The divided sub-frame period SF6_2 is a pixel write in period, and therefore the 6 bit of the digital video signal is input to the gate electrodes of the EL driving TFTs 107. Whether or not the EL elements emit light is selected in accordance with the 6 bit of the digital video signal.

The 7 bit of the digital video signal is stored in the memory 109 during the divided sub-frame period SF6_2.

A divided sub-frame period SF7_2 begins next. The divided sub-frame period SF7_2 is a memory read out period, and the 7 bit of the digital video signal stored in the memory 109 is read out and then input to the gate electrodes of the EL driving TFTs 107. Whether or not the EL elements emit light is selected in accordance with the 7 bit of the digital video signal.

One frame period is completed when the divided sub-frame period SF7_2 finishes. The gray scale of each pixel is determined by the proportion of the sum of the lengths of the sub-frame periods during which light is emitted in one frame period.

Observation of display hindrances such as pseudo contours conspicuous in time division driving by a binary code method can thus be prevented in accordance with the above structure.

Note that although a method of driving self light emitting devices which have the structure shown in FIGS. 4 to 6 is explained in embodiment 1, the driving method shown in embodiment 1 can also be used for self light emitting devices which have the structure shown in FIGS. 10 to 12.

[Embodiment 2]

An example is explained in embodiment 2, in which the polarity of the TFT differs from that of the pixels shown in embodiment mode 1.

Figure 16:
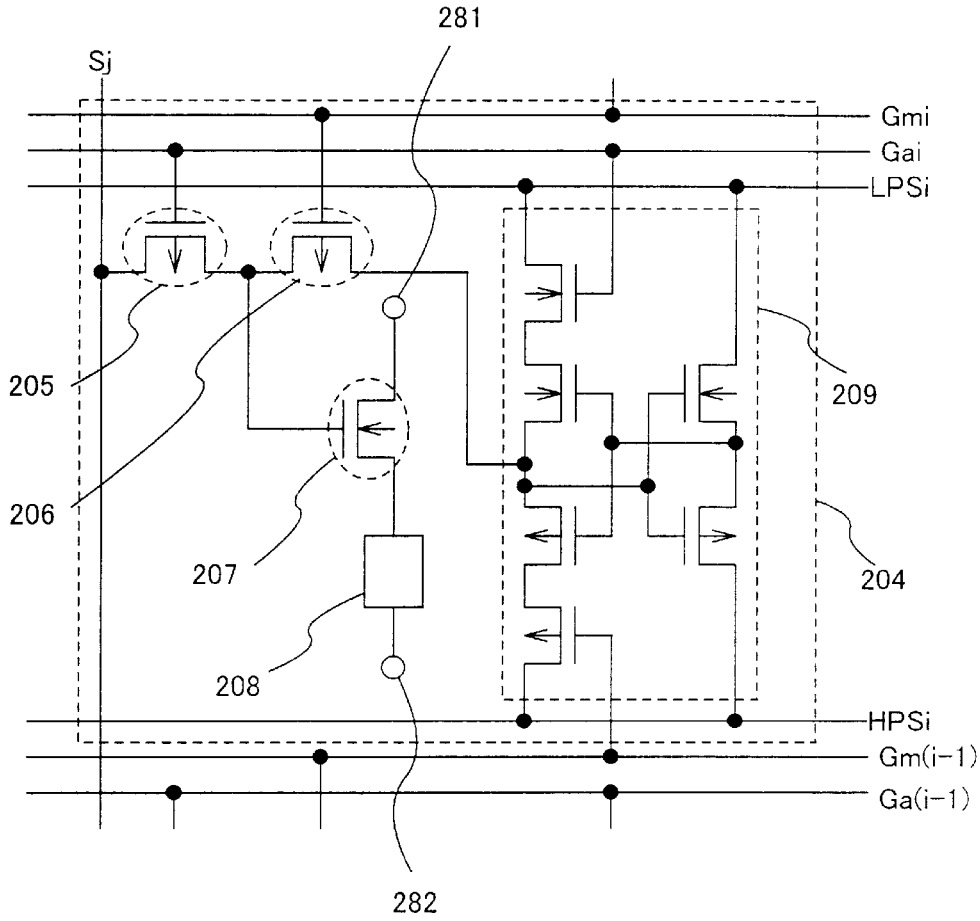
FIG. 16 is a circuit diagram of a pixel of a self light emitting device of the present invention.

A structure of a pixel of embodiment 2 is shown in FIG. 16. Shown in FIG. 16 is one arbitrary pixel of a plurality of pixels 204, and the pixel has the source signal line Sj (one from among S1 to Sx), the address gate signal line Gai (one from among Ga1 to Gay), the memory gate signal line Gmi (one from among Gm1 to Gmy), the high voltage side electric power source line HPSi (one from among HPS1 to HPSy), and the low voltage side electric power source line LPSi (one from among LPs1 to LPSy).

Further, the pixel 204 has an address TFT 205, a memory TFT 206, an EL driving TFT 207, an EL element 208, and a memory 209.

A gate electrode of the address TFT 205 is connected to the address gate signal line Gai. Further, one of a source region and a drain region of the address TFT 205 is connected to the source signal line Sj, and the other is connected to a gate electrode of the EL driving TFT 207.

A gate electrode of the memory TFT 206 is connected to the memory gate signal line Gmi. Furthermore, one of a source region and a drain region of the memory TFT 206 is connected to the gate electrode of the EL driving TFT 207, and the other is connected to the memory 209. In other words, one of the source region and the drain region of the address TFT 205, which is not connected to the source signal line Sj, is connected to one of the source region and the drain region of the memory TFT 206, which is not connected to the memory 209.

A source region of the EL driving TFT 207 is connected to a pixel electrode side electric power source 281, and a drain region of the EL driving TFT 207 is connected to a pixel electrode of the EL element 208. The EL element 208 has the pixel electrode, an opposing electrode, and an EL layer formed between the pixel electrode and the opposing electrode. The opposing electrode of the EL element 208 is connected to an opposing electrode side electric power source 282.

The electric potentials of the pixel electrode side electric power source 281 and the opposing electrode side electric power source 282 have a mutual electric potential difference, so that the EL element 208 emits light when the electric potential of the pixel electrode side electric power source 281 is imparted to the pixel electrode of the EL element 208.

One of the pixel electrode and the opposing electrode of the EL element is an anode, and the other is a cathode. The EL driving TFT 207 is an n-channel TFT in embodiment 2, and therefore the cathode is used as the pixel electrode, and the anode is used as the opposing electrode.

Note that a structure, in which the pixel electrode side electric power source 281 connected to the source region of the EL driving TFT 207 is made common with the low voltage side electric power source, and the opposing electrode side electric power source 282 connected to the opposing electrode of the EL element 208 is made common with high voltage side electric power source, may also be used.

Figure 17:
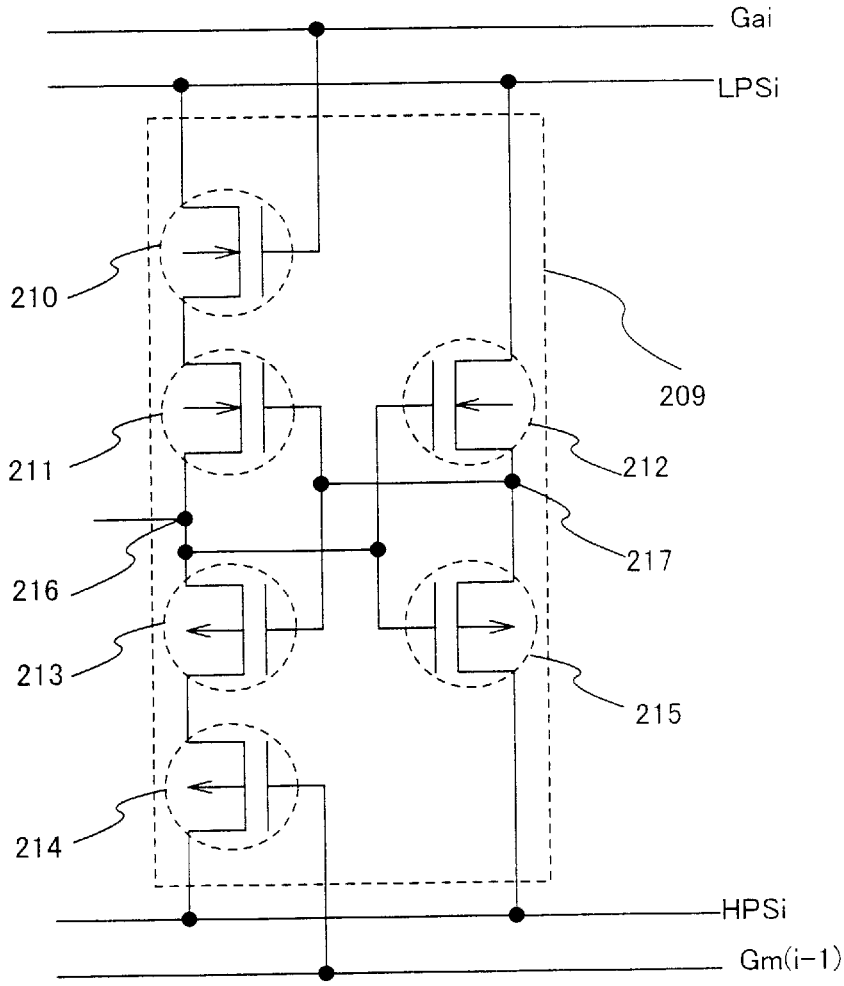
FIG. 17 is a memory circuit diagram.

A detailed structure of the memory 209 is explained next. FIG. 17 shows a detailed structure of the memory 209.

The memory 209 has three n-channel TFTs 210, 211, and 212, and three p-channel TFTs 213, 214, and 215.

A source region of the n-channel TFT 210 is connected to the low voltage side electric power source line LPSi, and a drain region of the n-channel TFT 210 is connected to the source region of the n-channel TFT 211. Further, a source region of the p-channel TFT 214 is connected to the high voltage side electric power source line HPSi, and a drain region of the p-channel TFT 214 is connected to a source region of the p-channel TFT 213.

A drain region of the n-channel TFT 211 and a drain region of the p-channel TFT 213 are connected at a connection point 216.

Further, a source region of the n-channel TFT 212 is connected to the low voltage side electric power source line LPSi, and a source region of the p-channel TFT 215 is connected to the high voltage side electric power source line HPSi. A drain region of the n-channel TFT 212 and a drain region of the p-channel TFT 215 are connected at a connection point 217.

A gate electrode of the n-channel TFT 210 is connected to the address gate signal line Gai, and a gate electrode of the p-channel TFT 214 is connected to the memory gate signal line Gm(i−1).

Gate electrodes of the n-channel TFT 211 and the p-channel TFT 213 are connected, and each connected at the connection point 217. Gate electrodes of the n-channel TFT 212 and the p-channel TFT 215 are connected, and also connected at the connection point 216.

The connection point 216 is connected to the source region or the drain region of the memory TFT 206.

Note that it is necessary that the address TFT 205 and the memory TFT 206 have the same polarity in embodiment 2. Further, it is necessary that the address TFT 205 and the memory TFT 206 have the opposite polarity to that of the EL driving TFT 207.

In addition, it is necessary that, from among the TFTs of the memory 209, the TFT which has a gate electrode connected to the address gate signal line Gai have the same polarity as that of the EL driving TFT 207. Furthermore, it is necessary that, from among the TFTs of the memory 209, the TFT which has a gate electrode connected to the memory gate signal line Ga(i−1) of the adjacent pixel have the same polarity as that of the address TFT 205 and the memory TFT 206.

It is possible to implement embodiment 2 by freely combining it with embodiment 1.

[Embodiment 3]

An example in which a capacitor is formed in the pixel shown in FIG. 5 is explained in embodiment 3.

Figure 18:
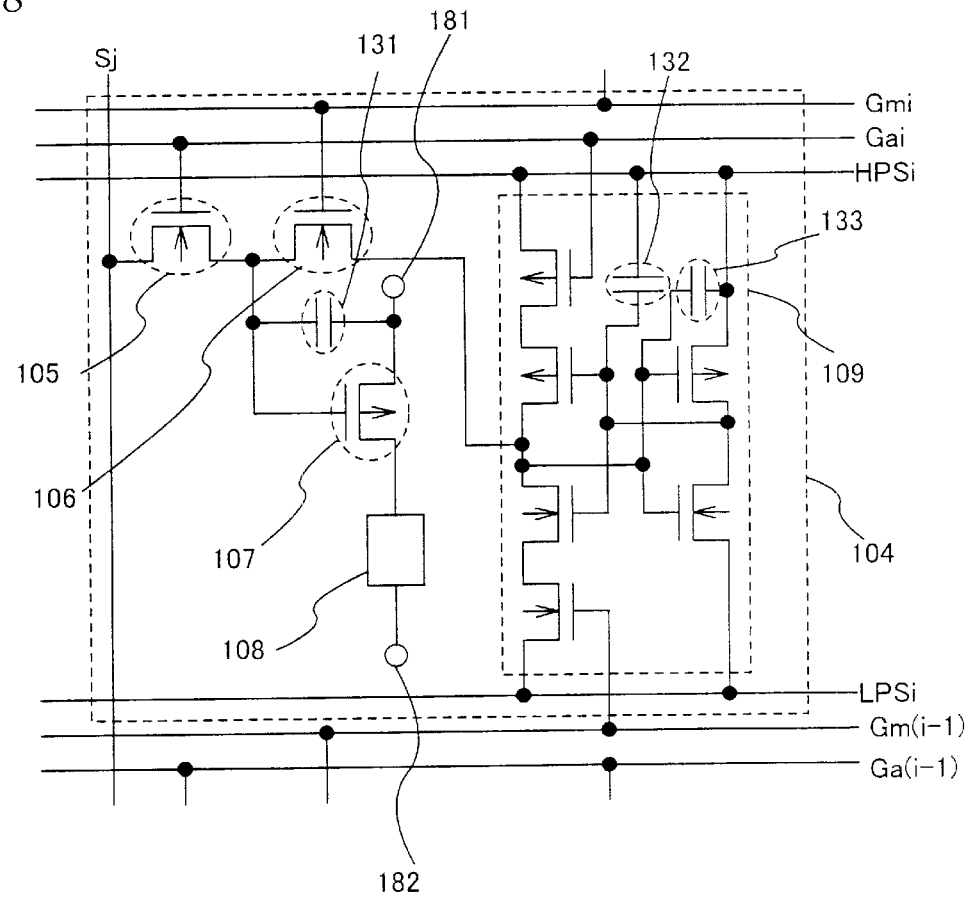
FIG. 18 is a circuit diagram of a pixel of a self light emitting device of the present invention.

FIG. 18 shows a structure of a pixel of embodiment 3. Portions shown in FIG. 5 use the same reference symbols. A detailed connection state of TFTs and EL elements except for capacitors has already been explained in the embodiment modes, and therefore only a connection structure for the capacitors is explained here.

A capacitor 131 is formed between the gate electrode of the EL driving TFT 107 and the high voltage side electric power source line HPSi. Further, capacitors 132 and 133 are formed of the high voltage electric power source line HPSi and the gate electrodes of the two sets of n-channel TFT and p-channel TFT which have drain regions mutually connected.

A reduction of an electric charge stored in the memory 109 due to off currents (electric currents flowing in channel forming regions when the TFTs are off) of the address TFT 105 and the memory TFT 106 can be prevented by forming the capacitors.

Note that it is not always necessary to form the capacitors 131, 132, and 133.

It is possible to implement embodiment 3 by freely combining it with embodiment 1 or embodiment 2.

[Embodiment 4]

An example is explained in embodiment 4 in which the TFT polarity differs from that of the pixels shown in embodiment mode 2.

Figure 19:
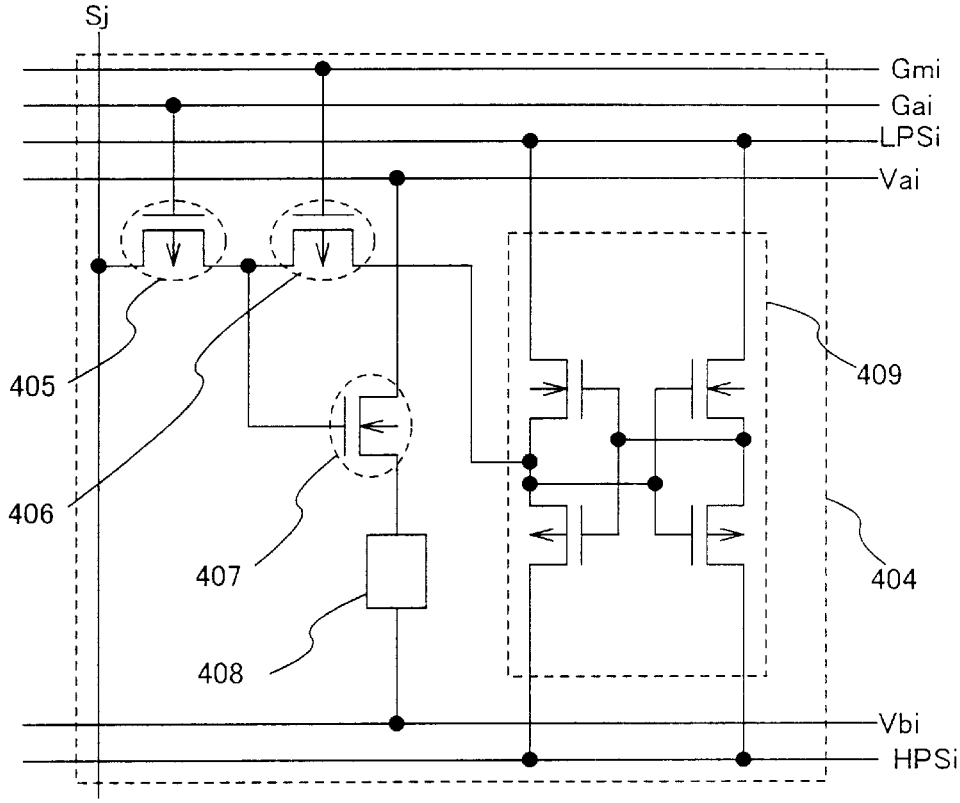
FIG. 19 is a circuit diagram of a pixel of a self light emitting device of the present invention.

A detailed structure of a pixel 404 is shown in FIG. 19. Shown in FIG. 19 is one arbitrary pixel from a plurality of the pixels 404, and the pixel has the source signal line Sj (one from among S1 to Sx), the address gate signal line Gai (one from among Ga1 to Gay), the memory gate signal line Gmi (one from among Gm1 to Gmy), the high voltage side electric power source line HPSi (one from among HPS1 to HPSy), and the low voltage side electric power source line LPSi (one from among LPs1 to LPSy), the pixel electrode side electric power source line Vai (one from among Va1 to Vay) and opposing electrode side electric power source Vbi (one from among Vb1 to Vby).

The high voltage side electric power source lines HPS1 to HPSy are connected to a high voltage side electric power source, and the low voltage side electric power source lines LPS1 to LPSy are connected to a low voltage side electric power source. Further, the pixel electrode side electric power source lines Va1 to Vay are connected to a pixel electrode side electric power source, and the opposing electrode side electric power source lines Vb1 to Vby are connected to an opposing electrode side electric power source.

Further, the pixel 404 has an address TFT 405, a memory TFT 406, an EL driving TFT 407, an EL element 408, and a memory 409. The address TFT 405 and the memory TFT 406 are p-channel TFTs in embodiment 4, and the EL driving TFT 407 is an n-channel TFT.

A gate electrode of the address TFT 405 is connected to the address gate signal line Gai. Further, one of a source region and a drain region of the address TFT 405 is connected to the source signal line Sj, and the other is connected to a gate electrode of the EL driving TFT 407.

A gate electrode of the memory TFT 406 is connected to the memory gate signal line Gmi. Furthermore, one of a source region and a drain region of the memory TFT 406 is connected to the gate electrode of the EL driving TFT 407, and the other is connected to the memory 409. In other words, one of the source region and the drain region of the address TFT 405, which is not connected to the source signal line Sj, is connected to one of the source region and the drain region of the memory TFT 406, which is not connected to the memory 409.

A source region of the EL driving TFT 407 is connected to the pixel electrode side electric power source line Vai, and a drain region of the EL driving TFT 407 is connected to a pixel electrode of the EL element 408. The EL element 408 has the pixel electrode, an opposing electrode, and an EL layer formed between the pixel electrode and the opposing electrode. The opposing electrode of the EL element 408 is connected to the opposing electrode side electric power source line Vbi.

The electric potentials of the pixel electrode side electric power source line Vai and the opposing electrode side electric power source line Vbi have a mutual electric potential difference, so that the EL element 408 emits light when the electric potential of the pixel electrode side electric power source line Vai is imparted to the pixel electrode of the EL element 408.

Further, one of the pixel electrode and the opposing electrode of the EL element is an anode, and the other is a cathode. It is preferable to use the cathode as the pixel electrode and the anode as the opposing electrode in cases in which the EL driving TFT 407 is an n-channel TFT, as in embodiment 4.

Figure 20:
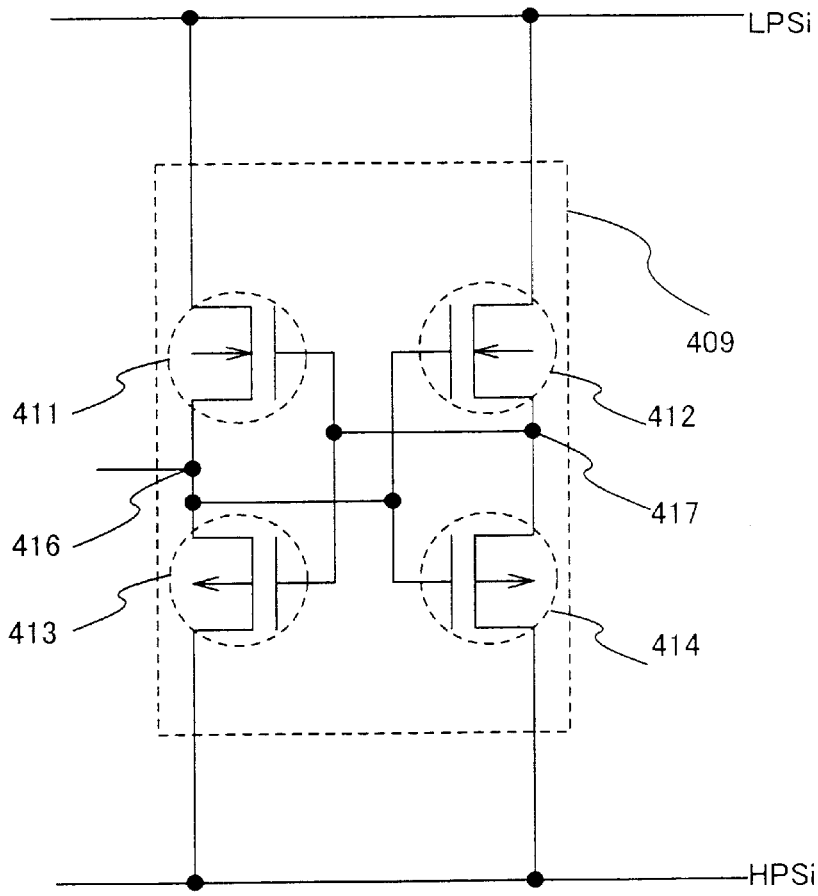
FIG. 20 is a memory circuit diagram.

A detailed structure of the memory 409 is explained next. FIG. 20 shows a detailed structure of the memory 409.

The memory 409 has two n-channel TFTs (NTFTs) 411 and 412, and two p-channel TFTs (PTFTs) 413 and 414.

Source regions of the n-channel TFTs 411 and 412 are each connected to the low voltage side electric power supply line LPSi. Further, source regions of the p-channel TFTs 413 and 414 are each connected to the high voltage side electric power source line HPSi.

A drain region of the n-channel TFT 411 and a drain region of the p-channel TFT 413 are connected at a connection point 416. Further, a drain region of the n-channel TFT 412 and a drain region of the p-channel TFT 414 are connected at a connection point 417.

Gate electrodes of the n-channel TFT 411 and the p-channel TFT 413 are connected to the connection point 417. Further, gate electrodes of the p-channel TFT 412 and the n-channel TFT 414 are connected to the connection point 416.

The connection point 416 is connected to a source region or a drain region of the memory TFT 406.

Note that the address TFT 405 and the memory TFT 406 have the same polarity.

It is possible to implement embodiment 4 by freely combining it with embodiment 1.

[Embodiment 5]

An example in which a capacitor is formed in the pixel shown in FIG. 11 is explained in embodiment 5.

Figure 21:
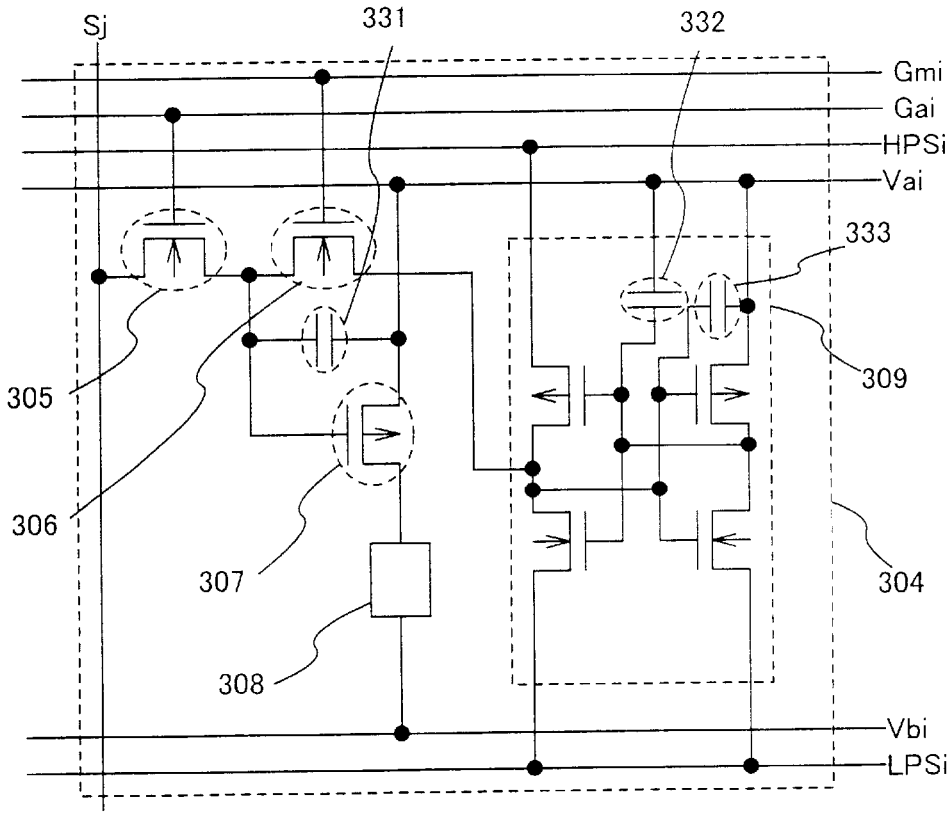
FIG. 21 is a circuit diagram of a pixel of a self light emitting device of the present invention.

FIG. 21 shows a structure of a pixel of embodiment 5. Portions shown in FIG. 11 use the same reference symbols. A detailed connection state of TFTs and EL elements, except for capacitors, has already been explained in the embodiment modes, and therefore only a connection structure for the capacitors is explained here.

A capacitor 331 is formed between the gate electrode of the EL driving TFT 307 and the pixel electrode side electric power source line Vai. Further, capacitors 332 and 333 are formed by the pixel electrode side electric power source line Vai and the gate electrodes of the two sets of n-channel TFT and p-channel TFT of the memory 309, which has drain electrodes mutually connected.

A reduction of an electric charge stored in the memory 309 due to off currents (electric currents flowing in channel forming regions when the TFTs are off)of the address TFT 305 and the memory TFT 306 can be prevented by forming the capacitors.

Note that it is not always necessary to form the capacitors 331, 332, and 333 for cases in which there is a sufficient parasitic capacitance or the like.

It is possible to implement embodiment 5 by freely combining it with embodiment 1 or embodiment 4.

[Embodiment 6]

In this embodiment, a detailed structure of a source signal line driving circuit, an address gate signal line driving circuit and a memory gate signal line driving circuit, which are used for driving a pixel portion of a self light emitting device of the present invention are explained.

Figure 22A:
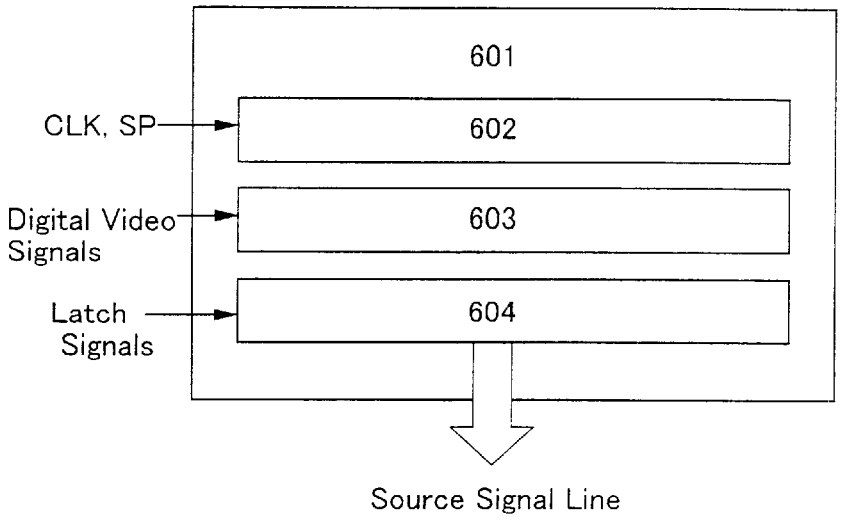
FIGS. 22A and 22B are block diagrams of driving circuits of a self light emitting device of the present invention.
Figure 22B:
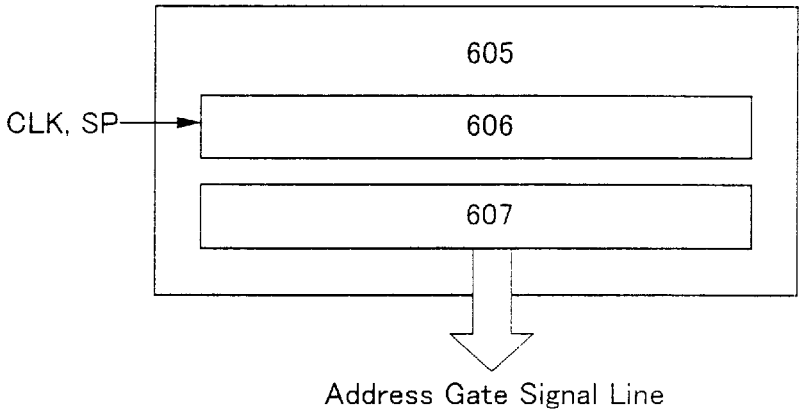

The block figure of a self light emitting device of this embodiment is shown in FIGS. 22A and 22B. FIG. 22A shows the source signal line driving 601, which has a shift register 602, a latch (A) 603, and a latch (B) 604.

A clock signal CLK and a start pulse SP are input to the shift register 602 in the source signal line driving circuit 601. The shift register 602 generates timing signals in order based upon the clock signal CLK and the start pulse SP, and supplies the timing signals one after another to the subsequent stage circuit through the buffer (not illustrated) and the like.

Note that, although not shown in the figure, the timing signals output from the shift register circuit 602 may be buffer amplified by a buffer and the like. The load capacitance (parasitic capacitance) of a wiring to which the timing signals are supplied is large because many of the circuits or elements are connected to the wiring. The buffer is formed in order to prevent bluntness in the rise and fall of the timing signal, generated due to the large load capacitance. In addition, the buffer is not always necessary provided.

The timing signal amplified by a buffer is inputted to the latch (A) 603. The latch(A) 603 has a plurality of latch stages for processing n-bit digital video signals. The latch (A) 603 writes in and maintains the n-bit digital video signal input from external of the source signal line driving circuit 601, when the timing signal is input.

Note that the digital video signal may also be input in order to the plurality of latch stages of the latch (A) 603 in writing in the digital video signal to the latch (A) 603. However, the present invention is not limited to this structure. The plurality of latch stages of the latch (A) 603 may be divided into a certain number of groups, and the digital video signal may be input to the respective groups at the same time in parallel, performing partitioned driving. For example, when the latches are divided into groups every four stages, it is referred to as partitioned driving with 4 divisions.

The period during which the digital video signal is completely written into all of the latch stages of the latch (A) 603 is referred to as a line period. In practice, there are cases in which the line period includes the addition of a horizontal return period to the above line period.

One line period is completed, the latch signal is inputted to the latch (B) 604. At the moment, the digital video signal written into and stored in the latch (A) 603 is send all together to be written into and stored in the latch (B) 604.

In the latch (A) 603 after completing sending the digital video signal to the latch (B) 604, it is performed to write into the digital video signal in accordance with the timing signal from the shift resister 602.

In the second ordered one line period, the digital video signal which is written into and stored in the latch (B) 603 is inputted to the source signal line.

FIG. 22B is a block figure showing the structure of address gate signal driving circuit.

The address gate signal driving circuit 605 has the shift resister 606 and the buffer 607. According to circumstances, the level shift is provided.

In the address gate signal line driving circuit 605, the timing signal from the shift resister 606 is inputted to the buffer 607, and then to a corresponding address gate signal line. The gate electrodes of the address TFTs for one line of pixels are connected to the address gate signal lines, and all of the address TFTs of the one line of pixels must be placed in an ON state simultaneously. A circuit which is capable of handling the flow of a large electric current is therefore used for the buffer.

Since the memory gate signal driving circuit is the same as the structure of the address gate signal driving circuit, FIG. 22B is referred. However, in the case of the memory gate signal driving circuit, the output from the buffer is inputted to the memory gate signal line. The gate electrode of the memory TFT of the one line of pixels is connected to the memory gate signal line, and all of the address TFTs of the one line of pixels must be placed in an ON state simultaneously. A circuit which is capable of handling the flow of a large electric current is therefore used for the buffer.

Note that it is possible to implement Embodiment 6 in combination with Embodiments 1 to 5.

[Embodiment 7]

In this embodiment, a method of forming TFT of a driving circuit (an n-channel TFT and a p-channel TFT) arranged in the periphery of the pixel portion and a pixel portion will be explained in detail. In this embodiment, the address TFT and the EL driving TFT is only shown as a typical TFT of the pixel portion, the memory TFT in each pixels and the TFT in the memory can be formed simultaneously.

Figures 23A, 23B, 23C:
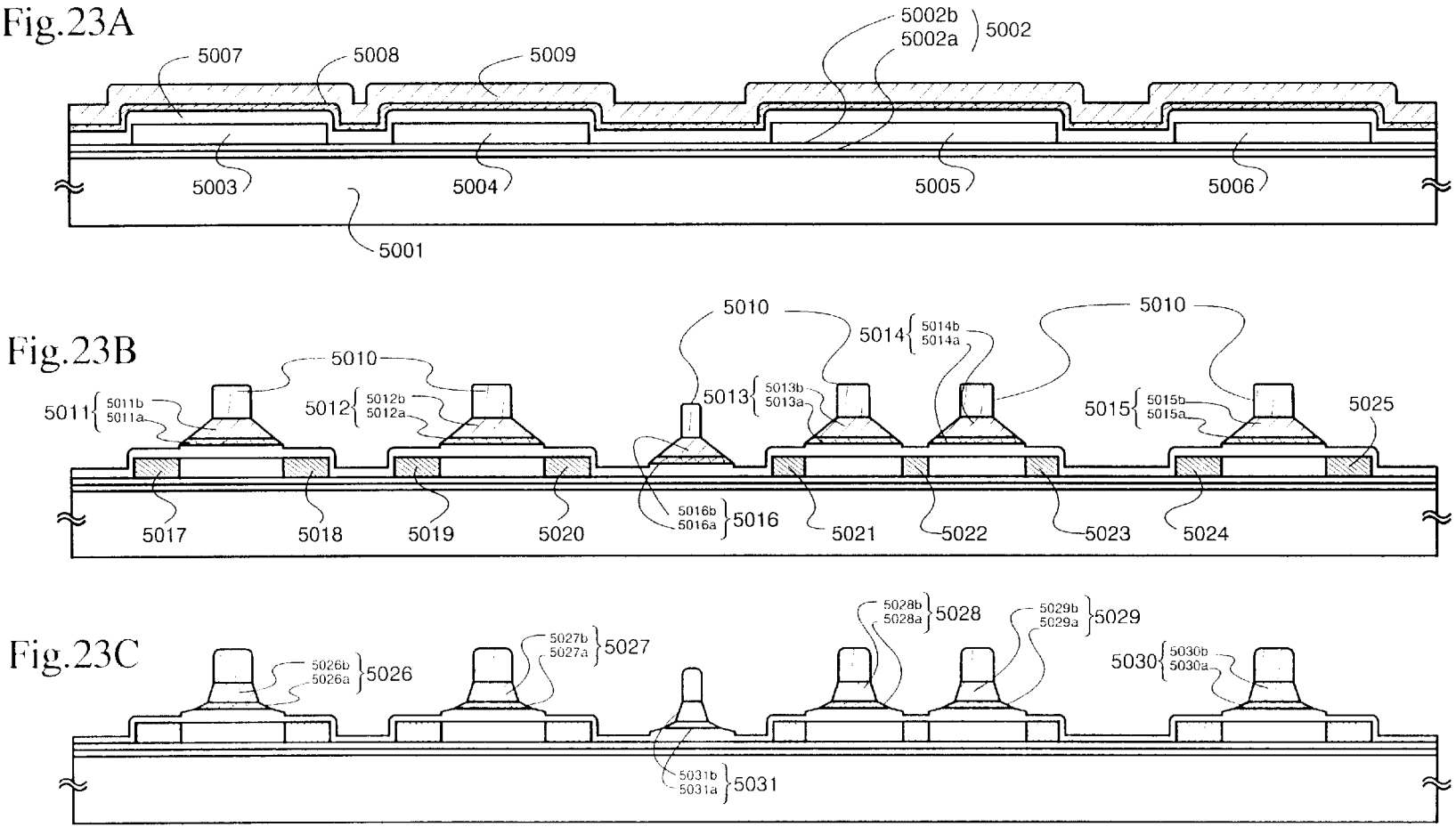
FIGS. 23A to 23C are diagrams showing a method of manufacturing a TFT.

First, as shown in FIG. 23A, a base film 5002 formed of an insulating film such as a silicon oxide film, a silicon nitride film or a silicon nitride oxide film is formed on a substrate 5001 formed of glass such as barium borosilicate glass or alumino borosilicate glass represented by #7059 glass and #1737 glass of CORNING Corporation, etc. For example, a silicon nitride oxide film 5002*a* formed from $SiH_4$, $NH_3$ and $N_2O$ by the plasma CVD method and having a thickness of from 10 to 200 [nm] (preferably 50 to 100 [nm]) is formed. Similarly, a hydrogenerated silicon nitride oxide film 5002*b* formed from $SiH_4$ and $N_2O$ and having a thickness of from 50 to 200 [nm] (preferably 100 to 150 [nm]) is layered thereon. In this embodiment, the base film 5002 has a two-layer structure, but may also be formed as a single layer film of one of the above insulating films, or a laminate film having more than two layers of the above insulating films.

Island-like semiconductor layers 5003 to 5006 are formed from a crystalline semiconductor film obtained by conducting laser crystallization or a known thermal crystallization on a semiconductor film having an amorphous structure. These island-like semiconductor layers 5003 to 5006 each have a thickness of from 25 to 80 [nm] (preferably 30 to 60 [nm]). No limitation is put on the material of the crystalline semiconductor film, but the crystalline semiconductor film is preferably formed from silicon, a silicon germanium (SiGe) alloy, etc.

When the crystalline semiconductor film is to be manufactured by the laser crystallization method, an excimer laser, a YAG laser and a $YVO_4$ laser of a pulse oscillation type or continuous light emitting type are used. When these lasers are used, it is preferable to use a method in which a laser beam radiated from a laser emitting device is converged into a linear shape by an optical system and then is irradiated to the semiconductor film. A crystallization condition is suitably selected by an operator. When the excimer laser is used, pulse oscillation frequency is set to 300 [Hz], and laser energy density is set to from 100 to 400 [mJ/cm$^2$] (typically 200 to 300 [mJ/cm$^2$]. When the YAG laser is used, pulse oscillation frequency is preferably set to from 30 to 300 [kHz] by using its second harmonic, and laser energy density is preferably set to from 300 to 600 [mJ/cm$^2$] (typically 350 to 500 [mJ/cm$^2$]). The laser beam converged into a linear shape and having a width of from 100 to 1000 [$\mu$m], e.g. 400 [$\mu$m] is, is irradiated to the entire substrate face. At this time, overlapping ratio of the linear laser beam is set to from 50 to 90 [%].

Next, a gate insulating film 5007 covering the island-like semiconductor layers 5003 to 5006 is formed. The gate insulating film 5007 is formed from an insulating film containing silicon and having a thickness of from 40 to 150 [nm] by using the plasma CVD method or a sputtering method. In this embodiment, the gate insulating film 5007 is formed from a silicon nitride oxide film of 120 [nm] in thickness. However, the gate insulating film is not limited to such a silicon nitride oxide film, but it may be an insulating film containing other and having a single layer or a laminated layer structure. For example, when a silicon oxide film is used, TEOS (Tetraethyl Orthosilicate) and $O_2$ are mixed by the plasma CVD method, the reaction pressure is set to 40 [Pa], the substrate temperature is set to from 300 to 400[° C.], and the high frequency (13.56 [MHZ]) power density is set to from 0.5 to 0.8 [W/cm$^2$] for electric discharge. Thus, the silicon oxide film can be formed by discharge. The silicon oxide film manufactured in this way can then obtain preferable characteristics as the gate insulating film by thermal annealing at from 400 to 500[° C.].

A first conductive film 5008 and a second conductive film 5009 for forming a gate electrode are formed on the gate insulating film 5007. In this embodiment, the first conductive film 5008 having a thickness of from 50 to 100 [nm] is formed from Ta, and the second conductive film 5009 having a thickness of from 100 to 300 [nm] is formed from W.

The Ta film is formed by a sputtering method, and the target of Ta is sputtered by Ar. In this case, when suitable amounts of Xe and Kr are added to Ar, internal stress of the Ta film is released, and pealing off of this film can be prevented. Resistivity of the Ta film of phase is about 20 [$\mu\Omega$cm], and this Ta film can be used for the gate electrode. However, resistivity of the Ta film of $\beta$ phase is about 180 [$\mu\Omega$cm], and is not suitable for the gate electrode. When tantalum nitride having a crystal structure close to that of the $\alpha$ phase of Ta and having a thickness of about 10 to 50 [nm] is formed in advance as the base for the Ta film to form the Ta film of the $\alpha$ phase, the Ta film of $\alpha$ phase can be easily obtained.

The W film is formed by the sputtering method with W as a target. Further, the W film can be also formed by a thermal CVD method using tungsten hexafluoride ($WF_6$). In any case, it is necessary to reduce resistance to use this film as the gate electrode. It is desirable to set resistivity of the W film to be equal to or smaller than 20 [$\mu\Omega$cm]. When crystal grains of the W film are increased in size, resistivity of the W film can be reduced. However, when there are many impurity elements such as oxygen, etc. within the W film, crystallization is prevented and resistivity is increased. Accordingly, in the case of the sputtering method, a W-target of 99.99[%] or 99.9999[%] in purity is used, and the W film is formed by taking a sufficient care of not mixing impurities from a gaseous phase into the W film time when the film is to be formed. Thus, a resistivity of from 9 to 20 [$\mu\Omega$cm] can be realized.

In this embodiment, the first conductive film 5008 is formed from Ta, and the second conductive film 5009 is formed from W. However, the present invention is not limited to this case. Each of these conductive films may also be formed from an element selected from Ta, W, Ti, Mo, Al and Cu, or an alloy material or a compound material having these elements as principal components. Further, a semiconductor film represented by a poly crystal silicon film doped with an impurity element such as phosphorus may also be used. Examples of combinations other than those shown in this embodiment include: a combination in which the first conductive film 5008 is formed from tantalum nitride (TaN), and the second conductive film 5009 is formed from W; a combination in which the first conductive film 5008 is formed from tantalum nitride (TaN), and the second conductive film 5009 is formed from Al; and a combination in which the first conductive film 5008 is formed from tantalum nitride (TaN), and the second conductive film 5009 is formed from Cu.

Next, a mask 5010 is formed from a resist, and first etching processing for forming an electrode and wiring is performed. In this embodiment, an ICP (Inductively Coupled Plasma) etching method is used, and $CF_4$ and $Cl_2$ are mixed with a gas for etching. RF (13.56 [MHZ]) power of 500 [W] is applied to the electrode of coil type at a pressure of 1 Pa so that plasma is generated. RF (13.56 [MHZ]) of 100 [W] power is also applied to a substrate side (sample stage), and a substantially negative self bias voltage is applied. When $CF_4$ and $Cl_2$ are mixed, the W film and the Ta film are etched to the same extent.

Under the above etching condition, end portions of a first conductive layer and a second conductive layer are formed into a tapered shape by effects of the bias voltage applied to the substrate side by making the shape of the mask formed from the resist into an appropriate shape. The angle of a taper portion is set to from 15° to 45°. It is preferable to increase an etching time by a ratio of about 10 to 20[%] so as to perform the etching without leaving the residue on the gate insulating film. Since a selection ratio of a silicon nitride oxide film to the W film ranges from 2 to 4 (typically 3), an exposed face of the silicon nitride oxide film is etched by about 20 to 50 [nm] by over-etching processing. Thus, conductive layers 5011 to 5016 of a first shape (first conductive layers 5011*a* to 5016*a* and second conductive layers 5011*b* to 5016*b*) formed of the first and second conductive layers are formed by the first etching processing. A region that is not covered with the conductive layers 5011 to 5016 of the first shape is etched by about 20 to 50 [nm] in the gate insulating film 5007, so that a thinned region is formed. (See FIG. 23A).

Then, an impurity element for giving an n-type conductivity is added by performing first doping processing. A doping method may be either an ion doping method or an ion implantation method. The ion doping method is carried out under the condition that a dose is set to from $1\times10^{13}$ to $5\times10^{14}$ [atoms/cm$^2$], and an acceleration voltage is set to from 60 to 100 [keV]. An element belonging to group 15, typically, phosphorus (P) or arsenic (As) is used as the impurity element for giving the n-type conductivity. However, phosphorus (P) is used here. In this case, the conductive layers 5011 to 5015 serve as masks with respect to the impurity element for giving the n-type conductivity, and first impurity regions 5017 to 5025 are formed in a self-aligning manner. The impurity element for giving the n-type conductivity is added to the first impurity regions 5017 to 5025 in a concentration range from $1\times10^{20}$ to $1\times10^{21}$ [atoms/cm$^3$]. (See FIG. 23B).

Second etching processing is next performed as shown in FIG. 23C. The ICP etching method is similarly used, so that $CF_4$, $Cl_2$ and $O_2$ are mixed with an etching gas, and RF power (13.56 [MHZ]) of 500 [W] is supplied to the electrode of coil type at a pressure of 1 [Pa] to generate plasma. RF (13.56 [MHZ]) power of 50 [W] is applied to the substrate side (sample stage), and a lower self bias voltage is applied in comparison with the self bias voltage in the first etching processing. Anisotropic etching of a W film is performed under such a condition, and anisotropic etching of the Ta film as the first conductive layer is performed at an etching speed slower than that of the anisotropic etching of the W film so that conductive layers 5026 to 5031 of a second shape (first conductive layers 5026*a* to 5031*a* and second conductive layers 5026*b* to 5031*b*) are formed. A region of the gate insulating film 5007 which is not covered with the conductive layers 5026 to 5031 of the second shape is further etched by about 20 to 50 [nm] so that a thinned region is formed.

An etching reaction in the etching of the W film using the mixed gas of $CF_4$ and $Cl_2$ and the Ta film can be assumed from the vapor pressure of a radical or ion species generated and a reaction product. When the vapor pressures of a fluoride and a chloride of W and Ta are compared, the vapor pressure of $WF_6$ as a fluoride of W is extremely high, and vapor pressures of other $WCl_5$, $TaF_5$ and $TaCl_5$ are approximately equal to each other. Accordingly, both the W film and the Ta film are etched using the mixed gas of $CF_4$ and $Cl_2$. However, when a suitable amount of $O_2$ is added to this mixed gas, $CF_4$ and $O_2$ react and become CO and F so that a large amount of F-radicals or F-ions are generated. As a result, the etching speed of the W film whose fluoride has a high vapor pressure is increased. In contrast to this, the increase in etching speed is relatively small for the Ta film when F is increased. Since Ta is easily oxidized in comparison with W, the surface of the Ta film is oxidized by adding $O_2$. Since no oxide of Ta reacts with fluorine or chloride, the etching speed of the Ta film is further reduced. Accordingly, it is possible to make a difference in etching speed between the W film and the Ta film so that the etching speed of the W film can be set to be higher than that of the Ta film.

Figure 24A:
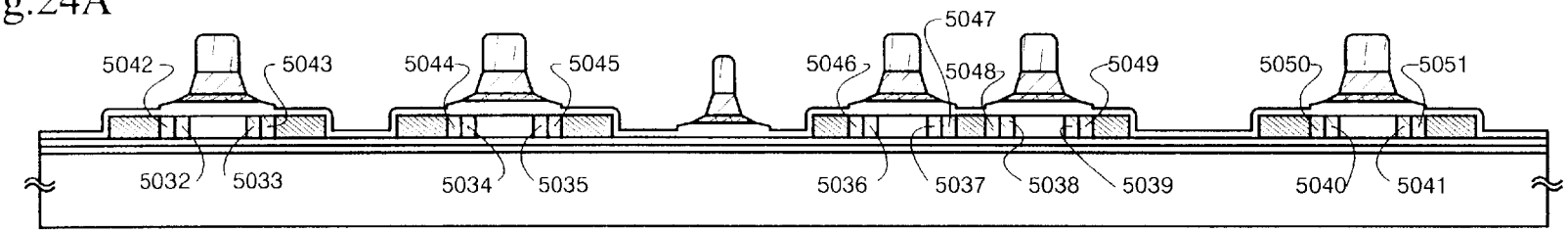
FIGS. 24A to 24C are diagrams showing the method of manufacturing a TFT.

As shown in FIG. 24A, second doping processing is then performed. In this case, an impurity element for giving the n-type conductivity is doped in a smaller dose than in the first doping processing and at a high acceleration voltage by reducing a dose lower than that in the first doping processing. For example, the acceleration voltage is set to from 70 to 120 [keV], and the dose is set to $1\times10^{13}$ [atoms/cm$^2$]. Thus, a new impurity region is formed inside the first impurity region formed in the island-like semiconductor layer in FIG. 23B. In the doping, the conductive layers 5026 to 5030 of the second shape are used as masks with respect to the impurity element, and the doping is performed such that the impurity element is also added to regions underside the first conductive layers 5026*a* to 5030*a*. Thus, third impurity regions 5032 to 5041 overlapped with the first conductive layers 5026*a* to 5030*a*, and second impurity regions 5042 to 5051 between the first and third impurity regions are formed. The impurity element for giving the n-type conductivity is doped such that the concentration of the impurity element ranges from $1\times10^{17}$ to $1\times10^{19}$ [atoms/cm$^3$] in the second impurity region, and the concentration of the impurity element ranges from $1\times10^{16}$ to $1\times10^{18}$ [atoms/cm$^3$] in the third impurity region.

Figure 24B:
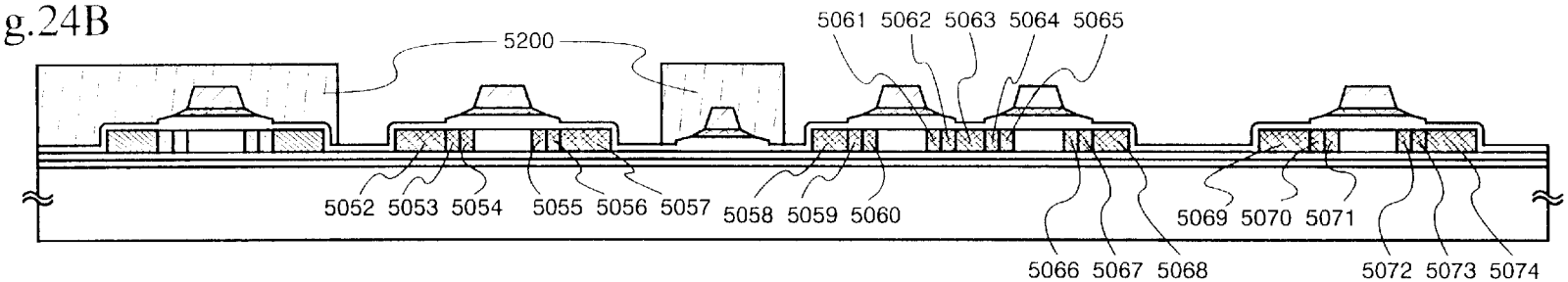

As shown in FIG. 24B, fourth impurity regions 5052 to 5074 having a conductivity type reverse to the first conductivity type are formed in island-like semiconductor layers 5004 to 5006 for forming a p-channel type TFT. The second conductive layers 5027*b* to 5030*b* are used as masks with respect to the impurity element, and the impurity regions are formed in a self-aligning manner. At this time, the entire faces of the island-like semiconductor layer 5003 for forming the n-channel type TFT, and the wiring portion 5031 are covered with a resist mask 5200 in advance. Phosphorus is added to each of impurity regions 5052 to 5074 at different concentrations. However, these regions are formed by the ion doping method using diborane ($B_2H_6$), and the impurity concentration is set to from $2\times10^{20}$ to $2\times10^{21}$ [atoms/cm$^3$] in each of these regions.

The impurity regions are formed in each of the island-like semiconductor layers through the above steps. The conductive layers 5026 to 5030 of the second shape overlapped with the island-like semiconductor layers function as the gate electrode. Further, the region 5031 functions as an island-like signal line.

Figure 24C:
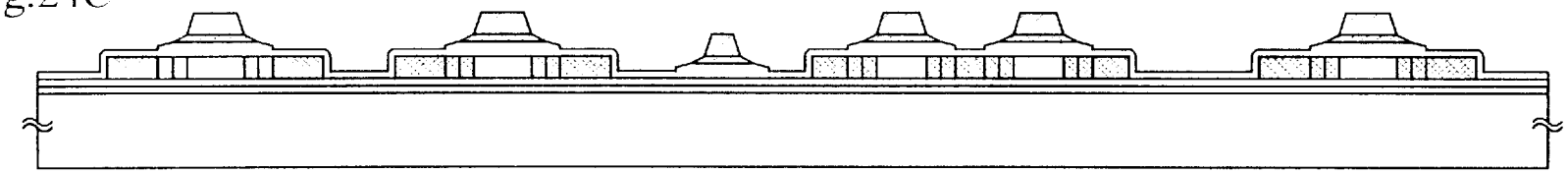

As shown in FIG. 24C, a step of activating the impurity elements added to the island-like semiconductor layers is performed to control the conductivity type. This process is performed by a thermal annealing method using a furnace for furnace annealing. Further, a laser annealing method or a rapid thermal annealing method (RTA method) can be applied. In the thermal annealing method, this process is performed at a temperature of from 400 to 700[° C.], typically from 500 to 600[° C.] within a nitrogen atmosphere in which oxygen concentration is equal to or smaller than 1 [ppm] and is preferably equal to or smaller than 0.1 [ppm]. In this embodiment, heat treatment is performed for four hours at a temperature of 500[° C.]. When a wiring material used in layers 5026 to 5031 is weak against heat, it is preferable to perform activation after an interlayer insulating film (having silicon as a principal component) is formed in order to protect wiring, etc.

Further, the heat treatment is performed for 1 to 12 hours at a temperature of from 300 to 450[° C.] within an atmosphere including 3 to 100[%] of hydrogen so that the island-like semiconductor layer is hydrogenerated. This step is to terminate a dangling bond of the semiconductor layer by hydrogen thermally excited. Plasma hydrogeneration (using hydrogen excited by plasma) may also be performed as another measure for hydrogeneration.

Figures 25A, 25B:
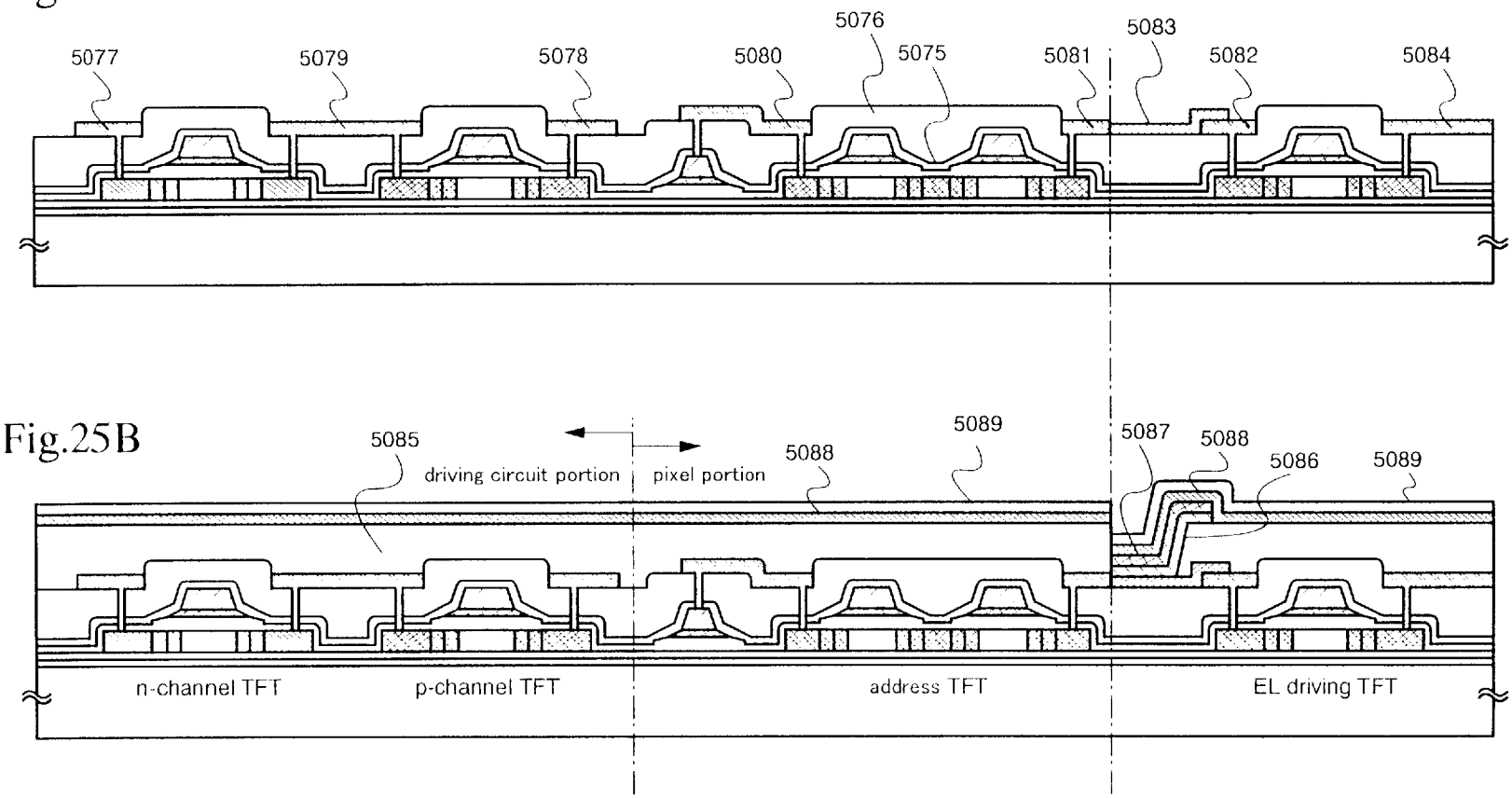
FIGS. 25A and 25B are diagrams showing the method of manufacturing a TFT.

Next, as shown in FIG. 25A, a first interlayer insulating film 5075 is formed from a nitride oxide silicon film to 100 to 200 [nm] thick. The second interlayer insulating film 5076 from an organic insulating material is formed on the first interlayer insulating film. Thereafter, contact holes are formed through the first interlayer insulating film 5075, the second interlayer insulating film 5076 and the gate insulating film 5007. Each wiring (including a connecting wiring and a signal line) 5077 to 5082, and a gate signal line 5084 are patterned and formed. Thereafter, a pixel electrode 5083 coming in contact with the connecting wiring 5082 is patterned and formed.

A film having an organic resin as a material is used as the second interlayer insulating film 5076. Polyimide, polyamide, acrylic, BCB (benzocyclobutene), etc. can be used as this organic resin. In particular, since the second interlayer insulating film 5076 is provided mainly for planarization, acrylic excellent in leveling the film is preferable. In this embodiment, an acrylic film having a thickness that can sufficiently level a level difference caused by the TFT is formed. The film thickness thereof is preferably set to from 1 to 5 [$\mu$m] (is further preferably set to from 2 to 4 [$\mu$m]).

In the formation of the contact holes, contact holes reaching n-type impurity regions 5017 and 5018 or p-type impurity regions 5052 to 5074, a contact hole reaching wiring 5031, an unillustrated contact hole reaching an electric current supply line, and unillustrated contact holes reaching gate electrodes are formed by using dry etching or wet etching.

Further, a laminate film of a three-layer structure is patterned in a desired shape and is used as wiring (including a connecting wiring and signal line) 5077 to 5082, 5084. In this three-layer structure, a Ti film of 100 [nm] in thickness, a Ti-containing aluminum film of 300 [nm] in thickness, and a Ti film of 150 [nm] in thickness are continuously formed by the sputtering method. However, another conductive film may also be used.

In this embodiment, an ITO film of 110 [nm] in thickness is formed as a pixel electrode 5083, and is patterned. Contact is made by arranging the pixel electrode 5083 such that this pixel electrode 5083 comes in contact with the connecting electrode 5082 and is overlapped with this connecting wiring 5082. Further, a transparent conductive film provided by mixing 2 to 20% of zinc oxide (ZnO) with indium oxide may also be used. This pixel electrode 5083 becomes an anode of the EL element. (See FIG. 25A).

As shown in FIG. 25B, an insulating film (a silicon oxide film in this embodiment) containing silicon and having a thickness of 500 [nm] is next formed. A third interlayer insulating film 5085 is formed in which an opening is formed in a position corresponding to the pixel electrode 5083. When the opening is formed, a side wall of the opening can easily be tapered by using the wet etching method. When the side wall of the opening is not gentle enough, deterioration of an EL layer caused by a level difference becomes a notable problem.

Next, an EL layer 5086 and a cathode (MgAg electrode) 5087 are continuously formed by using the vacuum evaporation method without exposing to the atmosphere. The EL layer 5086 has a thickness of from 80 to 200 [nm] (typically from 100 to 120 [nm]), and the cathode 5087 has a thickness of from 180 to 300 [nm] (typically from 200 to 250 [nm]).

In this process, the EL layer is sequentially formed with respect to a pixel corresponding to red, a pixel corresponding to green and a pixel corresponding to blue. In this case, since the EL layer has an insufficient resistance against a solution, the EL layer must be formed separately for each color instead of using a photolithography technique. Therefore, it is preferable to cover a portion except for desired pixels using a metal mask so that the EL layer is formed selectively only in a required portion.

Namely, a mask for covering all portions except for the pixel corresponding to red is first set, and the EL layer for emitting red light are selectively formed by using this mask. Next, a mask for covering all portions except for the pixel corresponding to green is set, and the EL layer for emitting green light are selectively formed by using this mask. Next, a mask for covering all portions except for the pixel corresponding to blue is similarly set, and the EL layer for emitting blue light are selectively formed by using this mask. Here, different masks are used, but instead the same single mask may be used repeatedly.

Next, the cathode 5087 is formed. The cathode 5087 can be formed as a common successive film of each color of EL layers, and also formed selectively in respective colors using a metal mask. In addition, it is preferable to perform processing without breaking a vacuum until the EL layer and the cathode are formed with respect to all the pixels.

Here, a system for forming three kinds of EL elements corresponding to RGB is used. However, a system in which an EL element for emitting white light and a color filter are combined, a system in which the EL element for emitting blue or blue green light is combined with a fluorescent substance (a fluorescent color converting layer: CCM), a system for overlapping the EL elements respectively corresponding to R, G, and B with the cathodes (opposite electrodes) by utilizing a transparent electrode, etc. may be used.

A known material can be used as the EL layer 5086. An organic material is preferably used as the known material in consideration of a driving voltage. For example, a four-layer structure consisting of a hole injection layer, a hole transportation layer, a light emitting layer and an electron injection layer is preferably used for the EL layer. In this embodiment, an MgAg electrode is used as the cathode of the EL element as an example, but another known material may also be used.

Next, a protective electrode 5088 is formed so as to cover the EL layer and the cathode. An conductive film having aluminum as a principal component is used as this protective electrode 5088. The protective electrode 5088 is formed by the vacuum evaporation method using a mask different from the one used when the EL layer and the cathode are formed. After the EL layer and the cathode are formed, the protective electrode 5088 is preferably formed continuously without exposing the formed films to the atmosphere.

Finally, a passivation film 5089 formed of a silicon nitride film and having a thickness of 300 [nm] is formed. In reality, the protective film 5088 plays a role of protecting the EL layer from moisture, etc. However, reliability of the EL element can be further improved by forming the passivation film 5089.

Thus, the structure of the active matrix type self-emission device is completed as shown in FIG. 25B. In the process of forming the active matrix type self-emission device in this embodiment, the source signal line is formed from Ta and W that are materials of the gate electrodes, and the gate signal line is formed from Al that is a wiring material of the source and drain electrodes for conveniences of the circuit construction and procedures in the process. However, different materials may also be used.

The active matrix type substrate in this embodiment has very high reliability and improved operating characteristics by arranging the TFTs of the optimal structures in a driving circuit portion in addition to the pixel portion. Further, in a crystallization process, crystallinity can be also improved by adding a metal catalyst such as Ni. Thus, a driving frequency of the source signal line driving circuit can be set to 10 [MHZ] or more.

First, the TFT having a structure for reducing hot carrier injection so as not to reduce an operating speed as much as possible is used as an n-channel type TFT of a CMOS circuit forming the driving circuit portion. Here, the driving circuit includes a shift register, a buffer, a level shifter, a latch in line sequential driving, a transmission gate in dot sequential driving, etc.

In the case of this embodiment, an active layer of the n-channel type TFT includes a source region, a drain region, a GOLD region, an LDD region and a channel forming region. The GOLD region is overlapped with the gate electrode through the gate insulating film.

Deterioration by the hot carrier injection in the p-channel type TFT of the CMOS circuit is almost neglectible. Therefore, it is not necessary to particularly form the LDD region in this p-channel type TFT. However, similar to the n-channel type TFT, the LDD region can be formed as a hot carrier countermeasure.

Further, when the CMOS circuit for bi-directionally flowing an electric current through a channel forming region, i.e., the CMOS circuit in which roles of the source and drain regions are exchanged is used in the driving circuit, it is preferable for the n-channel type TFT that constitutes the CMOS circuit to form LDD regions such that the channel forming region is sandwiched between the LDD regions. As an example of this, a transmission gate used in the dot sequential driving is given. When a CMOS circuit required to reduce an OFF-state current value as much as possible is used in the driving circuit, the n-channel type TFT forming the CMOS circuit preferably has a construction in which the LDD region is partially overlapped with the gate electrode through the gate insulating film. The transmission gate used in the dot sequential driving can be given also as an example of the TFT as such.

In reality, when the electro-optical device reaches the state of FIG. 25B, it is preferable to perform packaging (sealing) using a protective film (a laminate film, an ultraviolet curable resin film, etc.) that has a high airtight seal property and allows little degasification and a translucent sealing member in order to prevent the EL element from being exposed to the outside air. In this case, reliability of the EL element is improved by filling the interior of the sealing member with an inert gas atmosphere and arranging a moisture absorbing material (e.g., barium oxide) therein.

Further, after the airtight seal property is improved by processing of packaging, etc., a connector (flexible printed circuit: FPC) is attached to complete the device as a product. The connector is for connecting, with an external signal terminal, a terminal led out from the element or the circuit which is formed on the substrate. The device in this state is ready to be shipped and is called a self-emission device in this specification.

Furthermore, in accordance with the processes shown in Embodiment 7, the active matrix substrate can be manufactured by using five photo masks (an island shape semiconductor layer pattern, a first wiring pattern (gate wiring, island-like source wiring, capacitor wiring), an n-channel region mask pattern, a contact hole pattern, and a second wiring pattern (including pixel electrodes and connecting electrodes). As a result, the processes can be reduced, and this contributes to a reduction in the manufacturing costs and an increase in throughput.

Note that it is possible to implement Embodiment 7 in combination with Embodiments 1 to 6.

[Embodiment 8]

In this embodiment, an external light emitting quantum efficiency can be remarkably improved by using an EL material by which phosphorescence from a triplet exciton can be employed for emitting a light. As a result, the power consumption of the EL element can be reduced, the lifetime of the EL element can be elongated and the weight of the EL element can be lightened.

The following is a report where the external light emitting quantum efficiency is improved by using the triplet exciton (T. Tsutsui, C. Adachi, S. Saito, Photochemical processes in Organized Molecular Systems, ed. K. Honda, (Elsevier Sci. Pub., Tokyo, 1991) p. 437).

The molecular formula of an EL material (coumarin pigment) reported by the above article is represented as follows.

[Chemical Formula 1]

(M. A. Baldo, D. F. O'Brien, Y. You, A. Shoustikov, S. Sibley, M. E. Thompson, S. R. Forrest, Nature 395 (1998) p.151)

The molecular formula of an EL material (Pt complex) reported by the above article is represented as follows.

[Chemical Formula 2]

(M. A. Baldo, S. Lamansky, P. E. Burrows, M. E. Thompson, S. R. Forrest, Appl. Phys. Lett., 75 (1999) p.4.)

(T. Tsutsui, M.-J. Yang, M. Yahiro, K. Nakamura, T. Watanabe, T. Tsuji, Y. Fukuda, T. Wakimoto, S. Mayaguchi, Jpn, Appl. Phys., 38 (12B)(1999)L1502).

The molecular formula of an EL material (Ir complex) reported by the above article is represented as follows.

[Chemical Formula 3]

As described above, if phosphorescence from a triplet exciton can be put to practical use, it can realize the external light emitting quantum efficiency three to four times as high as that in the case of using fluorescence from a singlet exciton in principle.

An EL material using the self-emission device of the present invention by which phosphorescence can be employed for emitting a light is not limited to above-mentioned structure. An EL material used for the self-emission device of the present invention is not limited to the EL element by which phosphorescence from a triplet exciton can be employed for emitting a light, but also the EL element by which fluorescence can be employed for emitting light.

Note that it is possible to implement Embodiment 8 in combination with Embodiments 1 to 7.

[Embodiment 9]

The self-emission device fabricated in accordance with the present invention is of the self-emission type, and thus exhibits more excellent recognizability of the displayed image in a light place as compared to the liquid crystal display device. Furthermore, the self-emission device has a wider viewing angle. Accordingly, the self-emission device can be applied to a display portion in various electronic devices.

Such electronic devices include a video camera, a digital camera, a goggles-type display (head mount display), a navigation system, a sound reproduction device (a car audio equipment and an audio set), note-size personal computer, a game machine, a portable information terminal (a mobile computer, a portable telephone, a portable game machine, an electronic book, or the like), an image reproduction apparatus including a recording medium (more specifically, an apparatus which can reproduce a recording medium such as a digital video disc (DVD) and so forth, and includes a display for displaying the reproduced image), or the like. In particular, in the case of the portable information terminal, use of the self-emission device is preferable, since the portable information terminal that is likely to be viewed from a tilted direction is often required to have a wide viewing angle. FIG. 26 respectively show various specific examples of such electronic devices.

Fig, 26A illustrates an EL display device which includes a frame 2001, a support table 2002, a display portion 2003, a speaker portion 2004, a video input terminal 2005 or the like. The present invention is applicable to the display portion 2003. The self-emission device is of the self-emission type and therefore requires no back light. Thus, the display portion thereof can have a thickness thinner than that of the liquid crystal display device. The EL display device is including all of the display device for displaying information, such as a personal computer, a receiver of TV broadcasting and an advertising display.

Figure 26A:
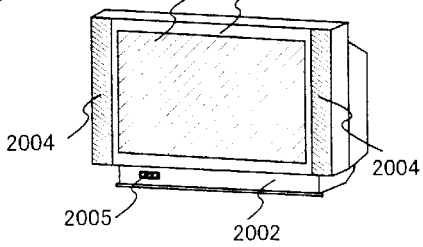
FIGS. 26A to 26H are diagrams showing electronic devices using a self light emitting device of the present invention.
Figure 26B:
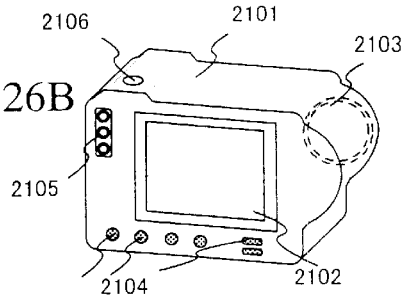

FIG. 26B illustrated a digital still camera which includes a main body 2101, a display portion 2102, an image receiving portion 2103, an operation key 2104, an external connection port 2105, a shutter 2106, or the like. The self-emission device in accordance with the present invention can be used as the display portion 2102.

Figure 26C:
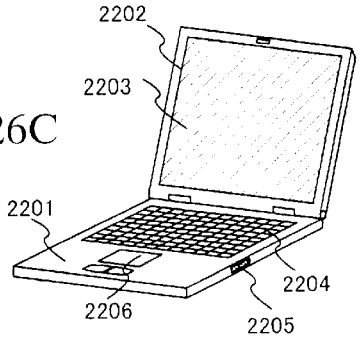

FIG. 26C illustrates a laptop computer which includes a main body 2201, a casing 2202, a display portion 2203, a keyboard 2204, an external connection port 2205, a pointing mouse 2206, or the like. The self-emission device in accordance with the present invention can be used as the display portion 2203.

Figure 26D:
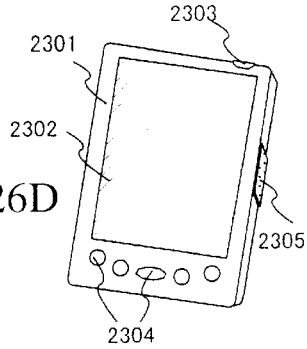

FIG. 26D illustrated a mobile computer which includes a main body 2301, a display portion 2302, a switch 2303, an operation key 2304, an infrared port 2305, or the like. The self-emission device in accordance with the present invention can be used as the display portion 2302.

Figure 26E:
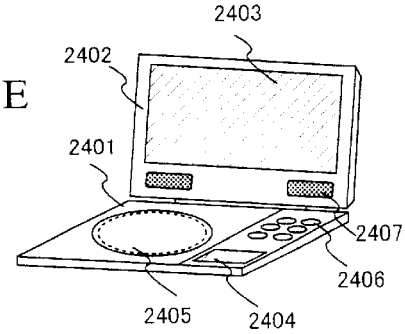

FIG. 26E illustrates an image reproduction apparatus including a recording medium (more specifically, a DVD reproduction apparatus), which includes a main body 2401, a casing 2402, a display portion A 2403, another display portion B 2404, a recording medium (DVD or the like) reading portion 2405, an operation key 2406, a speaker portion 2407 or the like. The display portion A 2403 is used mainly for displaying image information, while the display portion B 2404 is used mainly for displaying character information. The self-emission device in accordance with the present invention can be used as these display portions A and B. The image reproduction apparatus including a recording medium further includes a game machine or the like.

Figure 26F:
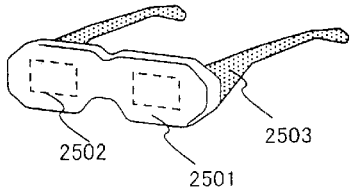

FIG. 26F illustrates a goggle type display (head mounted display) which includes a main body 2501, a display portion 2502, an arm portion 2503. The self-emission device in accordance with the present invention can be used as the display portion 2502.

Figure 26G:
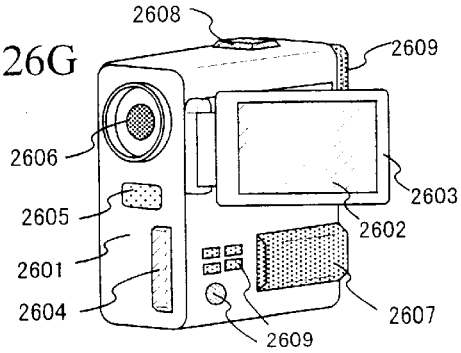

FIG. 26G illustrates a video camera which includes a main body 2601, a display portion 2602, an audio input portion 2603, an external connecting port 2604, a remote control receiving portion 2605, an image receiving portion 2606, a battery 2607, a sound input portion 2608, an operation key 2609, or the like. The self-emission device in accordance with the present invention can be used as the display portion 2602.

Figure 26H:
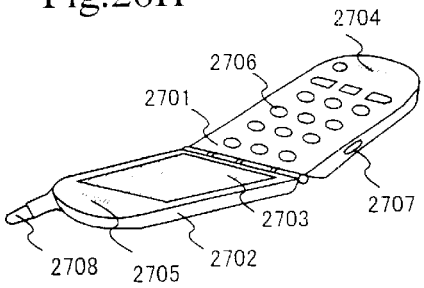
Figures 27A, 27B:
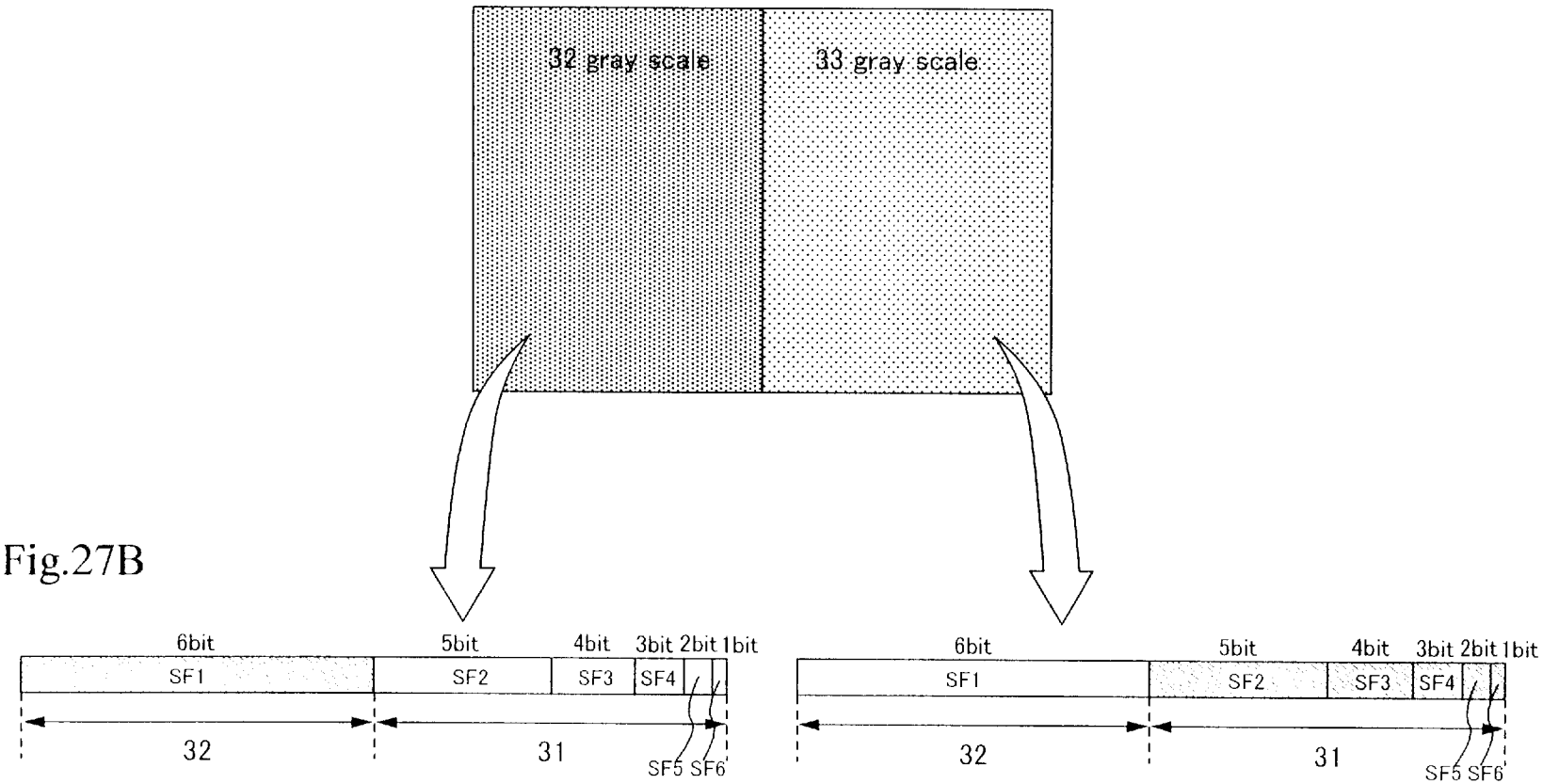
FIGS. 27A and 27B are a diagram of a pixel portion of a self light emitting device using a conventional driving method, and a diagram for expressing the ratio of the lengths of a display period and a divided display period, respectively.
Figure 28A:
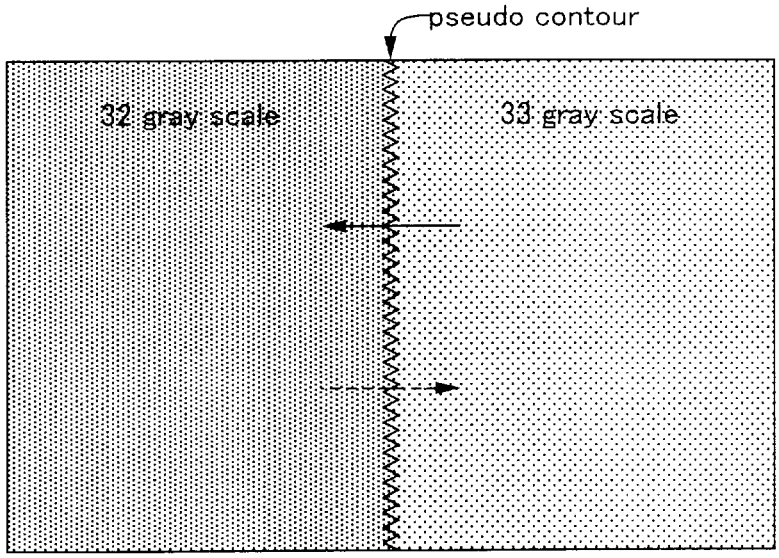
FIGS. 28A and 28B are a diagram of a pixel portion of a self light emitting device using a conventional driving method, and a diagram for expressing the ratio of the lengths of a turn on period and a turn off period, respectively.
Figure 28B:
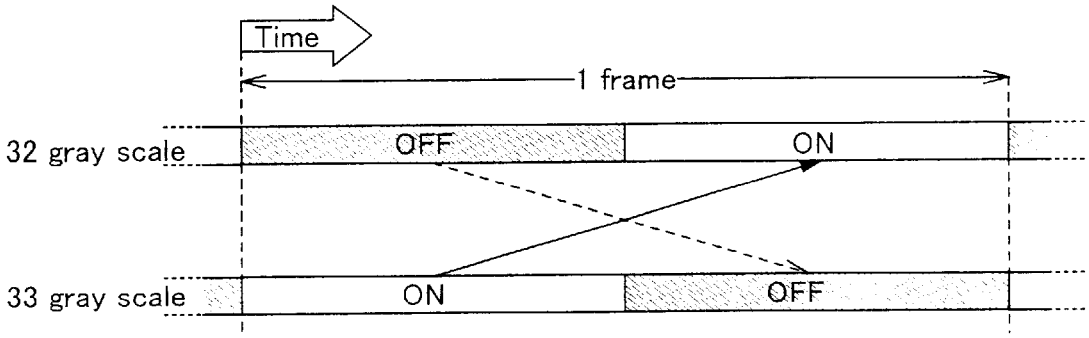

FIG. 26H illustrates a mobile phone which includes a main body 2701, a casing 2702, a display portion 2703, a sound input portion 2704, a sound output portion 2705, an operation key 2706, an external connecting port 2707, an antenna 2708, or the like. The self-emission device in accordance with the present invention can be used as the display portion 2703. Note that the display portion 2703 can reduce power consumption of the portable telephone by displaying white-colored characters on a black-colored background.

When the brighter luminance of light emitted from the organic EL material becomes available in the future, the self-emission device in accordance with the present invention will be applicable to a front-type or rear-type projector in which light including output image information is enlarged by means of lenses or the like to be projected.

The aforementioned electronic devices are more likely to be used for display information distributed through a telecommunication path such as Internet, a CATV (cable television system), and in particular likely to display moving picture information. The self-emission device is suitable for displaying moving pictures since the EL material can exhibit high response speed.

A portion of the self-emission device that is emitting light consumes power, so it is desirable to display information in such a manner that the light emitting portion therein becomes as small as possible. Accordingly, when the self-emission device is applied to a display portion which mainly displays character information, e.g., a display portion of a portable information terminal, and more particular, a portable telephone or a sound reproduction device, it is desirable to drive the self-emission device so that the character information is formed by a light-emitting portion while a non-emission portion corresponds to the background.

As set forth above, the present invention can be applied variously to a wide range of electronic devices in all fields. The electronic device in the present embodiment can be obtained by utilizing a self-emission device having the configuration in which the structures in Embodiments 1 through 8 are freely combined.

Turn on periods and non-turn on periods are divided and appear alternately during one frame period in a self light emitting device of the present invention. Therefore, even if the visual point of a human moves slightly left and right, up and down, and even if only non-turned on pixels are continuously observed, or conversely, only turned on pixels are continuously observed, the length of successive turn on periods or successive non-turn on periods is shorter compared to driving by a conventional simple binary code method. Observation of pseudo contours can therefore be prevented.

The self light emitting device of embodiment mode 1 stores a digital video signal in memory formed within its pixels, and therefore a static image can be continuously displayed without performing input of a digital video signal every frame, provided the writing of the digital video signal is performed once. In other words, it becomes possible to stop the source signal line driving circuit after performing processing operations on signals of at least one frame portion when a static image is displayed, and it thus becomes possible to greatly reduce electric power consumption.

Furthermore, the electric potential of the high voltage side electric power source lines, and the electric potential of the low voltage side electric power source lines, are fixed during periods which are not pixel and memory write in periods in the self light emitting device of embodiment mode 2. The memory formed within the pixel therefore functions as SRAM, and consequently a digital video signal once stored in the memory continues to be stored until the input of another digital video signal. Accordingly, a static image can be continuously displayed without performing input of a digital video signal every frame, provided the writing of the digital video signal is performed once. In other words, it becomes possible to stop the source signal line driving circuit after performing processing operations on signals of at least one frame portion when a static image is displayed, and it thus becomes possible to greatly reduce electric power consumption.

With the above construction, observation of display hindrances such as pseudo contours conspicuous in time division driving by a binary code method can thus be prevented.

What is claimed is:

1. A self light emitting device which comprises a plurality of pixels, each pixel comprising:

an EL element;

a memory;

a first TFT;

a second TFT;

a third TFT;

a source signal line;

an address gate signal line connected to a gate electrode of the first TFT; and a memory gate signal line connected to a gate electrode of the second TFT, wherein:

the source signal line is connected to one of a source region and a drain region of the first TFT, while the other is connected to a gate electrode of the third TFT;

one of a source region and a drain region of the second TFT is connected to the memory, while the other is connected to the gate electrode of the third TFT; and a source region of the third TFT is connected to a first electric power source, and a drain region of the third TFT is connected to the EL element.

2. A self light emitting device according to claim 1, wherein the memory comprises three n-channel TFTs and three p-channel TFTs.

3. A self light emitting device according to claim 2, wherein a gate electrode of one of the three n-channel TFTs is connected to a gate electrode of the first TFT, and a gate electrode of one of the three p-channel TFTs is connected to a gate electrode of the second TFT of a different pixel.

4. A self light emitting device according to claim 2, wherein the memory has two sets of an n-channel TFT and a p-channel TFT which have gate electrodes mutually connected, wherein drain regions of the n-channel TFT and the p-channel TFT are mutually connected, wherein the gate electrodes of one of the two sets of the n-channel TFT and the p-channel TFT are mutually connected to the drain regions of the other, and wherein the drain regions of one of two sets of the n-channel TFT and the p-channel TFT are connected to one of a source region and a drain region of the second TFT.

5. A self light emitting device according to claim 1, wherein said light emitting device is incorporated into an electronic device selected from the group consisting of a digital camera, a video camera, a computer, and a mobile phone.

6. A self light emitting device which comprises a plurality of pixels, each pixel comprising:

an EL element;

a SRAM;

a first TFT;

a second TFT;

a third TFT;

a source signal line;

an address gate signal line connected to a gate electrode of the first TFT; and a memory gate signal line connected to a gate electrode of the second IFT, wherein:

the source signal line is connected to one of a source region and a drain region of the first TFT, while the other is connected to a gate electrode of the third TFT;

one of a source region and a drain region of the second TFT is connected to the SRAM, while the other is connected to the gate electrode of the third TFT; and a source region of the third TFT is connected to a first electric power source, and a drain region of the third TFT is connected to the EL element.

7. A self light emitting device according to claim 6, wherein the SRAM comprises two n-channel TFTs and two p-channel TFTs.

8. A self light emitting device according to claim 7, wherein the SRAM has two sets of an n-channel TFT and a p-channel TFT which have gate electrodes mutually connected, wherein drain regions of the n-channel TFT and the p-channel TFT are mutually connected, wherein the gate electrodes of one of the two sets of the n-channel TFT and the p-channel TFT are mutually connected to the drain regions of the other, and wherein the drain regions of one of two sets of the n-channel TFT and the p-channel TFT are connected to one of a source region and a drain region of the second TFT.

9. A self light emitting device according to claim 6, wherein said light emitting device is incorporated into an electronic device selected from the group consisting of a digital camera, a video camera, a computer, and a mobile phone.

10. A method of driving a self light emitting device which comprises a plurality of pixels, each pixel comprising an EL element, a memory, a first TFT, a second TFT, and a third TFT, the method comprises:

a period during which a p bit of a digital signal is input to a gate electrode of the third TFT through the first TFT, and during which the p bit of the digital signal is written into the memory through the first TFT and the second TFT;

a period during which a q bit of the digital signal is input to the gate electrode of the third TFT through the first TFT, and during which the p bit of the digital signal written into the memory is stored; and a period during which the p bit of the digital signal stored in the memory is read out, and then input to the gate electrode of the third TFT, wherein light emission of the EL element is controlled by controlling switching of the third TFT in accordance with the p bit of the digital signal and the q bit of the digital signal.

11. A method according to claim 10, wherein the memory comprises three n-channel TFTs and three p-channel TFTs.

12. A method according to claim 10, wherein the plurality of divided sub-frame periods need not appear in sequence.

13. A method of driving a self light emitting device which comprises a plurality of pixels, each pixel comprising: an EL element; a memory; a first TFT; a second TFT; and a third TFT formed therein, wherein input of a digital video signal to the pixels is controlled by the first TFT;

wherein write in to the memory and read out from the memory of a portion of bits of the digital video signal input is controlled by the second TFT;

wherein switching of the third TFT is controlled in accordance with the portion of bits of the digital video signal read out from the memory or the digital video signal input to the pixels, and wherein light emission of the EL element is controlled by the third TFT.

14. A method according to claim 13, wherein the memory comprises three n-channel TFTs and three p-channel TFTs.

15. A method according to claim 13, wherein the plurality of divided sub-frame periods need not appear in sequence.

16. A method of driving a self light emitting device comprising a step of:

writing a digital video signal into a memory and into an EL element in a first period of a plurality of divided sub-frame periods;

reading out the digital video signal from the memory in a second period of the plurality of divided sub-frame periods which appears after the first period; and controlling a light emission of the EL element in accordance with the digital video signal;

wherein:

a frame period comprises a plurality of sub-frame periods;

at least one of the plurality of sub-frame periods comprises the plurality of divided sub-frame periods; and the plurality of divided sub-frame periods are distributed within one frame period so as not to appear in succession.

17. A method according to claim 16, wherein the memory comprises three n-channel TFTs and three p-channel TFTs.

18. A method according to claim 16, wherein the plurality of divided sub-frame periods need not appear in sequence.

19. A method of driving a self light emitting device which comprises a plurality of pixels, each pixel comprising an EL element, an SRAM, a first TFT, a second TFT, and a third TFT, the method comprises:

a period during which a p bit of a digital signal is input to a gate electrode of the third TFT through the first TFT, and during which the p bit of the digital signal is written into the SRAM through the first TFT and the second TFT;

a period during which a q bit of the digital signal is input to the gate electrode of the third TFT through the first TFT, and during which the p bit of the digital signal written into the SRAM is stored; and a period during which the p bit of the digital signal stored in the SRAM is read out, and then input to the gate electrode of the third TFT, wherein light emission of the EL element is controlled by controlling switching of the third TFT in accordance with the p bit of the digital signal and the q bit of the digital signal.

20. A method according to claim 19, wherein the SRAM comprises two n-channel TFTs and two p-channel TFTs.

21. A method according to claim 19, wherein the plurality of divided sub-frame periods need not appear in sequence.

22. A method of driving a self light emitting device which comprises a plurality of pixels, each pixel comprising: an EL element; an SRAM; a first TFT; a second TFT; and a third TFT formed therein, wherein input of a digital video signal to the pixels is controlled by the first TFT;

wherein write in to the memory and read out from the memory of a portion of bits of the digital video signal input is controlled by the second TFT;

wherein switching of the third TFT is controlled in accordance with the portion of bits of the digital video signal read out from the SRAM or the digital video signal input to the pixels, and wherein light emission of the EL element is controlled by the third TFT.

23. A method according to claim 22, wherein the SRAM comprises two n-channel TFTs and two p-channel TFTs.

24. A method according to claim 22, wherein the plurality of divided sub-frame periods need not appear in sequence.

25. A method of driving a self light emitting device comprising a step of:

writing a digital video signal into a SRAM and into an EL element in a first period of a plurality of divided sub-frame periods;

reading out the digital video signal from the SRAM in a second period of the plurality of divided sub-frame periods which appears after the first period; and controlling a light emission of the EL element in accordance with the digital video signal;

wherein:

a frame period comprises a plurality of sub-frame periods;

at least one of the plurality of sub-frame periods comprises the plurality of divided sub-frame periods; and the plurality of divided sub-frame periods are distributed within one frame period so as not to appear in succession.

26. A method according to claim 25, wherein the SRAM comprises two n-channel TFTs and two p-channel TFTs.

27. A method according to claim 25, wherein the plurality of divided sub-frame periods need not appear in sequence.

28. A self light emitting device which comprises a plurality of pixels, each pixel comprising:

an EL element;

a memory;

a first TFT;

a second TFT;

a third TFT;

a source signal line; and an address gate signal line connected to a gate electrode of the first TFT and the memory, wherein:

the source signal line is connected to one of a source region and a drain region of the first TFT, while the other is connected to a gate electrode of the third TFT;

one of a source region and a drain region of the second TFT is connected to the memory, while the other is connected to the gate electrode of the third TFT; and a source region of the third TFT is connected to a first electric power source, and a drain region of the third TFT is connected to the EL element.

29. A self light emitting device according to claim 28, wherein the memory comprises three n-channel TFTs and three p-channel TFTs.

30. A self light emitting device according to claim 29, wherein a gate electrode of one of the three n-channel TFTs is connected to a gate electrode of the first TFT, and a gate electrode of one of the three p-channel TFTs is connected to a gate electrode of the second TFT of a different pixel.

31. A self light emitting device according to claim 29, wherein the memory has two sets of an n-channel TFT and a p-channel TFT which have gate electrodes mutually connected, wherein drain regions of the n-channel TFT and the p-channel TFT are mutually connected, wherein the gate electrodes of one of the two sets of the n-channel TFT and the p-channel TFT are mutually connected to the drain regions of the other, and wherein the drain regions of one of two sets of the n-channel TFT and the p-channel TFT are connected to one of a source region and a drain region of the second TFT.

32. A self light emitting device which comprises a plurality of pixels, each pixel comprising:

an EL element;

a SRAM;

a first TFT;

a second TFT;

a third TFT;

a source signal line; and an address gate signal line connected to a gate electrode of the first TFT and the SRAM, wherein:

the source signal line is connected to one of a source region and a drain region of the first TFT, while the other is connected to a gate electrode of the third TFT;

one of a source region and a drain region of the second TFT is connected to the SRAM, while the other is connected to the gate electrode of the third TFT; and a source region of the third TFT is connected to a first electric power source, and a drain region of the third TFT is connected to the EL element.

33. A self light emitting device according to claim 32, wherein the SRAM comprises two n-channel TFTs and two p-channel TFTs.

34. A self light emitting device according to claim 33, wherein the SRAM has two sets of an n-channel TFT and a p-channel TFT which have gate electrodes mutually connected, wherein drain regions of the n-channel TFT and the p-channel TFT are mutually connected, wherein the gate electrodes of one of the two sets of the n-channel TFT and the p-channel TFT are mutually connected to the drain regions of the other, and wherein the drain regions of one of two sets of the n-channel TFT and the p-channel TFT are connected to one of a source region and a drain region of the second TFT.

* * * * *

UNITED STATES PATENT AND TRADEMARK OFFICE

CERTIFICATE OF CORRECTION

PATENT NO. : 6,774,876 B2
DATED : August 10, 2004
INVENTOR(S) : Kazutaka Inukai

It is certified that error appears in the above-identified patent and that said Letters Patent is hereby corrected as shown below:

Column 29,
Line 64, delete “resister” and insert -- register --;

Column 30,
Lines 4 and 7, delete “resister” and insert -- register --.

Signed and Sealed this

Twenty-fifth Day of January, 2005

JON W. DUDAS
*Director of the United States Patent and Trademark Office*